US007876180B2

(12) United States Patent
Uchimura

(10) Patent No.: US 7,876,180 B2
(45) Date of Patent: Jan. 25, 2011

(54) WAVEGUIDE FORMING APPARATUS, DIELECTRIC WAVEGUIDE FORMING APPARATUS, PIN STRUCTURE, AND HIGH FREQUENCY CIRCUIT

(75) Inventor: Hiroshi Uchimura, Kirishima (JP)

(73) Assignee: Kyocera Corporation, Kyoto (JP)

( * ) Notice: Subject to any disclaimer, the term of this patent is extended or adjusted under 35 U.S.C. 154(b) by 191 days.

(21) Appl. No.: 12/282,321

(22) PCT Filed: Mar. 8, 2007

(86) PCT No.: PCT/JP2007/054593

§ 371 (c)(1),
(2), (4) Date: Sep. 9, 2008

(87) PCT Pub. No.: WO2007/102591

PCT Pub. Date: Sep. 13, 2007

(65) Prior Publication Data

US 2009/0072924 A1 Mar. 19, 2009

(30) Foreign Application Priority Data

Mar. 9, 2006 (JP) ..... 2006-064482
Mar. 30, 2006 (JP) ..... 2006-096034
Jul. 31, 2006 (JP) ..... 2006-209312

(51) Int. Cl.
*H01P 3/16* (2006.01)
*H01P 5/04* (2006.01)

(52) U.S. Cl. ..... 333/248; 333/239

(58) Field of Classification Search ..... 333/17.1, 333/208, 209, 239, 248
See application file for complete search history.

(56) References Cited

U.S. PATENT DOCUMENTS 5,473,296 A 12/1995 Ishikawa et al.
6,057,747 A 5/2000 Takenoshita et al.
6,064,350 A 5/2000 Uchimura et al.
6,359,535 B1 3/2002 Uchimura et al.
7,142,165 B2 * 11/2006 Sanchez et al. ..... 343/771
2004/0041663 A1 3/2004 Uchimura et al.

FOREIGN PATENT DOCUMENTS

JP 43019462 B1 8/1968
JP 06-260814 9/1994
JP 07-094915 4/1995
JP 10-075108 3/1998
JP 11-046114 2/1999

(Continued)

OTHER PUBLICATIONS

International search report for corresponding PCT application PCT/JP2007/054593 list the reference above.

*Primary Examiner*—Dean O Takaoka
(74) *Attorney, Agent, or Firm*—DLA Piper LLP (US)

(57) ABSTRACT

There are provided a waveguide forming apparatus, a dielectric waveguide forming apparatus, a pin structure and a high frequency circuit that can optimize a circuit portion provided therein and have high versatility. A waveguide is formed by allowing first and second conductive layers (6, 7) to cooperate with a plurality of control pins (2). A variable high frequency circuit forming portion is freely and simply changed by displacing each control pin (2) between a down-status indicated by Z1 and an up-status indicated by Z2.

13 Claims, 39 Drawing Sheets

FOREIGN PATENT DOCUMENTS

| | | |
|---|---|---|
| JP | 11-112210 | 4/1999 |
| JP | 11-186816 | 7/1999 |
| JP | 11-284409 | 10/1999 |
| JP | 2001-230608 | 8/2001 |
| JP | 2002-171102 | 6/2002 |
| JP | 2005-051332 | 2/2005 |

* cited by examiner

WAVEGUIDE FORMING APPARATUS, DIELECTRIC WAVEGUIDE FORMING APPARATUS, PIN STRUCTURE, AND HIGH FREQUENCY CIRCUIT

CROSS-REFERENCE TO THE RELATED APPLICATIONS

This application is a national stage of international application No. PCT/JP2007/054593 filed Mar. 8, 2007, which also claims the benefit of priority under 35 U.S.C. §119 to Japanese Patent Application No. 2006-064482 filed Mar. 9, 2006, Japanese Patent Application No. 2006-096034 filed Mar. 30, 2006 and Japanese Patent Application No. 2006-209312 filed Jul. 31, 2006, the entire contents of all of which are incorporated herein by reference.

TECHNICAL FIELD

The present invention relates to a waveguide forming apparatus, a dielectric waveguide forming apparatus, a pin structure, and a high frequency circuit, and, for example, relates to techniques preferably applied to a high frequency circuit component such as an antenna, a filter, or a coupler circuit.

BACKGROUND ART

Recently, research on software-defined radios is being intensively conducted (see Japanese Patent Nos. 3686736, 3439973, and 3517097, Japanese Unexamined Patent Publication JP-A 11-284409 (1999), and Japanese Patent No. 3420474). For example, it is possible to change a mobile terminal between multiple modes such as car navigation apparatuses and terrestrial television receiving terminals, by replacing existing software of the mobile terminal to change the configuration thereof. Development in increasing the scale of field programmable gate arrays (abbreviated as FPGAs), increasing the speed of digital signal processors (abbreviated as DSPs), putting reconfigurable processors (abbreviated as RCPs) into practice, increasing the speed of A/D (analog to digital) or D/A (digital to analog) converters, and increasing the speed of data transmission interfaces has made a significant contribution to the realization of this technique for software-defined radios (see OKI "Technical Review" October 2005, OTR204, Vol. 72, No. 4, pp. 80-85, and "IEICE Technical Report" ED2005-116, OME2005-42(2005-09), pp. 45-50, for example).

In particular, FPGAs have made a significant contribution to putting software-defined radios into practice, and constitute a core technique thereof. FPGAs can support various modulation and demodulation processes, by changing the processing itself of digitalized signals by means of programmable circuits. Thus, as the premise, the radio portion is required to have a wide band.

However, it is difficult to realize programmable center frequency and passband of wideband antennas or filters that are required for this method. Thus, it is necessary to prepare a filter bank and switch a plurality of filters as needed. Furthermore, a direct conversion method and the like have been also investigated (see OKI "Technical Review" October 2005, OTR204, Vol. 72, No. 4, pp. 80-85, and "IEICE Technical Report" ED2005-116, OME2005-42(2005-09), pp. 45-50).

In conventional techniques, the passband of a radio portion, namely, a high frequency circuit component such as an antenna or a filter is limited, or a plurality of types of such high frequency circuit components are provided and selectively used. With radio portions in which the passband is limited, a software-defined radio cannot be realized that can be changed between multiple modes. With radio portions in which a plurality of types of high frequency circuit components are provided and selectively used, the structure of the high frequency circuit components becomes large and complex, which lacks versatility.

A technique using the direct conversion method has the following problem. The transmission side needs to have a function of converting a digital signal transmitted from a signal processing portion into an analog signal, and upconverting the signal to a desired radio frequency over a wide band. On the reception side, in a case where a plurality of high level signals are inputted to a desired band in a frequency converting portion, there is the problem that the dynamic range is lowered and a non-linear distortion of a mixer occurs.

DISCLOSURE OF INVENTION

An object of the invention is to provide a waveguide forming apparatus, a dielectric waveguide forming apparatus, a pin structure, and a high frequency circuit that can optimize a circuit portion provided therein and have high versatility.

The invention is directed to a waveguide forming apparatus, comprising:

a circuit forming portion that can change a waveguide shape for forming a waveguide; and control portion for controlling the circuit forming portion so as to change the waveguide shape of the circuit forming portion based on expected information.

According to the invention, the control portion changes the waveguide shape of the circuit forming portion based on expected information. Thus, the circuit forming portion can be easily changed. Compared with a conventional technique in which a plurality of types of high frequency circuit components are selectively used, it is possible to simplify the structure and optimize the circuit forming portion. Thus, a waveguide forming apparatus having high versatility can be realized.

Furthermore, in the invention, the circuit forming portion may include a pair of conductive layers that are spaced away from each other, and a plurality of movable members that can form a waveguide in cooperation with the conductive layers, and each of the movable members can be displaced between a wall portion forming state in which the movable member forms a part of a wall portion of the waveguide and a wall portion non-forming state.

According to the invention, the pair of conductive layers and the plurality of movable members can cooperate with each other to form a waveguide. Each of the movable members is displaced between the wall portion forming state and the wall portion non-forming state, so that the circuit forming portion can be easily changed.

Furthermore, in the invention, the waveguide forming apparatus may further comprise a driving source that drives displacement of each of the movable members between the wall portion forming state and the wall portion non-forming state, and the control portion controls driving of the driving source.

According to the invention, the control portion controls driving of the driving source, so that each of the movable members is driven to be displaced between the wall portion forming state and the wall portion non-forming state. In this manner, the waveguide shape can be changed.

Furthermore, in the invention, the control portion may control so as to change the circuit forming portion to have a waveguide shape of at least one of a power divider, a filter circuit, and a coupler.

According to the invention, the circuit forming portion is changed to have a waveguide shape of at least one of a power divider, a filter circuit, and a coupler. In this manner, the versatility of the waveguide forming apparatus can be increased.

Moreover, the invention is directed to a pin structure that can form a wall portion of a waveguide in cooperation with a plurality of conductive layers that are spaced away from each other, the pin structure being displaceable between a wall portion forming state in which the pin structure forms the wall portion and a wall portion non-forming state.

According to the invention, the pin structure can form a wall portion of a waveguide in cooperation with a plurality of conductive layers that are spaced away from each other. More specifically, the pin structure is displaced to the wall portion forming state, so that the pin structure can function as a wall portion of a waveguide. Thus, a pin structure can be realized that can optimize the circuit forming portion.

Moreover, the invention is directed to a high frequency circuit, comprising:

a pair of conductive layers that are spaced away from each other;

a plurality of control pins that are made of a conductive material, and arranged so as to be displaceable through holes that are formed in at least one of the pair of conductive layers, in a thickness direction of the conductive layer; and control portion for controlling a displacement position of the control pins in the thickness direction, two rows of slots being formed in at least one of the pair of conductive layers, the two rows of slots being arranged such that a longitudinal direction of one row of the slots is perpendicular to a longitudinal direction of the other row of the slots, and control of the control portion being executed so that switching can be performed between a state in which vertically polarized waves are emitted from one row of the slots and a state in which horizontally polarized waves are emitted from the other row of the slots.

According to the invention, the control portion can perform switching between a state in which vertically polarized waves are emitted from one row of the slots and a state in which horizontally polarized waves are emitted from the other row of the slots, by controlling the displacement position of the control pins. That is to say, switching can be performed between a vertical polarized antenna and a horizontal polarized antenna, using the pair of conductive layers and the plurality of control pins. In this manner, a high frequency circuit having high versatility can be realized.

Moreover, the invention is directed to a dielectric waveguide forming apparatus, comprising:

a circuit forming portion that can change a dielectric waveguide shape for forming a dielectric waveguide; and control portion for controlling the circuit forming portion so as to change the dielectric waveguide shape of the circuit forming portion based on expected information.

According to the invention, the control portion changes the dielectric waveguide shape of the circuit forming portion based on expected information. Thus, the circuit forming portion can be easily changed. Compared with a conventional technique in which a plurality of types of high frequency circuit components are selectively used, it is possible to simplify the structure and optimize the circuit forming portion. Thus, a dielectric waveguide forming apparatus having high versatility can be realized.

Furthermore, in the invention, the circuit forming portion may include a pair of conductive layers that are spaced away from each other, and a plurality of movable members that can form a dielectric waveguide in cooperation with the conductive layers, and each of the movable members can be displaced between a dielectric waveguide forming state in which the movable member forms a part of the dielectric waveguide and a dielectric waveguide non-forming state.

According to the invention, the pair of conductive layers and the plurality of movable members can cooperate with each other to form a dielectric waveguide. In a case where each of the movable members is displaced between the dielectric waveguide forming state and the dielectric waveguide non-forming state, the circuit forming portion can be easily changed.

Furthermore, in the invention, the dielectric waveguide forming apparatus may further comprise a driving source that drives displacement of each of the movable members between the dielectric waveguide forming state and the dielectric waveguide non-forming state, and the control portion may control driving of the driving source.

According to the invention, the control portion controls driving of the driving source, so that each of the movable members is driven to be displaced between the dielectric waveguide forming state and the dielectric waveguide non-forming state. In this manner, the dielectric waveguide shape can be changed.

Furthermore, in the invention, the control portion may control so as to change the circuit forming portion to have a dielectric waveguide shape of at least one of a filter circuit and a coupler.

According to the invention, the circuit forming portion is changed to have a dielectric waveguide shape of at least one of a filter circuit and a coupler. In this manner, the versatility of the dielectric waveguide forming apparatus can be increased.

Moreover, the invention is directed to a pin structure that can form a dielectric waveguide in cooperation with a plurality of conductive layers that are spaced away from each other, the pin structure being displaceable between a dielectric waveguide forming state in which the pin structure forms the dielectric waveguide and a dielectric waveguide non-forming state.

According to the invention, the pin structure can form a dielectric waveguide in cooperation with a plurality of conductive layers that are spaced away from each other. More specifically, in a case where the pin structure is displaced to the dielectric waveguide forming state, the pin structure can function as a dielectric waveguide. Thus, a pin structure can be realized that can optimize the circuit forming portion.

Moreover, the invention is directed to a high frequency circuit, comprising:

a pair of conductive layers that are spaced away from each other;

a plurality of control pins that are made of a conductive material, and arranged so as to be displaceable through holes that are formed in at least one of the pair of conductive layers, in a thickness direction of the conductive layer; and control portion for controlling a displacement position of the control pins in the thickness direction, the control portion forming an H guide or NRD guide, with the control pins whose displacement position in the thickness direction is controlled and the pair of conductive layers.

According to the invention, the control portion can form an H guide or a nonradiative dielectric waveguide (abbreviated as an NRD guide), with the control pins whose displacement position in the thickness direction is controlled and the pair of conductive layers, by controlling the displacement position of the control pins. The interval between conductive plates of the NRD guide is prescribed in advance according to the interval between the pair of conductive layers. The thickness of a dielectric strip is variously prescribed according to the dimension of the control pins in the direction that is perpendicular to the displacement direction. Thus, a high frequency circuit having high versatility can be realized by controlling the displacement position of the control pins.

Furthermore, in the invention, the circuit forming portion may include one conductive layer and a plurality of movable members that can form a dielectric waveguide in cooperation with the conductive layer, and each of the movable members can be displaced between a dielectric waveguide forming state in which the movable member forms a part of the dielectric waveguide and a dielectric waveguide non-forming state.

According to the invention, one conductive layer and the plurality of movable members can cooperate with each other to form a dielectric waveguide. In a case where each of the movable members is displaced between the dielectric waveguide forming state and the dielectric waveguide non-forming state, the circuit forming portion can be easily changed. In particular, compared with the structure that includes two conductive layers, it is possible to simplify the structure. The orientation of an electric field that is to be transmitted may be either perpendicular or parallel to the conductive material, and thus the versatility of the dielectric waveguide forming apparatus can be further increased.

Furthermore, in the invention, the dielectric waveguide forming apparatus may further comprise a driving source that drives displacement of each of the movable members between the dielectric waveguide forming state and the dielectric waveguide non-forming state, and the control portion may control driving of the driving source.

According to the invention, the control portion controls driving of the driving source, so that each of the movable members is driven to be displaced between the dielectric waveguide forming state and the dielectric waveguide non-forming state. In this manner, the dielectric waveguide shape can be changed.

Furthermore, in the invention, the control portion may control so as to change the circuit forming portion to have a dielectric waveguide shape of at least one of a power divider, a filter circuit, and a coupler.

According to the invention, the circuit forming portion is changed to have a dielectric waveguide shape of at least one of a power divider, a filter circuit, and a coupler. In this manner, the versatility of the dielectric waveguide forming apparatus can be increased.

Moreover, the invention is directed to a pin structure that can form a dielectric waveguide in cooperation with one conductive layer, the pin structure being displaceable between a dielectric waveguide forming state in which the pin structure forms the dielectric waveguide and a dielectric waveguide non-forming state.

According to the invention, the pin structure can form a dielectric waveguide in cooperation with one conductive layer. More specifically, in a case where the pin structure is displaced to the dielectric waveguide forming state, the pin structure group can function as a dielectric waveguide. Thus, a pin structure can be realized that can optimize the circuit forming portion.

BRIEF DESCRIPTION OF DRAWINGS

Other and further objects, features, and advantages of the invention will be more explicit from the following detailed description taken with reference to the drawings.

FIG. 5A is a plan view showing a circuit pattern in which electric power is equally distributed to a second port Pt2 and a third port Pt3, FIG. 5B is a plan view showing a circuit pattern in which a plurality of rows of groups of control pins forming an E-plane of the waveguide are arranged, and FIG. 5C is a plan view showing a circuit pattern in which the distribution ratio of electric power between the second port Pt2 and the third port Pt3 is shifted.

FIG. 6A is a plan view showing a circuit pattern of a linear waveguide structure, and FIG. 6B is a plan view showing a circuit pattern provided with a filtering function.

FIGS. 7A and 78 are plan views showing circuit patterns, where FIG. 7A is a plan view showing a circuit pattern with the structure in which two linear waveguide structures are in contact with each other.

FIG. 8A is a plan view showing a circuit pattern in which high frequency signals inputted from the first port Pt1 are emitted from a slot 16, and FIG. 5B is a plan view showing a circuit pattern in which high frequency signals inputted from the first port Pt1 are emitted from a slot 17.

FIG. 9A is a plan view showing a circuit pattern in which high frequency signals inputted from the first port Pt1 resonate within a region S1 surrounded in the shape of a circle, and are emitted from an antenna opening portion Ah, and FIG. 9B is a plan view showing a circuit pattern in which the frequency properties are shifted to the low frequency side.

FIG. 15A is a plan view showing a circuit pattern in which the control pins are arranged to have the function of a coupler, and FIG. 15B is a plan view showing a circuit pattern in which the coupling gap is made wider than that in the circuit pattern in FIG. 15A.

FIG. 16A is a plan view showing a circuit pattern of a linear dielectric waveguide structure, and FIG. 16B is a plan view showing a circuit pattern provided with a filtering function.

FIG. 23A is a plan view showing a circuit pattern in which electric power is equally distributed to a second port Pt2 and a third port Pt3, and FIG. 23B is a plan view showing a circuit pattern in which the distribution ratio of electric power between the second port Pt2 and the third port Pt3 is shifted.

FIG. 24A is a plan view showing a circuit pattern of a linear dielectric waveguide structure, and FIG. 24B is a plan view showing a circuit pattern provided with a filtering function.

FIG. 25A is a plan view showing a circuit pattern, and FIG. 25B is a graph showing a simulation result obtained in this circuit pattern.

FIG. 26A is a plan view showing a circuit pattern, and FIG. 26B is a graph showing a simulation result obtained in this circuit pattern.

FIG. 27A is a plan view showing a circuit pattern, and FIG. 27B is a graph showing a simulation result obtained in this circuit pattern.

BEST MODE FOR CARRYING OUT THE INVENTION

Figure 1:
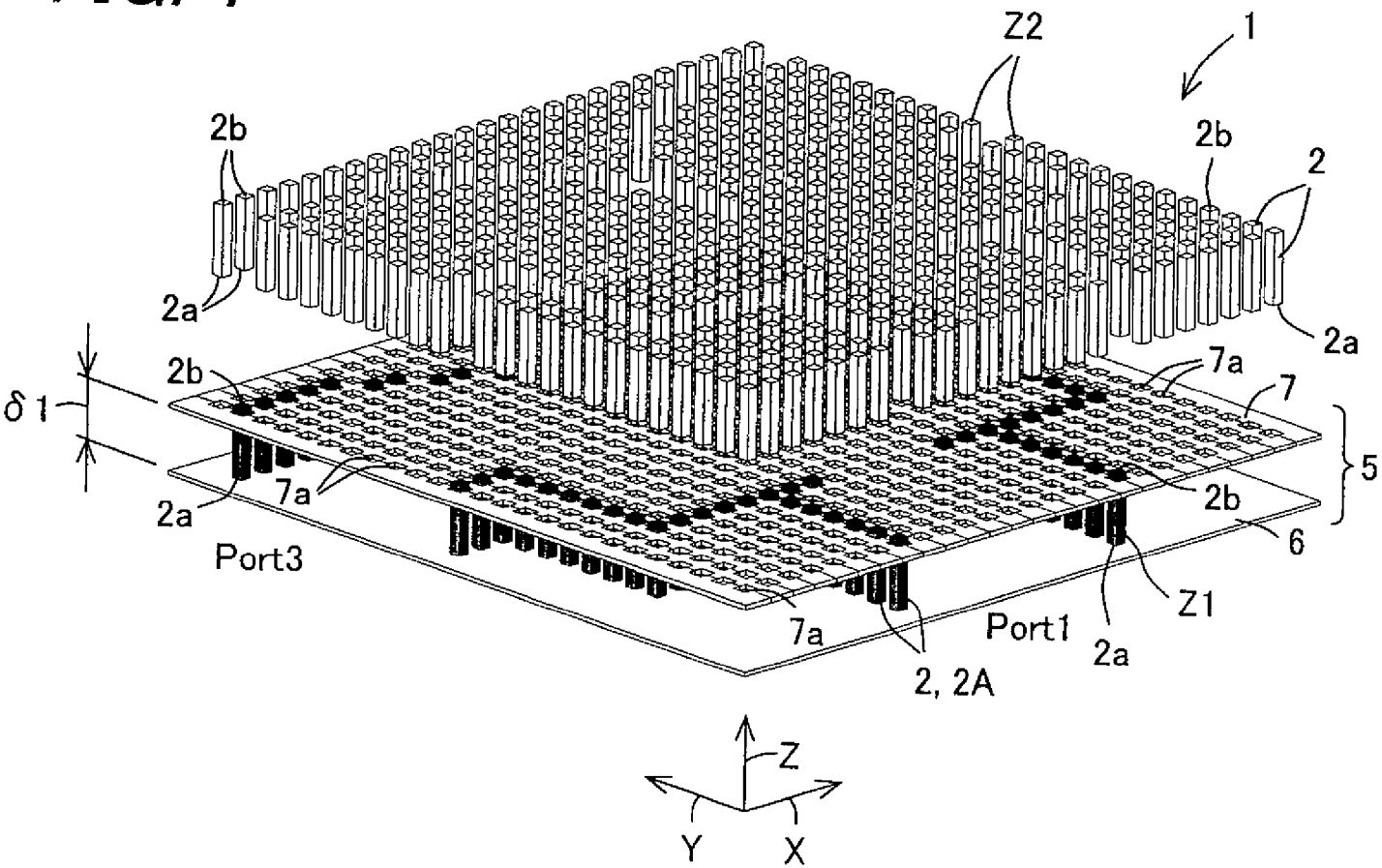
FIG. 1 is a perspective view showing a variable high frequency circuit forming portion 3 according to a first embodiment of the invention.

Now referring to the drawings, preferred embodiments of the invention are described below. In the description of the embodiments, a portion corresponding to that described in a foregoing embodiment may be denoted by the same reference numeral, and the description thereof may not be repeated. In a case where only a part of a configuration is described, the other portions of the configuration are similar to those previously described. In addition to a combination of portions specifically described in embodiments, a partial combination of the embodiments is also possible as long as the combination does not cause any problem. A variable high frequency circuit according to the embodiments is applicable to a plurality of high frequency circuit components such as antennas, waveguides, power dividers, couplers, and filter circuits. In the description below, a method for controlling a variable high frequency circuit, and a pin structure of control pins are also described.

Figure 2:
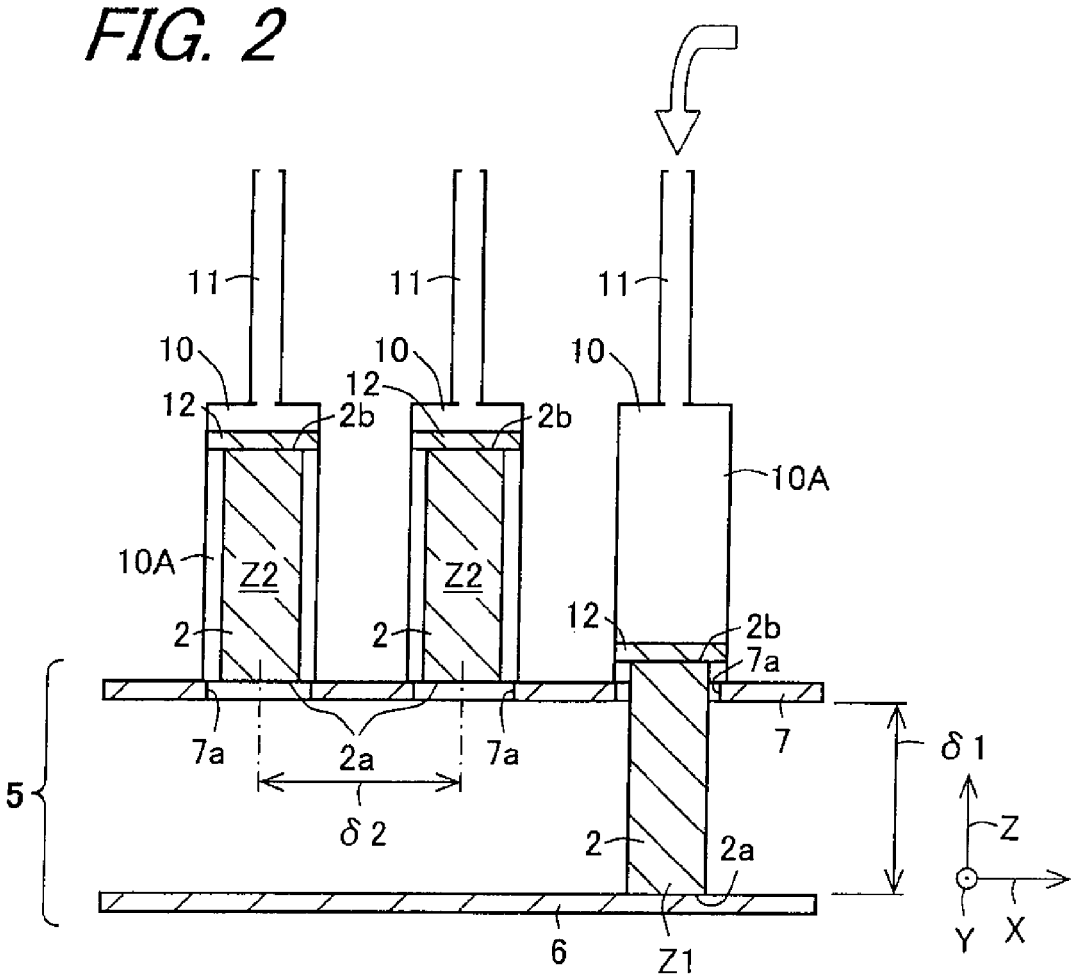
FIG. 2 is a cross-sectional view of the main portions of a driving portion of control pins 2, taken along a virtual plane containing the direction in which the pins are projected and withdrawn.
Figure 3:
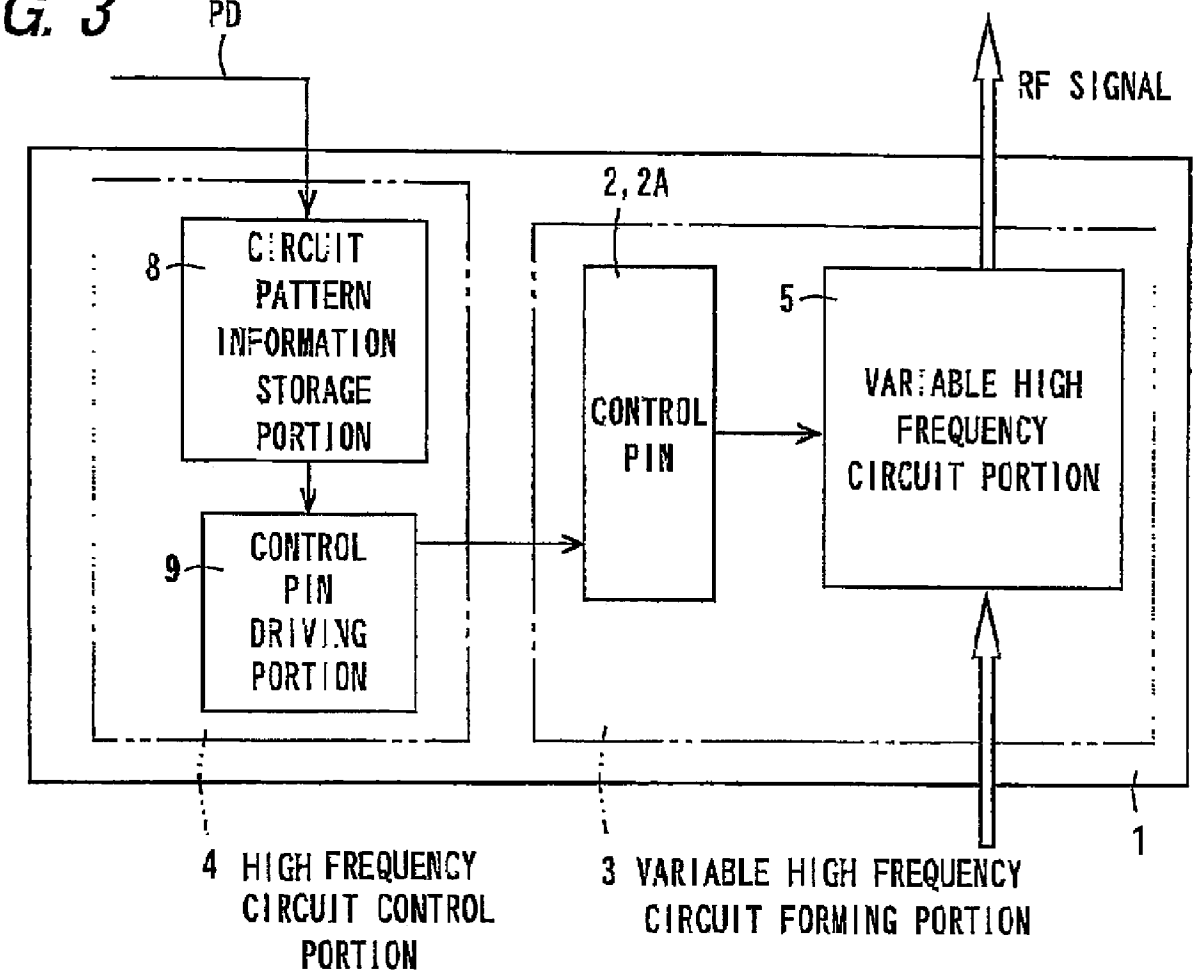
FIG. 3 is a block diagram showing the electric configuration of a variable high frequency circuit 1 according to the first embodiment.

FIG. 1 is a perspective view showing a variable high frequency circuit forming portion 3 according to a first embodiment of the invention. FIG. 2 is a cross-sectional view of the main portions of a driving portion of control pins 2, taken along a virtual plane containing the direction in which the pins are projected and withdrawn. FIG. 3 is a block diagram showing the electric configuration of a variable high frequency circuit 1 according to the first embodiment. The variable high frequency circuit 1 according to the first embodiment is referred to as a "first high frequency circuit 1". The first high frequency circuit 1 includes the variable high frequency circuit forming portion 3 as a circuit forming portion and a high frequency circuit control portion 4 as control means. The variable high frequency circuit forming portion 3 is a circuit forming portion that can change the waveguide shape for forming a waveguide. The high frequency circuit control portion 4 controls so as to change the waveguide shape of the circuit forming portion based on expected information. First, the variable high frequency circuit forming portion 3 will be described.

The variable high frequency circuit forming portion 3 has a variable high frequency circuit portion 5 and a plurality of control pins 2 (corresponding to movable members). The variable high frequency circuit portion 5 includes a first and a second conductive layer 6 and 7. The first and the second conductive layers 6 and 7 are a pair of conductive layers that form a so-called H-plane of the waveguide, and are arranged in parallel so as to be spaced away from each other by a predetermined small distance $\delta 1$. The conductive layers 6 and 7 are formed, for example, in the shape of a rectangular plate when viewed from above. The thickness direction of the first and the second conductive layers 6 and 7 is defined as a Z direction. The direction that is parallel to one side of the first conductive layer 6 is defined as an X direction. The direction that is perpendicular to the X and Z directions and parallel to the other side of the first conductive layer 6 is defined as a Y direction. In FIG. 1, the X, Y, and Z directions are indicated respectively as arrows X, Y, and Z. A virtual plane containing the X direction and the Y direction is referred to as an "XY plane". A view of the first high frequency circuit 1 or a part thereof in the Z direction is referred to as a "view from above".

A plurality of through-holes 7*a* for displacing the control pins 2 are formed in the second conductive layer 7. The plurality of through-holes 7*a* are arranged along the XY plane of the second conductive layer 7 at predetermined intervals in the X direction and at predetermined intervals in the Y direction. The configuration is such that the control pins 2 correspond to the through-holes 7*a* in a one-to-one manner. Each through-hole 7*a* of the second conductive layer 7 is formed in the shape of a rectangular hole so as to correspond to the shape of the control pin 2 described below. Each through-hole 7*a* is loosely formed with respect to each control pin 2 so that the control pin 2 can be smoothly displaced.

The plurality of control pins 2 can form a waveguide in cooperation with the first and the second conductive layers 6 and 7. Each control pin 2 is configured such that the control pin 2 can be displaced between a down-status in which a part of a so-called E-plane of the waveguide is formed and an up-status. The down-status (see Z1 in FIG. 2) is synonymous with a wall portion forming state in which the control pin 2 has been lowered in one direction in the Z direction to form a part of a wall portion of the waveguide. The up-status (see Z2 in FIG. 2) is synonymous with a wall portion non-forming state in which the control pin 2 has been lifted in the other direction in the Z direction not to form a wall portion of the waveguide. Each control pin 2 is made of a conductive material, and is formed in the shape of a quadratic prism that extends in the Z direction. Each control pin 2 is formed such that the length in the Z direction is longer by a predetermined small distance than the distance δ1 between the first conductive layer 6 and the second conductive layer 7. In the down-status, one end portion 2*a* in the longitudinal direction of each control pin 2 is in contact with the first conductive layer 6, and another end portion 2*b* in the longitudinal direction of the control pin 2 slightly projects from one surface portion of the second conductive layer 7. In the up-status, the one end portion 2*a* in the longitudinal direction of the control pin 2 is away from the first conductive layer 6, and is flush with, for example, one surface of the second conductive layer 7. However, there is no limitation to this flush state.

Herein, in a waveguide, even in a case where a hole with a size of less than half the wavelength of electromagnetic waves transmitted through the waveguide is open in a metal wall, the electromagnetic waves do not leak to be transmitted from this hole. In other words, in a case where a distance δ2 between the control pins 2 adjacent to each other in the X or Y direction, which is the center distance between the adjacent control pins 2 in the lateral cross section, is prescribed to be less than half the wavelength, the interval between the control pins 2 adjacent to each other in the X or Y direction is obtained by subtracting the thickness of each control pin 2 in the X or Y direction from the center distance δ2. That is to say, the interval between the adjacent control pins 2 naturally becomes less than half the wavelength. Thus, electromagnetic waves can be reliably prevented from leaking to be transmitted out of the waveguide. Using this aspect, it is possible to form a waveguide in a region surrounded by the first conductive layer 6, the second conductive layer 7, and the plurality of control pins 2 in the down-status. Furthermore, it is possible to form or change the waveguide structure that is formed, by selecting the state of the control pins 2 between the up-status and the down-status (described later).

In this embodiment, each control pin 2 is formed in the shape of a quadratic prism, but the shape is not limited to quadratic prisms, and other shapes are also possible such as cylindrical columns or polygonal prisms other than quadratic prisms, more specifically, triangular prisms, pentagonal prism, and the like. In the variable high frequency circuit, the plurality of control pins 2 can be constituted by a plurality of types of polygonal prisms, or may be constituted by cylindrical columns and polygonal prisms. Compared with control pins constituted by polygonal prisms, those constituted by cylindrical columns can form curves of a waveguide more easily, and thus can support various structures, which increases the versatility. In the up-status of each control pin 2, the one end portion 2*a* in the longitudinal direction of the control pin 2 is flush with one surface of the second conductive layer 7, that is, the through-hole 7*a* of the second conductive layer 7 is sealed with the one end portion 2*a* in the longitudinal direction of each control pin 2 to realize a sealed state, and thus the transmission loss in the conductive material portion can be made as small as possible.

In this embodiment, air is present in the interior of the waveguide that is surrounded by the first conductive layer 6, the second conductive layer 7, and the plurality of control pins 2 in the down-status, but the configuration is not limited to this. A dielectric material (not shown) may be inserted between the first conductive layer 6 and the second conductive layer 7. A plurality of holes corresponding to the positions where the control pins 2 are arranged are formed through the dielectric material so that displacement of the control pins 2 is not hampered. In a case where this dielectric material is inserted, the first conductive layer 6 and the second conductive layer 7 are held by the dielectric material, and a smaller cutoff frequency and a longer cutoff wavelength can be realized. Thus, the variable high frequency circuit forming portion 3 can be made smaller by setting the cutoff frequency to be the same as that in the case where air is present. In a case where the first and the second conductive layers 6 and 7 are held by the dielectric material, it is possible to increase the rigidity strength of the variable high frequency circuit forming portion 3 compared with the case in which air is present in the interior of the waveguide. The increased rigidity strength makes it possible to smoothly displace the control pins 2. Since the interval between the control pins 2 is less than half the wavelength, electromagnetic waves can be reliably prevented from leaking to be transmitted out of the waveguide.

Hereinafter, the high frequency circuit control portion 4 will be described. The high frequency circuit control portion 4 includes a circuit pattern information storage portion 8 and a control pin driving portion 9, which are electrically connected. The circuit pattern information storage portion 8 stores therein information of the waveguide shape for forming a waveguide, that is, pattern information. Pattern information PD transmitted, for example, in a wired or wireless manner to the first high frequency circuit 1 is temporarily stored in the circuit pattern information storage portion 8. The circuit pattern information storage portion 8 transmits signals to the control pin driving portion 9 so that the information is reproduced. The control pin driving portion 9 includes a pump motor as a driving source, a fluid pressure cylinder 10, and a pipe 11 and a control valve (not shown) which are referred to as a pipe or the like, which are connected via pipes. A cylinder body 10A of the fluid pressure cylinder 10 is secured to the second conductive layer 7.

The fluid pressure cylinder 10 includes the cylinder body 10A and a piston 12 that is integrally secured to the other end portion 2*b* in the longitudinal direction of the control pin 2. As a working fluid of the fluid pressure cylinder 10, for example, a gas or oil is used. In a case where a gas is used as the working fluid, it is possible to make the first high frequency circuit 1 lighter than in the case where an oil is used, and thus it is possible to increase the portability of apparatuses including the first high frequency circuit 1. In a case where the working fluid is injected from the driving source via a pipe or the like into the cylinder body 10A based on signals transmitted from the circuit pattern information storage portion 8 to the control pin driving portion 9, positive pressure is applied to the interior of the cylinder body 10A, and thus the piston 12, that is, the control pin 2 is pushed from the up-status to the down-status.

Conversely, in a case where the working fluid inside the cylinder body 10A is sucked based on the signals, negative pressure is applied to the interior of the cylinder body 10A, and thus the control pin 2 is displaced from the down-status to the up-status. As a result, each control pin 2 is in the up-status or the down-status, and thus a modified high frequency circuit is formed. High frequency signals (radio frequency signals abbreviated as RF signals) that are inputted to the high frequency circuit are outputted after a filtering process or the like performed in the variable high frequency circuit portion 5. However, the process is not limited to the filtering process.

In this embodiment, the control pin 2 is displaced to the up-status with application of negative pressure to the interior of the cylinder body 10A, but the configuration is not limited to this. For example, biasing means also may be provided that is constituted by a coil spring displacing the control pin 2 from the down-status to the up-status when the pressure of the working fluid applied to the interior of the cylinder body 10A is released. Here, the coil spring has to be made of a nonmetal such as synthetic resins. In this case, it is possible to displace the control pin 2 more quickly than in this embodiment in which negative pressure is applied to the interior of the cylinder body 10A. Even in a case where the working fluid leaks at a point in the pipes or the like, the control pin 2 can be reliably and quickly displaced.

Figure 4:
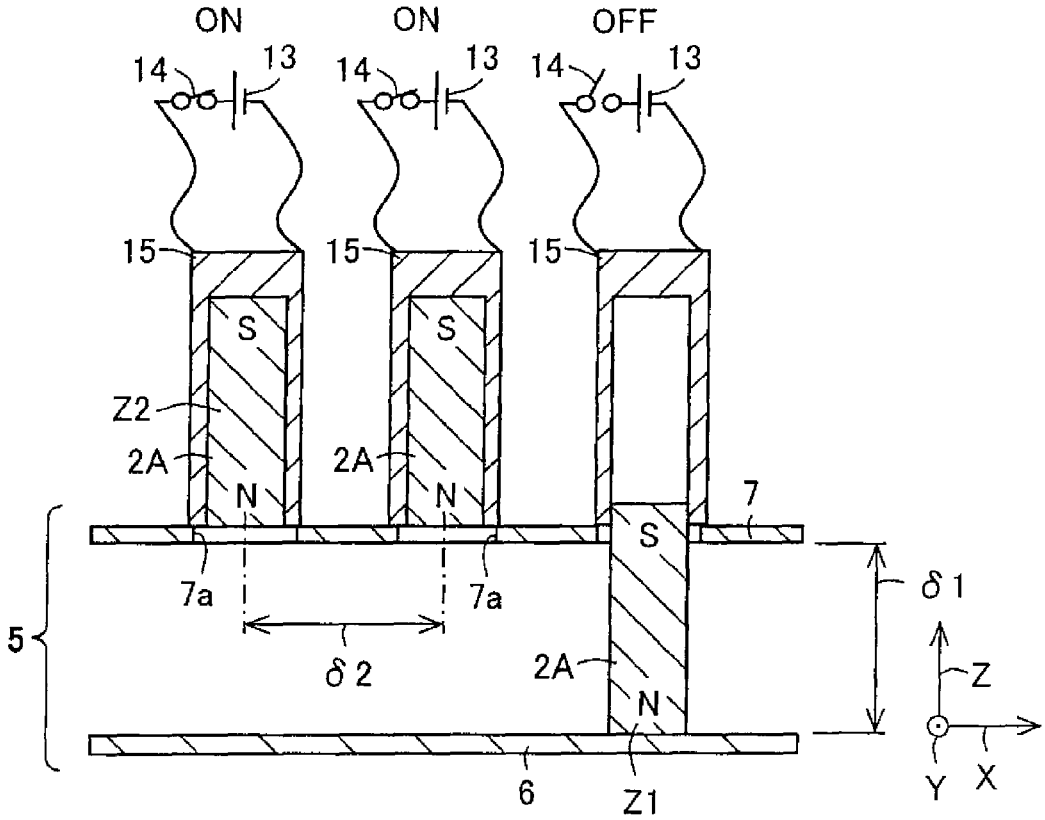
FIG. 4 is a cross-sectional view of the main portions of a driving portion according to a modified embodiment in which the structure of the driving portion of the control pins 2 is partially modified, taken along a virtual plane containing the direction in which the pins are projected and withdrawn.

FIG. 4 is a cross-sectional view of the main portions of a driving portion according to a modified embodiment in which the structure of the driving portion of the control pins 2 is partially modified, taken along a virtual plane containing the direction in which the pins are projected and withdrawn. In the embodiment in FIG. 2, the fluid pressure cylinder 10 is used to control each control pin 2 between the up-status and the down-status. In the embodiment shown in FIG. 4, each control pin also can be electromagnetically controlled. More specifically, the control pin driving portion includes a battery 13 as a driving source, switching means 14, a coil member 15 wound around an axis in the Z direction, and a control pin 2A that is constituted by a magnetic material. The coil member 15 is secured to the second conductive layer 7, and the battery 13 and the switching means 14 are electrically connected to the coil member 15.

Each control pin 2A is made of an electrically conductive magnetic member such as a nickel metal, and magnetized. The control pin 2A is configured such that the control pin 2A can be guided by the coil member 15 generating a magnetic force and displaced to one or the other direction in the Z direction. For example, a central processing unit (abbreviated as a CPU) of the high frequency circuit control portion 4 controls on and off of the switching means 14 based on signals transmitted to the control pin driving portion. For example, it is possible to displace a given control pin 2A from the up-status to the down-status by controlling the switching means 14 corresponding to that control pin 2A from on to off. Conversely, it is possible to displace the control pin 2A from the down-status to the up-status by performing switching control on the switching means 14 from off to on based on the signals.

According to this modified embodiment, the control pins 2A can be electromagnetically controlled. Thus, it is possible to reduce the time necessary for changing the structure of the high frequency circuit, compared with the foregoing embodiment in which the fluid pressure cylinder 10 is used to control the control pins 2. More specifically, since the control pins 2A can be electromagnetically controlled, the structure can be easily changed based on an existing high frequency circuit. Since not a pump motor but the battery 13 can be used as the driving source, this modified embodiment in more excellent in portability and maintenance properties than the foregoing embodiment. This modified embodiment achieves other effects similar to those of the foregoing embodiment. It is also possible to control so that each control pin 2 can be displaced between the up-status and the down-status, using a motor and a cam that is secured to a shaft of the motor, the biasing means described above, or the like. Also in this case, effects similar to those in this modified embodiment can be achieved.

Figure 5A:
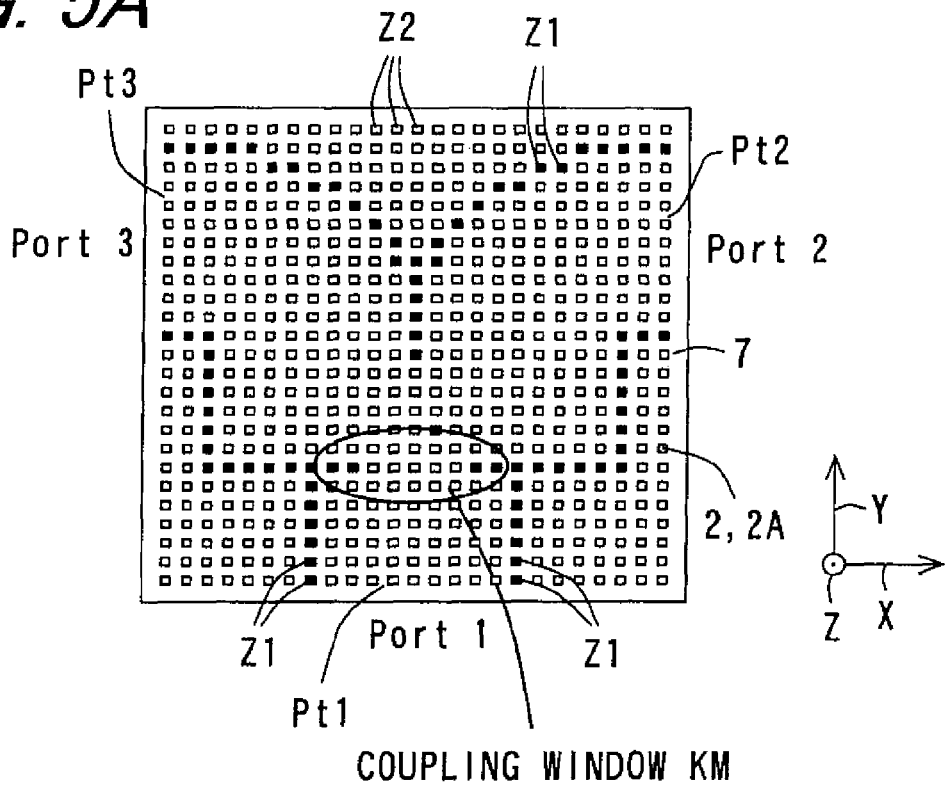
FIGS. 5A to 5C are plan views showing circuit patterns, where
Figure 5B:
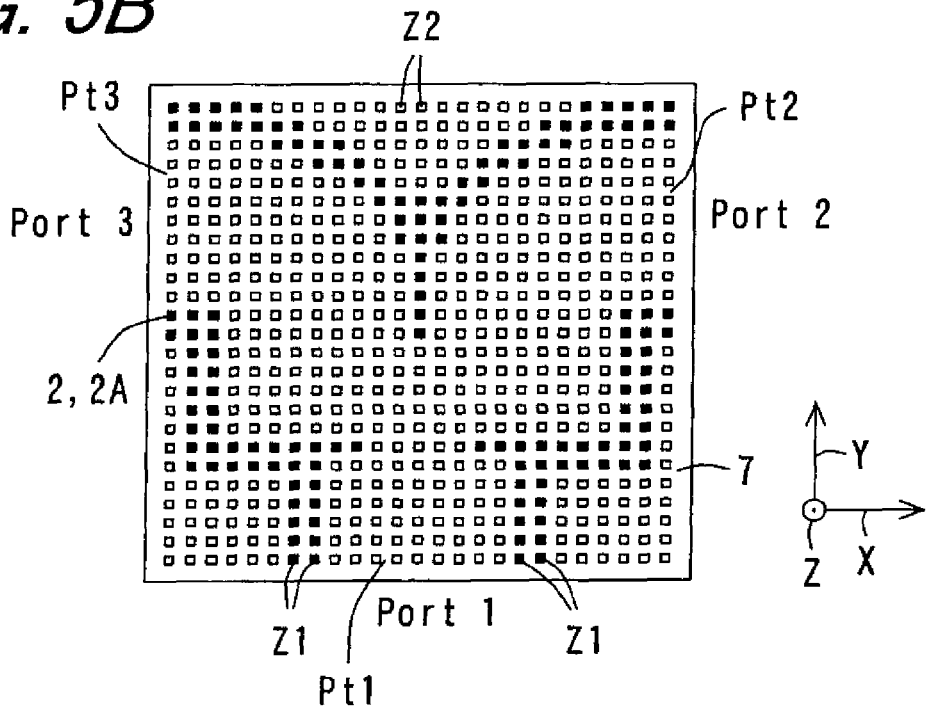
Figure 5C:
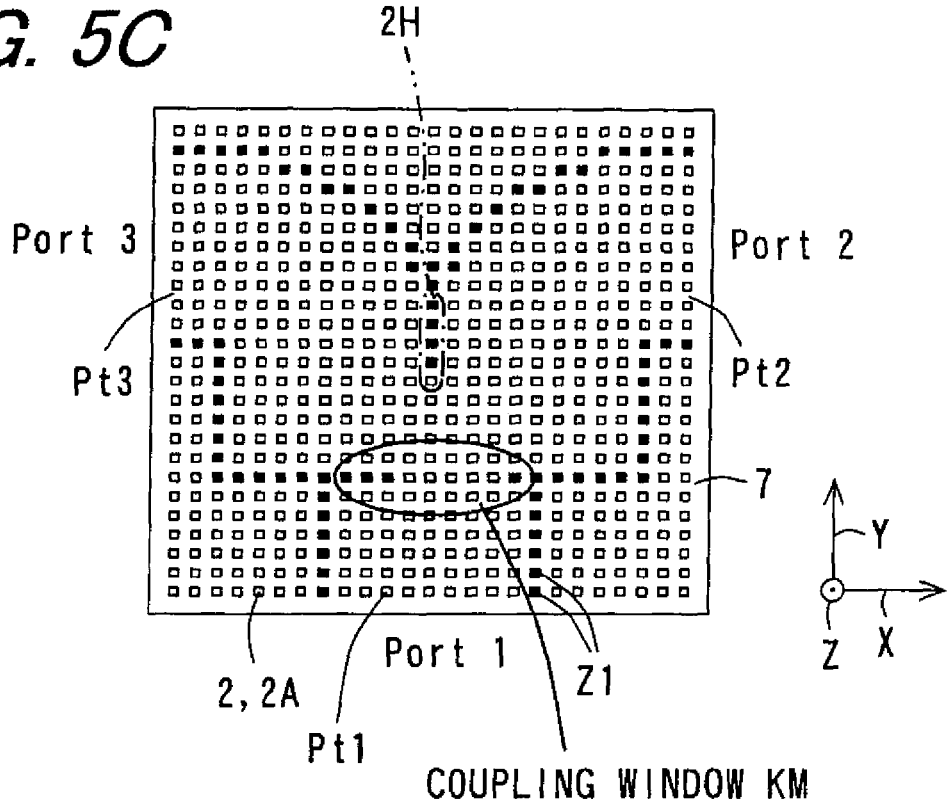

FIGS. 5A to 5C are plan views showing circuit patterns. FIG. 5A is a plan view showing a circuit pattern in which electric power is equally distributed to a second port Pt2 and a third port Pt3. FIG. 5B is a plan view showing a circuit pattern in which a plurality of rows of groups of control pins forming an E-plane of the waveguide are arranged. FIG. 5C is a plan view showing a circuit pattern in which the distribution ratio of electric power between the second port Pt2 and the third port Pt3 is shifted.

The control pins 2 or 2A are arranged at constant intervals in the X direction and the Y direction. A hollow square indicates the control pin 2 or 2A in the up-status in which the E-plane is not formed. A solid square indicates the control pin 2 or 2A in the down-status in which the E-plane of the waveguide is formed. In FIG. 5A, the control pins 2 or 2A are arranged such that an equally branching process is performed. The circuit pattern that is in the waveguide shape shown in FIG. 5A is prescribed, for example, as a default. Electric power of high frequency signals inputted from a first port Pt1 is equally distributed to the second and the third ports Pt2 and Pt3. Pattern information for performing the equally branching process shown in FIG. 5A is stored in the circuit pattern information storage portion 8. Based on an operation command of an operator, the circuit pattern information storage portion 8 transmits signals to the control pin driving portion 9, and the control pin driving portion 9 controls driving of the driving source. Accordingly, positive pressure or negative pressure is applied to the interior of the cylinder body 10A, and the control pin 2 or 2A is displaced to the up-status or the down-status. Thus, the circuit pattern in FIG. 5A is obtained.

In the case of this waveguide, in order to reduce transmission loss, it is also possible to arrange not one row, but a plurality of rows of groups of the control pins 2 or 2A forming the E-plane of the waveguide in the X direction and the Y direction, for example, as shown in FIG. 5B. Pattern information for low transmission loss is also stored in the circuit pattern information storage portion 8. More specifically, based on an operation command of an operator, the circuit pattern information storage portion 8 transmits signals to the control pin driving portion 9, and the control pin driving portion 9 controls driving of the driving source based on the pattern information for low transmission loss. Accordingly, the circuit pattern shown in FIG. 5B in which a plurality of rows of groups of the control pins 2 forming the E-plane of the waveguide in the X direction and the Y direction is obtained. It is possible to reduce transmission loss to the extent possible, by increasing the thickness of the E-plane, that is, a wall portion of the waveguide in this manner.

As shown in FIG. 5C, a structure is also possible in which a coupling window KM is shifted in the X direction from the position in the circuit pattern shown in FIG. 5A. The distribution ratio of electric power is shifted by shifting the coupling window KM in this manner, and thus a so-called power divider can be formed. Pattern information for a power divider, which realizes the power divider, is also stored in the circuit pattern information storage portion 8. Based on an operation command of an operator, the circuit pattern information storage portion 8 transmits signals to the control pin driving portion 9, and the control pin driving portion 9 controls driving of the driving source based on the pattern information for a power divider. Thus, the power divider shown in FIG. 5C is obtained.

In the examples in FIGS. 5*a* to 5C, there is only one branching structure. However, in a case where the variable high frequency circuit is enlarged in the X direction and the Y direction to form a large number of branching structures as a feed circuit for an antenna, the ratio of feed to antenna elements coupled with the circuit can be changed, and thus the emission pattern can be changed. With this sort of waveguide structure, it is possible to change the wavelength inside the waveguide by changing the width of the waveguide. Thus, even with the same waveguide length, the phase that is outputted from the port can be changed. As a result, an electric beam scanning antenna also can be formed.

Figure 6A:
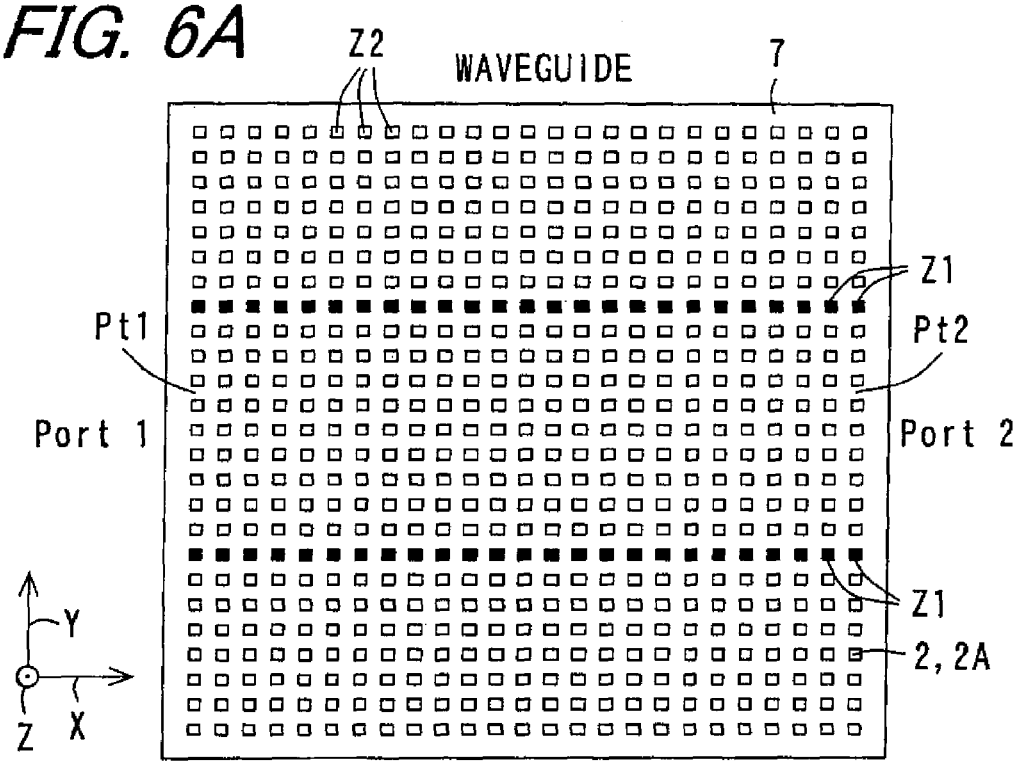
FIGS. 6A and 6B are plan views showing circuit patterns, where
Figure 6B:
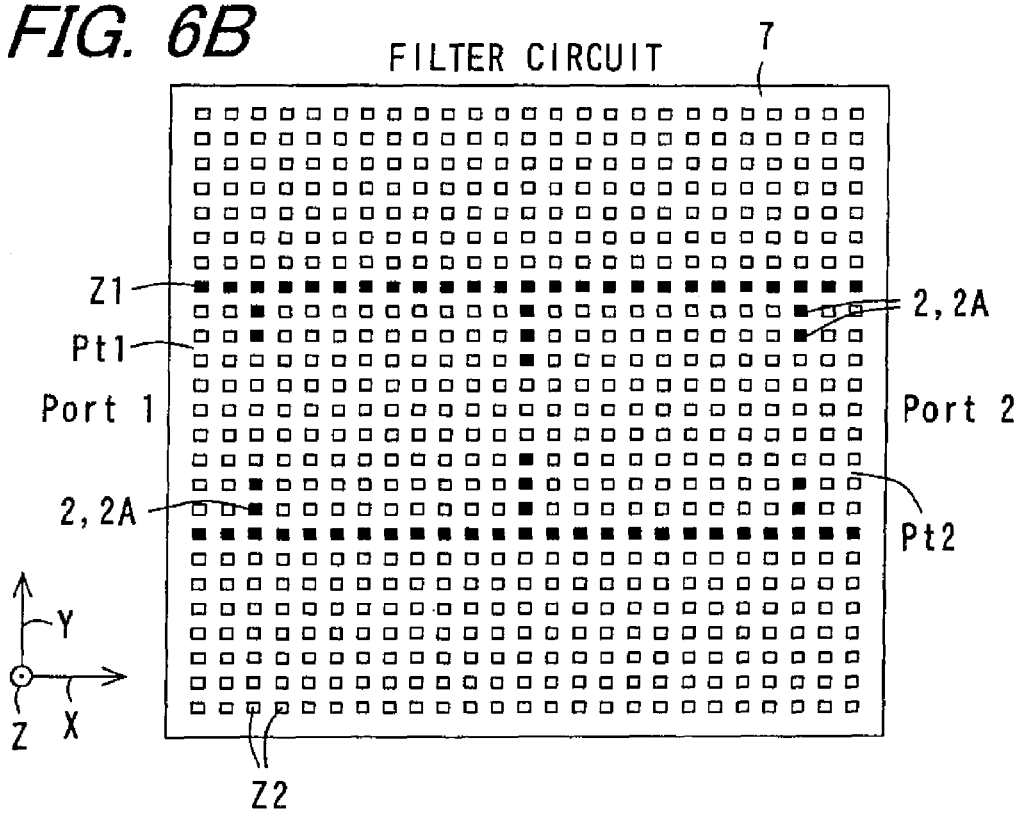

FIGS. 6A and 6B are plan views showing circuit patterns. FIG. 6A is a plan view showing a circuit pattern of a linear waveguide structure. FIG. 6B is a plan view showing a circuit pattern provided with a filtering function. In this embodiment, for example, the circuit pattern shown in FIG. 6A stored as a default can be changed into the circuit pattern provided with a filtering function (filter circuit), with an operation command from an operator. For example, the width in the Y direction at a portion near the first port Pt1 on the upstream side in the waveguide is narrowed, and the width in the Y direction at a portion near the second port Pt2 on the downstream side in the waveguide is narrowed. In addition to this, the width in the Y direction at a portion near the center in the longitudinal direction in the waveguide is further narrowed. A filter circuit can be easily and quickly realized by displacing predetermined control pins 2 or 2A to the up-status or the down-status. Since the circuit pattern can be changed by displacing predetermined control pins 2 or 2A to the up-status or the down-status, the center frequency properties and passband of the filtering function also can be changed.

Figure 7A:
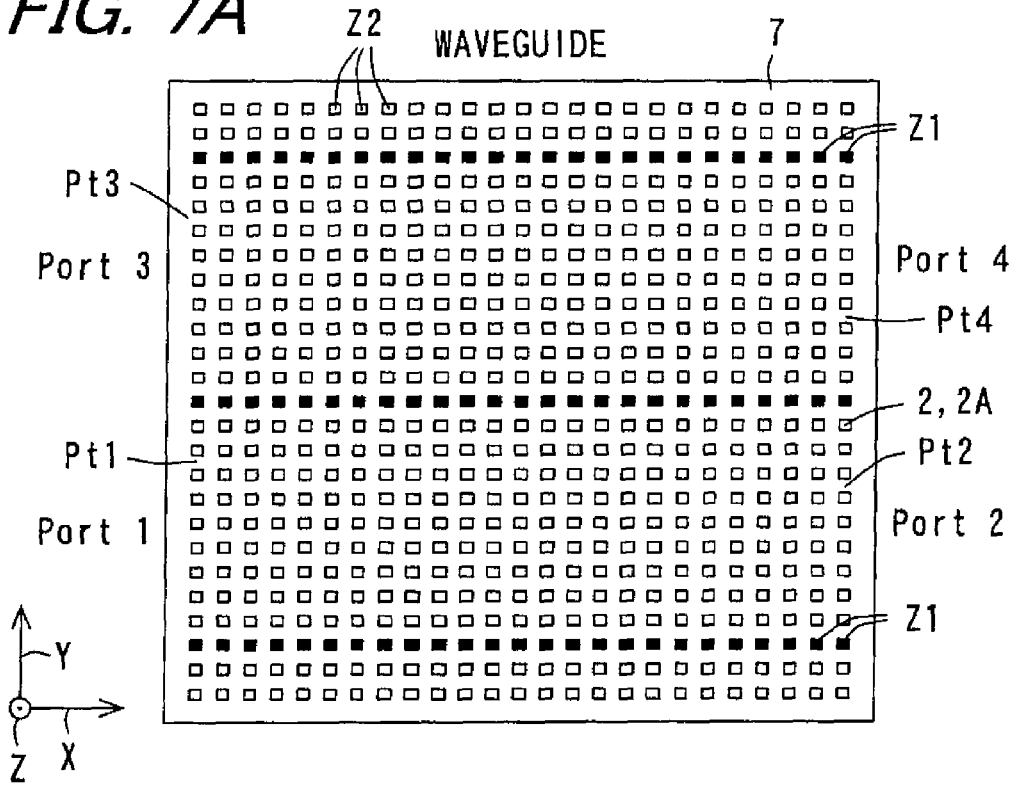
Figure 7B:
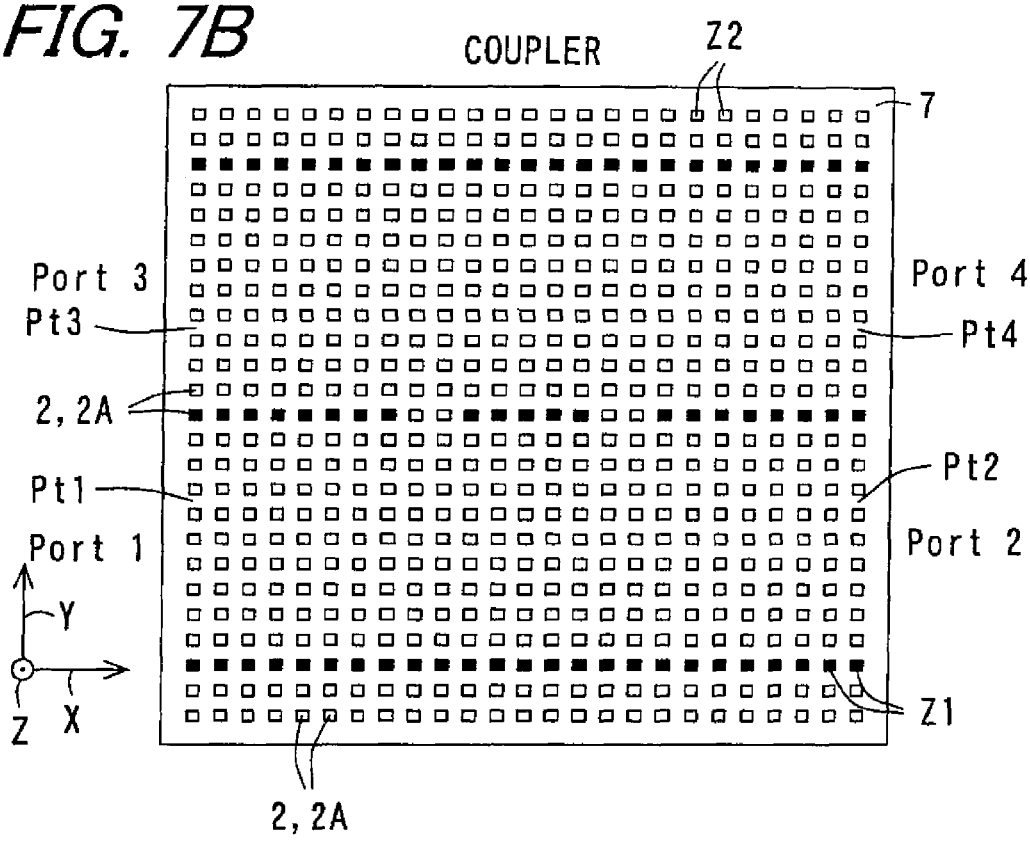
FIG. 7B is a plan view showing a circuit pattern with the structure in which a part of high frequency signals inputted from the first port Pt1 is coupled and outputted also to a fourth port Pt4.

FIGS. 7A and 7B are plan views showing circuit patterns. FIG. 7A is a plan view showing a circuit pattern with the structure in which two linear waveguide structures are in contact with each other. FIG. 7B is a plan view showing a circuit pattern with the structure in which a part of high frequency signals inputted from the first port Pt1 and outputted from the second port Pt2 is coupled and outputted also to a fourth port Pt4. Pattern information for the waveguide in FIG. 7A is stored in the circuit pattern information storage portion 8, and pattern information for the coupler in FIG. 7B is also stored in the circuit pattern information storage portion 8. A part of the plurality of control pins 2 or 2A functioning also as a wall portion is displaced to the up-status or the down-status based on an operation command from an operator, and thus switching can be easily and quickly performed between the circuit pattern shown in FIG. 7A and the circuit pattern shown in FIG. 7B.

Figure 8A:
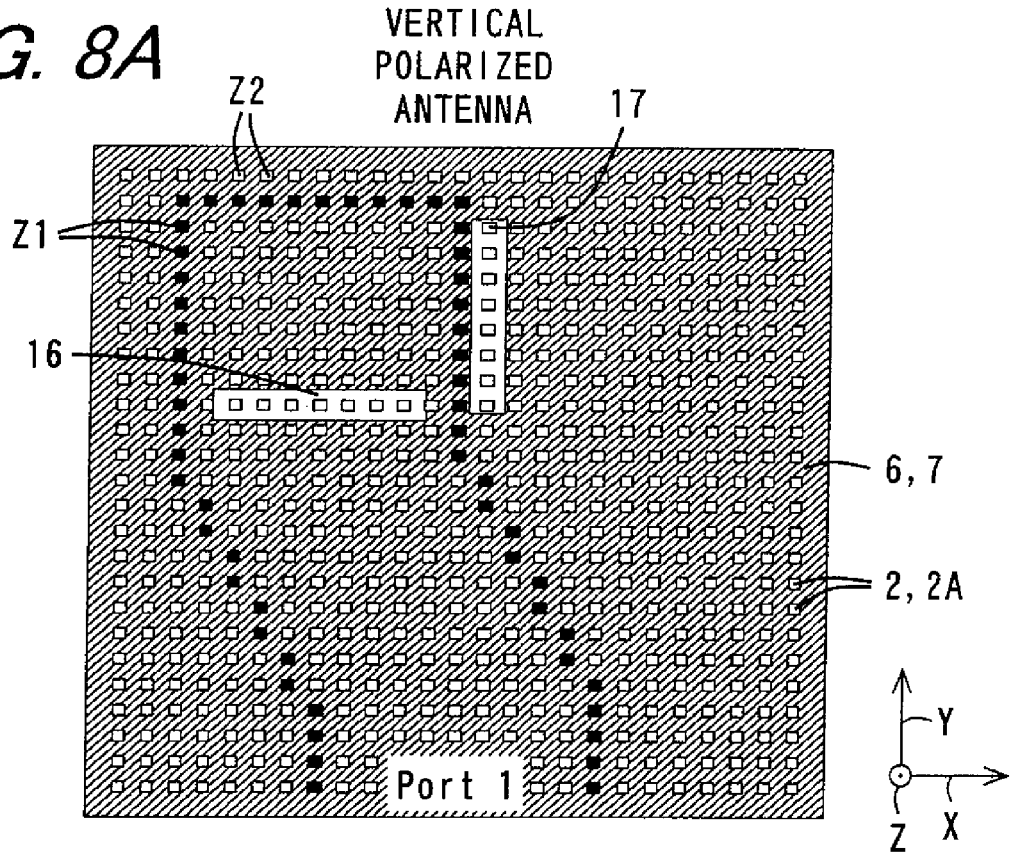
FIGS. 8A and 8B are plan views showing circuit patterns, where
Figure 8B:
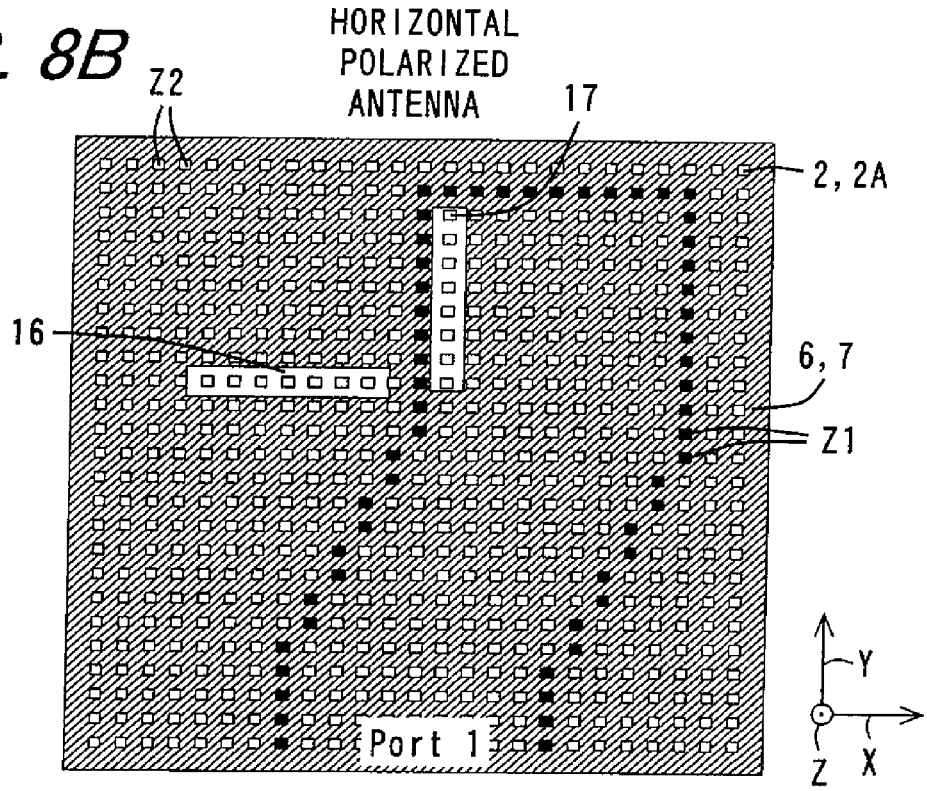

FIGS. 8A and 8B are plan views showing circuit patterns. FIG. 5A is a plan view showing a circuit pattern in which high frequency signals inputted from the first port Pt1 are emitted from a slot 16. FIG. 5B is a plan view showing a circuit pattern in which high frequency signals inputted from the first port Pt1 are emitted from a slot 17. The first high frequency circuit 1 according to this embodiment is applicable also to an antenna.

A first slot 16 for realizing a vertical polarized antenna and a second slot 17 for realizing a horizontal polarized antenna are formed in the first conductive layer 6. The first and the second slots 16 and 17 are formed in advance in the same size. The first slot 16 is arranged in the X direction, and the second slot 17 is arranged in the Y direction. The longitudinal direction of the first slot 16 is perpendicular to that of the second slot 17. It should be noted that one end portion in the longitudinal direction of the first slot 16 is spaced away by a predetermined small distance from one side portion in the width direction of the second slot 17.

In the example shown in FIG. 8A, only the first slot 16 arranged in the X direction is surrounded by the first and the second conductive layers 6 and 7 and the plurality of control pins 2 or 2A in the down-status. Pattern information for realizing this state is stored in advance in the circuit pattern information storage portion 8. This circuit pattern is obtained by displacing the plurality of control pins 2 or 2A to the up-status or the down-status based on an operation command from an operator. High frequency signals inputted from the first port Pt1 are guided to one direction in the X direction and one direction in the Y direction, and emitted from the first slot 16. At that time, electromagnetic waves in the Z direction are emitted from the antenna. The polarized waves form an electric field in the direction that is perpendicular to the section of the diagram (vertical polarization).

In the example shown in FIG. 5B, only the second slot 17 arranged in the Y direction is surrounded by the first and the second conductive layers 6 and 7 and the plurality of control pins 2 or 2A in the down-status. Pattern information for realizing this state is stored in advance in the circuit pattern information storage portion 8. This circuit pattern is obtained by displacing the plurality of control pins 2 or 2A to the up-status or the down-status based on an operation command from an operator. High frequency signals inputted from the first port Pt1 are guided to one direction in the X direction and one direction in the Y direction, and emitted from the second slot 17. At that time, the frequency of electromagnetic waves emitted from the antenna has not been changed from that in FIG. 5A, but the polarized waves form an electric field in the direction that is parallel to the section of the diagram (horizontal polarization).

It is possible to selectively switch polarized waves emitted from an antenna, by forming the slots 16 and 17 functioning as emission elements in advance in the first conductive layer 6 in this manner. In this example, the first and the second slots 16 and 17 have the same size, but the size is not limited to being the same. Since the frequency properties of emitted waves depend on the size of the slots, it is possible to selectively switch the frequency of emitted or received waves, by setting the size of the slots so as to match a desired frequency in advance. A high frequency circuit having such high versatility can be realized.

Figure 9A:
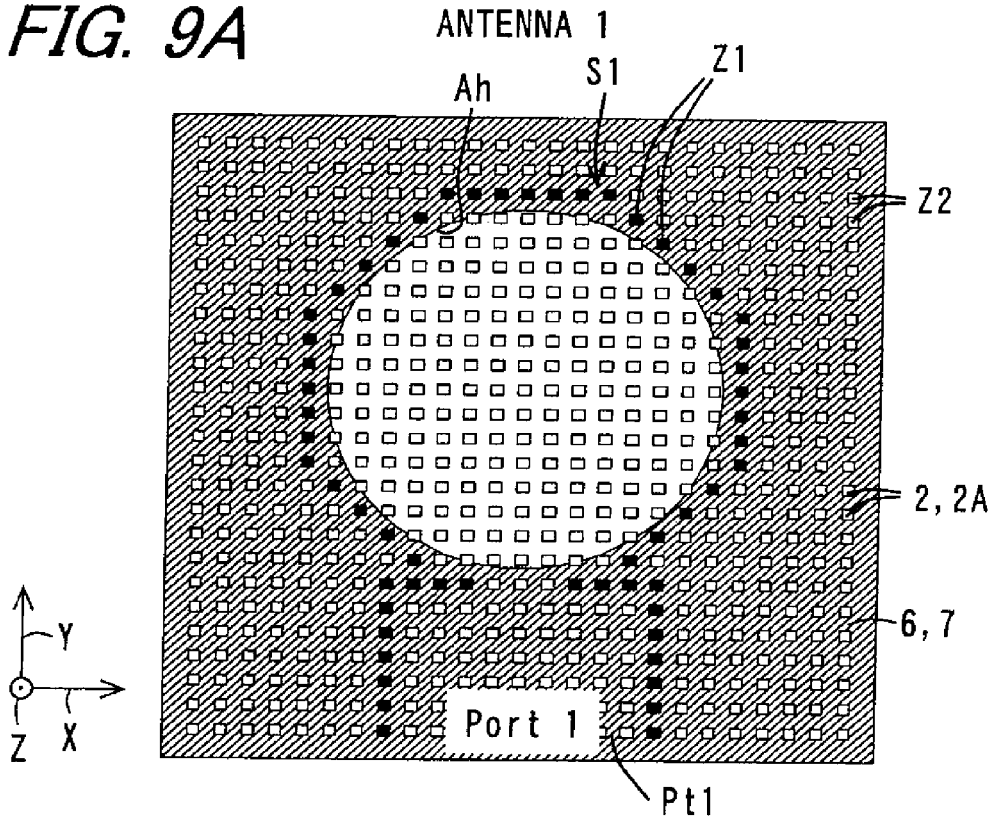
FIGS. 9A and 9B are plan views showing circuit patterns, where
Figure 9B:
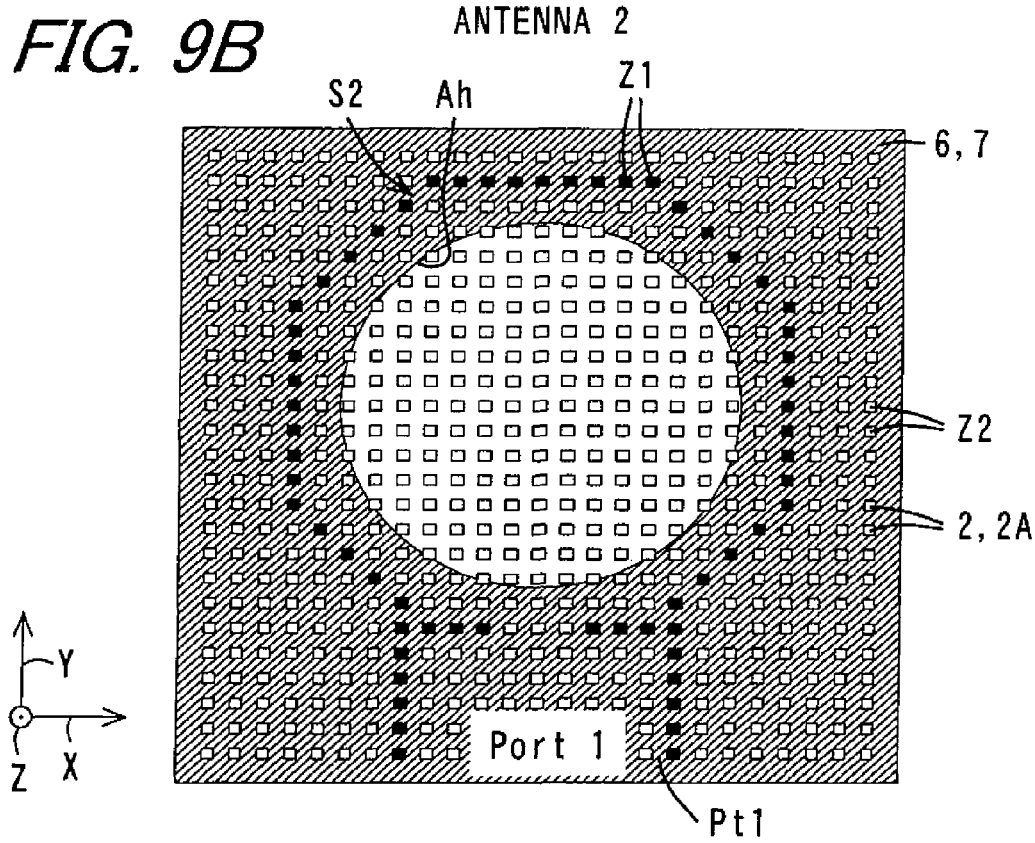

FIGS. 9A and 9B are plan views showing circuit patterns. FIG. 9A is a plan view showing a circuit pattern in which high frequency signals inputted from the first port Pt1 resonate within a region S1 surrounded in the shape of a circle, and are emitted from an antenna opening portion Ah. FIG. 9B is a plan view showing a circuit pattern in which the frequency properties are shifted to the low frequency side. In this example, the antenna opening portion Ah in the shape of a circle when viewed from above is formed in advance in the first conductive layer 6.

The circuit pattern shown in FIG. 9A realizes a resonator-type antenna. High frequency signals inputted from the first port Pt1 resonate within the region S1 surrounded in the shape of a circle by the plurality of control pins 2 or 2A, and are emitted from the antenna opening portion Ah. The resonance frequency at that time depends on the area of the antenna opening portion and the portion that is surrounded in the shape of a circle or polygon by the plurality of control pins 2 or 2A. Thus, in a case where the area of a region S2 that is surrounded in the shape of a circle or polygon by the control pins 2 or 2A in the down-status is made larger as shown in FIG. 95 than that of the region S1 shown in FIG. 9A, the frequency properties of waves emitted from the antenna opening portion Ah are shifted to the low frequency side. Conversely, the frequency properties of waves emitted from the antenna opening portion Ah also can be shifted from the low frequency side to the high frequency side. As described above, it is possible to change the frequency properties by changing the control state of the control pins 2 or 2A between the down-status and the up-status.

According to the first high frequency circuit 1 described above, the high frequency circuit control portion 4 changes the waveguide shape of the variable high frequency circuit forming portion 3 based on the pattern information (corresponding to expected information), and thus the variable high frequency circuit forming portion 3 can be easily changed. Compared with a conventional technique in which a plurality of types of high frequency circuit components are selectively used, it is possible to simplify the structure and optimize the variable high frequency circuit forming portion 3. Thus, a high frequency circuit having high versatility can be realized.

According to the first high frequency circuit 1, the first and the second conductive layers 6 and 7 and the plurality of control pins 2 or 2A can cooperate with each other to form a waveguide. The variable high frequency circuit forming portion 3 can be easily changed by displacing each control pin 2 or 2A between the down-status and the up-status. The variable high frequency circuit forming portion 3 is changed to have a waveguide shape of at least one of a power divider, a filter circuit, and a coupler. In this manner, the versatility of the first high frequency circuit 1 can be increased.

The high frequency circuit control portion 4 can perform switching between a state in which vertically polarized waves are emitted from one slot 16 and a state in which horizontally polarized waves are emitted from another slot 17, by controlling the displacement position of the control pins 2 or 2A. That is to say, it is possible to perform switching between a vertical polarized antenna and a horizontal polarized antenna, using the first and the second conductive layers 6 and 7 and the plurality of control pins 2 or 2A.

Figure 10:
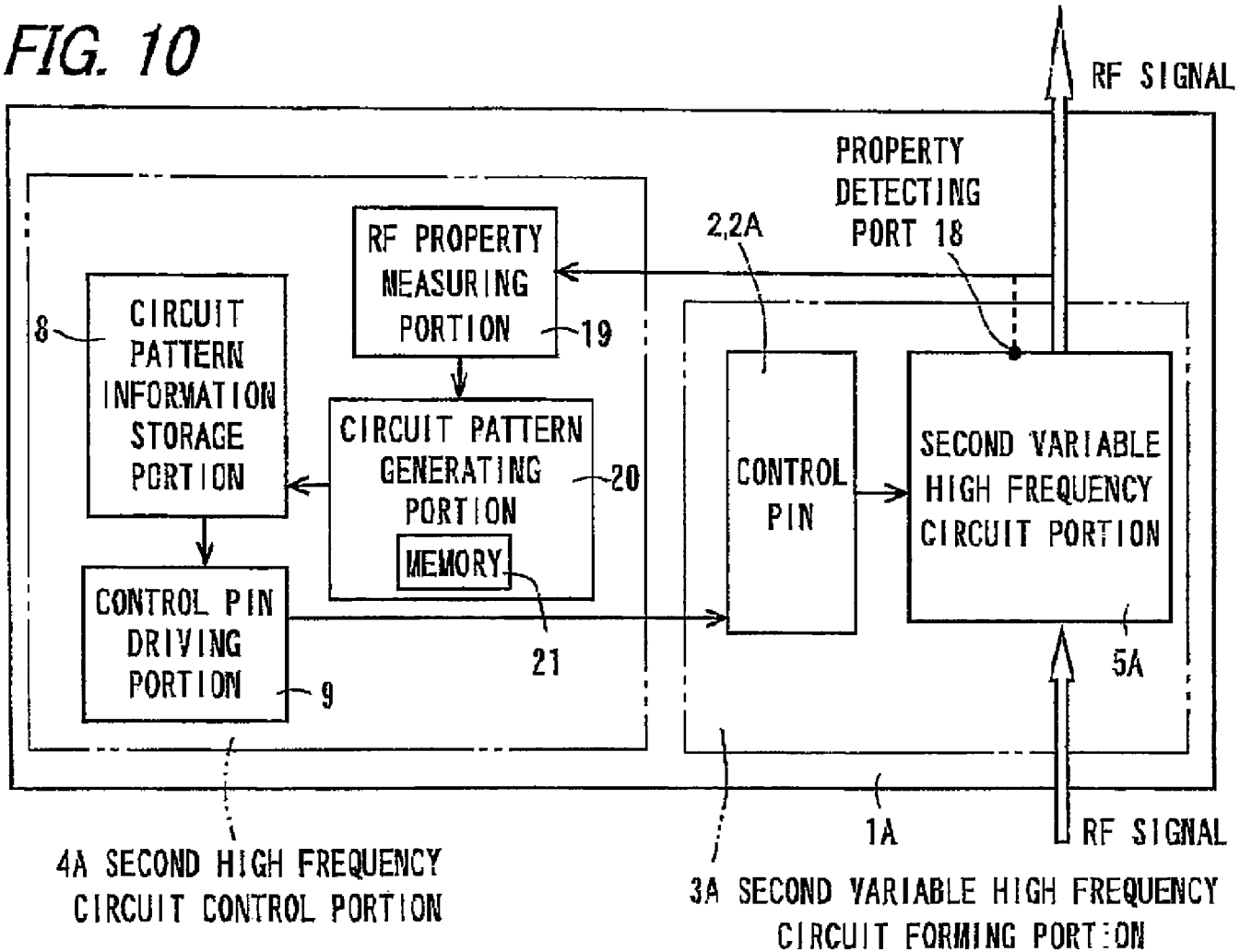
FIG. 10 is a block diagram showing the electric configuration of a variable high frequency circuit 1A according to a second embodiment.

FIG. 10 is a block diagram showing the electric configuration of a variable high frequency circuit 1A according to a second embodiment. The variable high frequency circuit 1A according to the second embodiment is referred to as a "second high frequency circuit 1A". The second high frequency circuit 1A includes a second variable high frequency circuit forming portion 3A as a circuit forming portion and a second high frequency circuit control portion 4A as control means. The second variable high frequency circuit forming portion 3 has a second variable high frequency circuit portion 5A and the plurality of control pins 2 or 2A. A property detecting port 18 for detecting high frequency signals processed in the second variable high frequency circuit portion 5A is formed in the second variable high frequency circuit portion 5A. A part of high frequency signals outputted from the property detecting port 18 is inputted to a radio frequency (RF) property measuring portion 19 described later.

The second high frequency circuit control portion 4A includes the RF property measuring portion 19, a circuit pattern generating portion 20, the circuit pattern information storage portion 8, and the control pin driving portion 9, which are electrically connected. High frequency signals outputted (finally outputted) from the property detecting port 18 are inputted to the RF property measuring portion 19. The RF property measuring portion 19 performs measurement to determine whether or not desired RF signals are outputted. Information indicating a result of this measurement is transmitted to the circuit pattern generating portion 20. The circuit pattern generating portion 20 has a function of determining whether or not high frequency signals processed in the second variable high frequency circuit portion 5A have been processed to obtain desired properties, and modifying the process.

The circuit pattern generating portion 20 has a memory 21 as storage means. The memory 21 stores therein reference data functioning as a determination reference for determining whether or not a process has been performed to obtain desired properties. Information indicating a result of the determination is temporarily stored in the memory 21, and this information and the reference data are used for comparison. The circuit pattern generating portion 20 generates a modified circuit pattern based on a result of the comparison. This modified circuit pattern is temporarily stored in the circuit pattern information storage portion 8. The circuit pattern information storage portion 8 transmits signals to the control pin driving portion 9 so that the circuit pattern is reproduced. In this manner, high frequency signals that are to be processed in the second variable high frequency circuit portion 5A can be easily and reliably modified. The second variable high frequency circuit portion 5A can output expected high frequency signals by repeating this feedback control.

For example, the coupler structure shown in FIG. 7B can be formed in the vicinity of output signals of a functional block that is to be measured, and waves can be separated in such a manner that the main signals are not significantly disturbed and outputted to the property detecting port 18. Accordingly, only a necessary functional block can be measured. Thus, compared with the case in which all functional blocks are measured, it is possible to reduce the processing load on the CPU and the like. The other functions and effects are the same as those in the first high frequency circuit 1.

Figure 11:
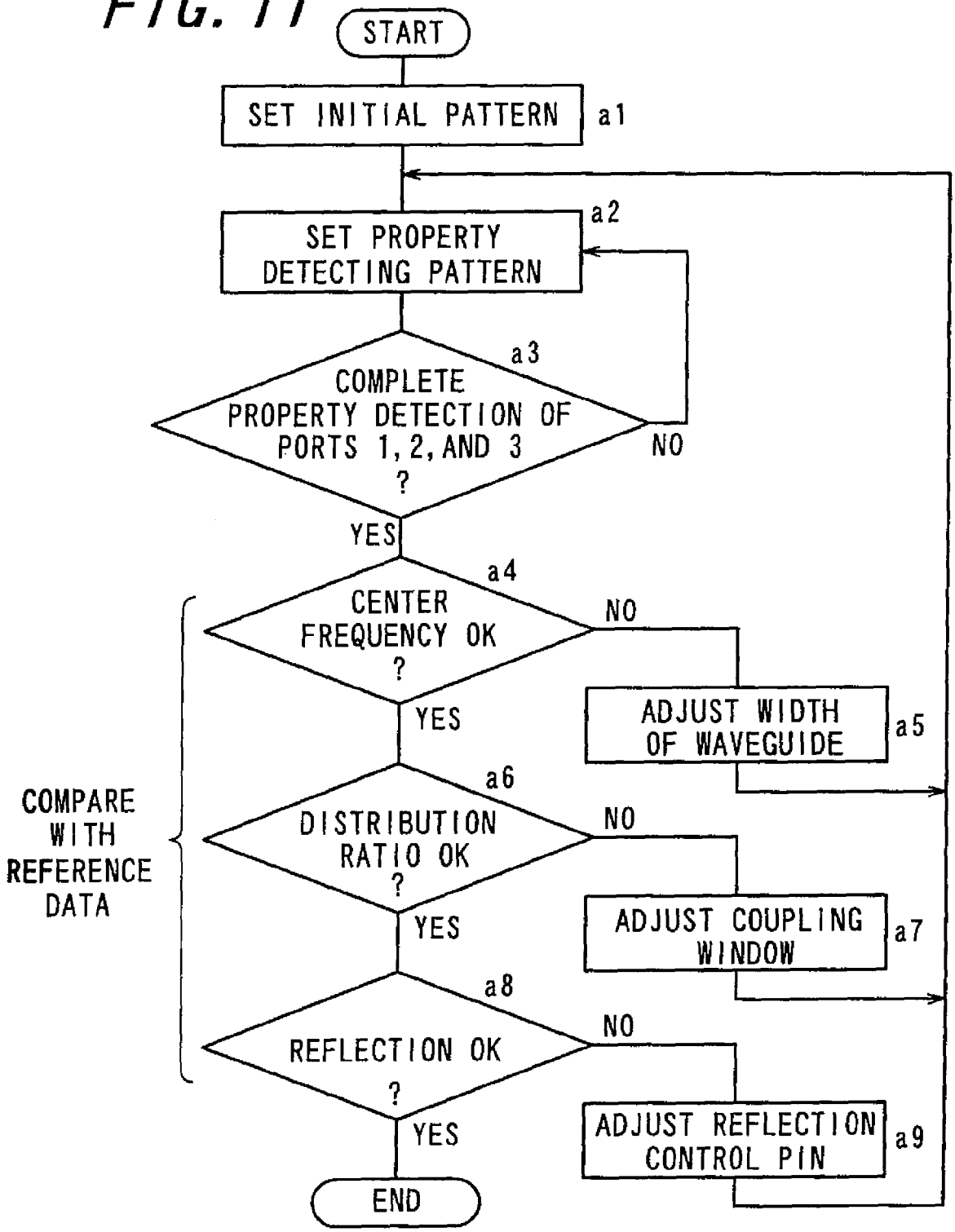
FIG. 11 is a flowchart showing the processing flow in the circuit pattern generating portion 20.

FIG. 11 is a flowchart showing the processing flow in the circuit pattern generating portion 20. In the description below, a reference is made also to FIG. 10. Unless otherwise specified, in this processing, the control is mainly performed in the circuit pattern generating portion 20. The procedure of the processing flow starts, for example, upon satisfying the condition that the main power (not shown) of the second high frequency circuit 1A is turned on. After the start, the procedure proceeds to step a1, where an initial pattern that is an initial waveguide shape is set. Next, the procedure proceeds to step a2, where a property detecting pattern is set. Next, the procedure proceeds to step a3, where it is determined whether or not property detection of the first port Pt1, the second port Pt2, and the third port Pt3 has been completed, in order to compare the reference data and the detected data. In a case where a result of the determination is "NO", the procedure returns to step a2.

In a case where it is determined that the property detection has been completed, the procedure proceeds to step a4. In step a4, a center frequency of the measurement result and the reference data stored in the memory 21 are compared so that it is determined whether or not the center frequency is acceptable. In a case where a result of the determination is "NO", the procedure proceeds to step a5, where based on the comparison result in step a4, signals are transmitted via the circuit pattern information storage portion 8 to the control pin driving portion 9, to adjust the width of the waveguide. Then, the procedure returns to step a2. In a case where it is determined in step a4 that the center frequency is acceptable, the procedure proceeds to step a6.

In step a6, a distribution ratio of the measurement result and the reference data stored in the memory 21 are compared so that it is determined whether or not the distribution ratio is acceptable. In a case where a result of the determination is "NO", the procedure proceeds to step a7, where based on the comparison result in step a6, signals are transmitted via the circuit pattern information storage portion 8 to the control pin driving portion 9, to adjust the coupling window KM (see FIGS. 5A to 5C). Then, the procedure returns to step a2. In a case where it is determined in step a6 that the distribution ratio is acceptable, the procedure proceeds to step a8. In step a8, reflection of the measurement result and the reference data stored in the memory 21 are compared so that it is determined whether or not the reflection is acceptable. In a case where a result of the determination is "NO", the procedure proceeds to step a9, where based on the comparison result in step a8, signals are transmitted via the circuit pattern information storage portion 8 to the control pin driving portion 9, to perform adjustment by changing the number of reflection controls pins 2 or 2A in the down-status in the region enclosed by the a dashed double dotted line in FIG. 5C. Then, the procedure returns to step a2. In a case where it is determined in step a8 that the reflection is acceptable, the procedure of this flow ends.

As described above, in steps a4, a6, and a8, information that is the measurement result and the reference data are compared. In a case where it is determined that the measurement result does not satisfy the condition of the circuit pattern, adjustment is performed respectively in steps a5, a7, and a9, and then the procedure returns to step a2. The second variable high frequency circuit portion 5A can precisely output expected high frequency signals by repeating this feedback control.

In this embodiment, the plurality of control pins 2 or 2A are arranged on the entire XY plane in the second conductive layer 7. However, the plurality of control pins 2 or 2A may be arranged only at a main portion of the entire XY plane in the second conductive layer 7. In this case, the structure of the variable high frequency circuit forming portion can be simplified, and the control system that displaces the control pins also can be simplified. Through-holes for displacing the control pins also may be formed in the first and the second conductive layers. In this case, the first and the second conductive layers can be held by a part of cylinder bodies, and thus the rigidity strength of the high frequency circuit can be increased. In a case where the first and the second conductive layers can be held by a part of the cylinder bodies, the cylinder bodies have to be dielectric materials, and the cylinder bodies and an oil or gas are partially present in the formed waveguide, and thus a dielectric waveguide can be formed. The first conductive layer can be made lighter, by the weight reduced by forming a plurality of through-holes in the first conductive layer.

The waveguide forming apparatus is applicable also to a high frequency circuit component other than the above-described high frequency circuit component such as an antenna or a filter circuit. In this embodiment, the waveguide forming apparatus is applied to a high frequency circuit, but is applicable also to a low frequency circuit. In this case, it is possible to simplify the structure and optimize a variable low frequency circuit forming portion. Thus, a low frequency circuit having high versatility can be realized. As another embodiment of the invention, a desired high frequency circuit may be provided, for example, in which based on a request from a user, a plurality of control pins are controlled to be in the up-status or the down-status, and then all the control pins are fixed so as not to be displaced. In this case, a plurality of types of high frequency circuit components do not have to be prepared, and thus the versatility of the high frequency circuit can be improved. In addition to the above, embodiments can be modified in various manners without departing from the gist of the invention.

Figure 12:
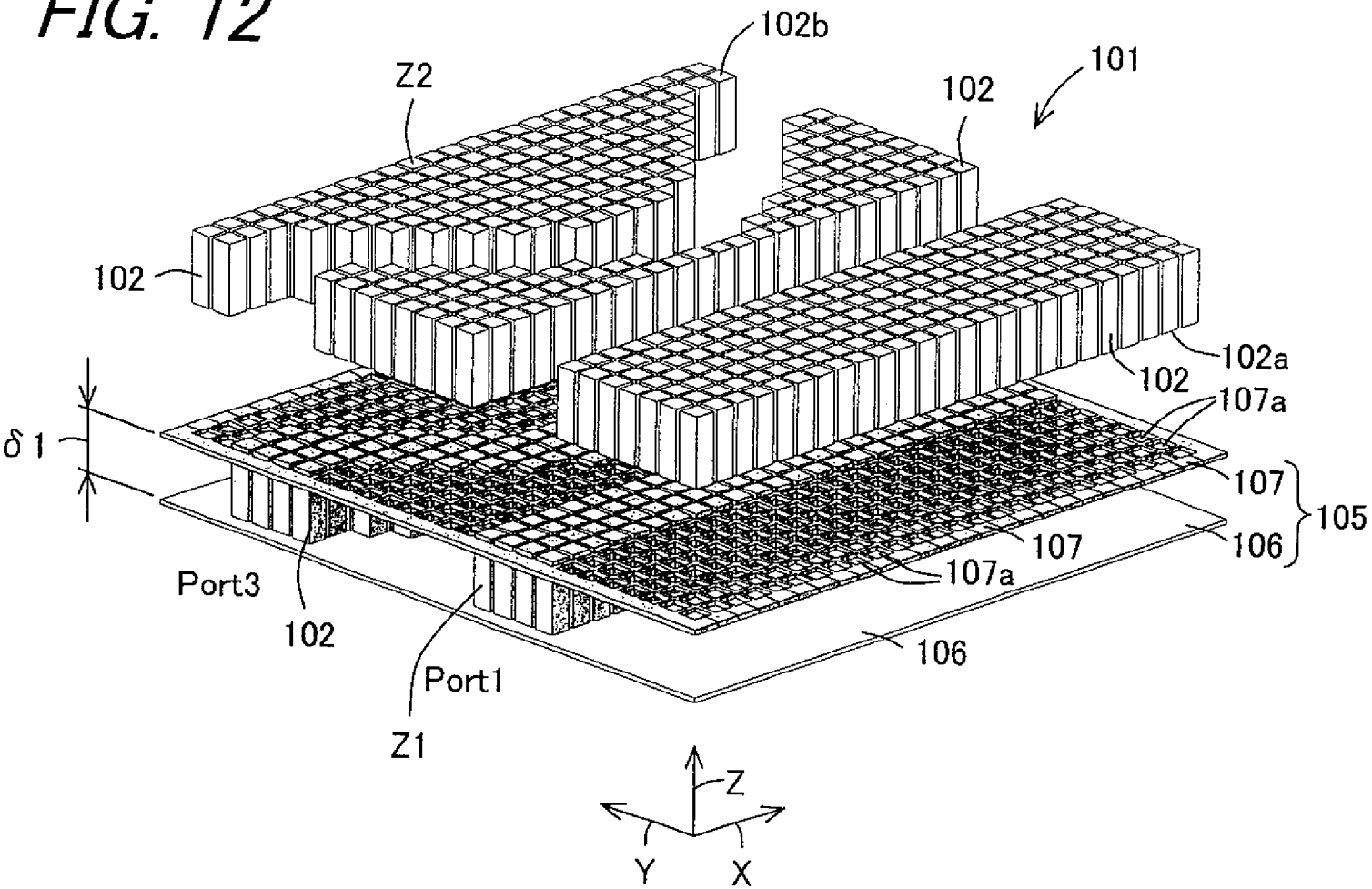
FIG. 12 is a perspective view showing a variable high frequency circuit forming portion 103 according to a third embodiment of the invention.
Figure 13:
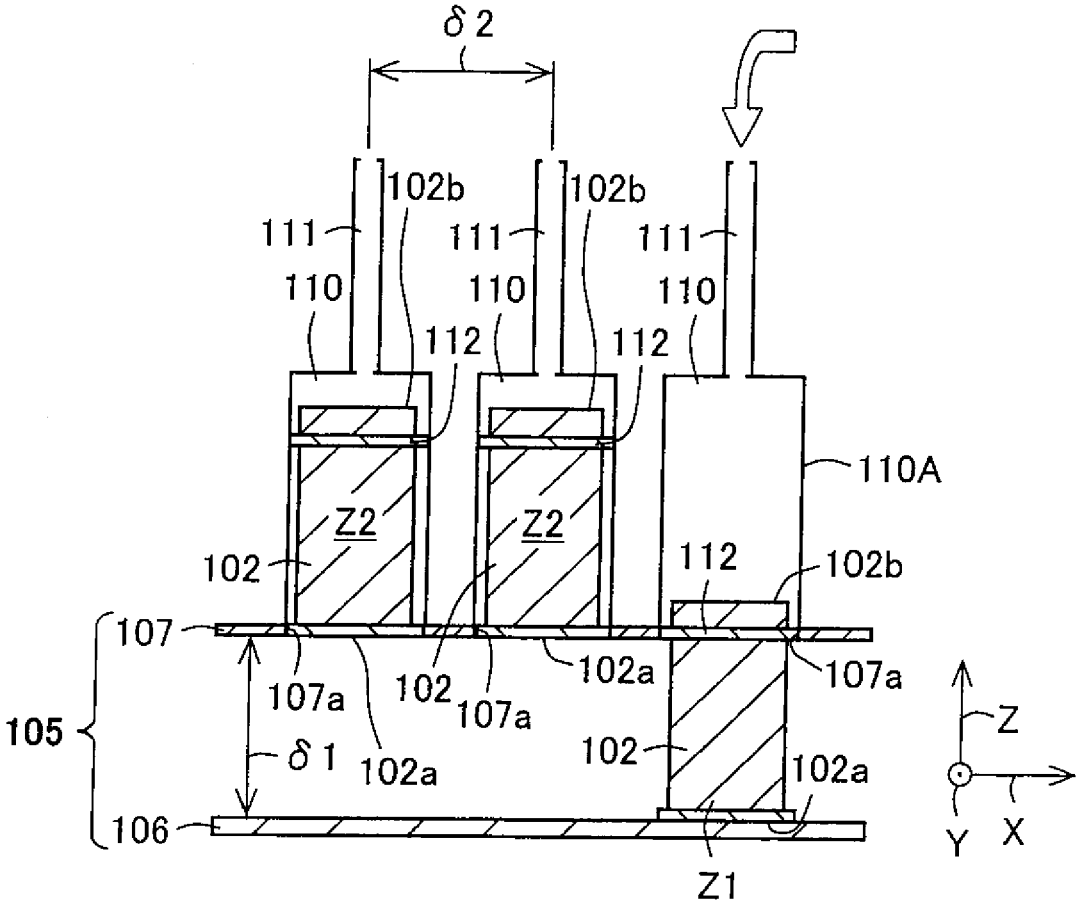
FIG. 13 is a cross-sectional view of the main portions of a driving portion of control pins 102, taken along a virtual plane containing the direction in which the pins are projected and withdrawn.
Figure 14:
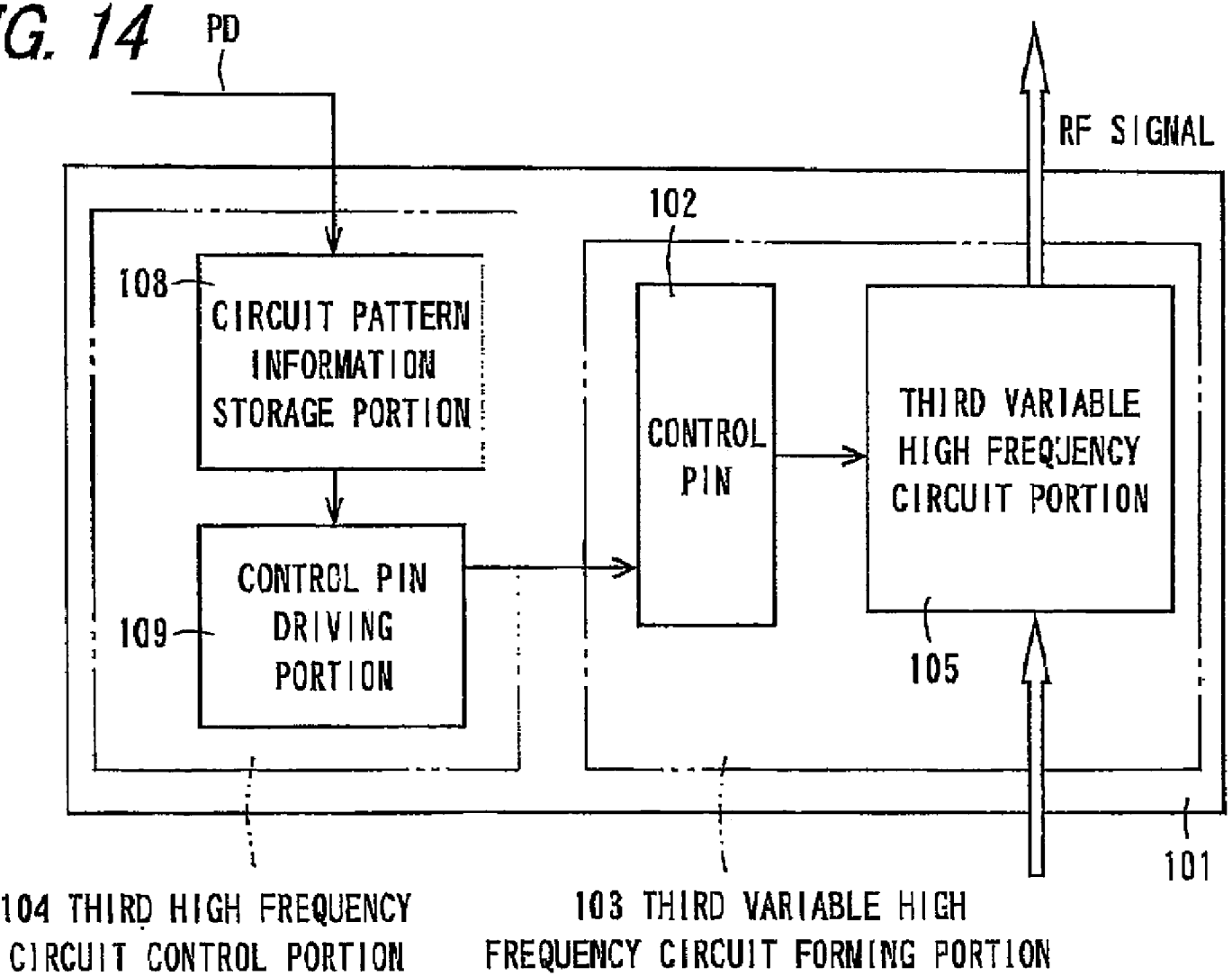
FIG. 14 is a block diagram showing the electric configuration of a variable high frequency circuit 101 according to the third embodiment.

FIG. 12 is a perspective view showing a variable high frequency circuit forming portion 103 according to a third embodiment of the invention. FIG. 13 is a cross-sectional view of the main portions of a driving portion of control pins 102, taken along a virtual plane containing the direction in which the pins are projected and withdrawn. FIG. 14 is a block diagram showing the electric configuration of a variable high frequency circuit 101 according to the third embodiment. The variable high frequency circuit 101 according to the third embodiment is referred to as a "third high frequency circuit 101". The third high frequency circuit 101 includes the variable high frequency circuit forming portion 103 as a circuit forming portion and a high frequency circuit control portion 104 as control means. The variable high frequency circuit forming portion 103 is a circuit forming portion that can change the dielectric waveguide shape for forming a dielectric waveguide. The high frequency circuit control portion 104 controls so as to change the dielectric waveguide shape of the circuit forming portion based on expected information. First, the variable high frequency circuit forming portion 103 will be described.

The variable high frequency circuit forming portion 103 has a variable high frequency circuit portion 105 and a plurality of control pins 102 (corresponding to movable members). The control pins 102 may be referred to as control dielectric materials. The variable high frequency circuit portion 105 includes a first and a second conductive layer 106 and 107. The first and the second conductive layers 106 and 107 are a pair of conductive layers that form a part of a dielectric waveguide, and are arranged in parallel so as to be spaced away from each other by a predetermined small distance δ1. The first and the second conductive layers 106 and 107 are formed, for example, in the shape of a rectangular plate when viewed from above. The thickness direction of the first and the second conductive layers 106 and 107 is defined as a Z direction. The direction that is parallel to one side of the first conductive layer 106 is defined as an X direction. The direction that is perpendicular to the X and Z directions and parallel to the other side of the first conductive layer 106 is defined as a Y direction. In FIG. 12, the X, Y, and Z directions are indicated respectively as arrows X, Y, and Z. A virtual plane containing the X direction and the Y direction is referred to as an "XY plane". A view of the first high frequency circuit 101 or a part thereof in the Z direction is referred to as a "view from above".

A plurality of through-holes 107*a* for displacing the control pins 102 are formed in the second conductive layer 107. The plurality of through-holes 107*a* are arranged along the XY plane of the second conductive layer 107 at predetermined intervals in the X direction and at predetermined intervals in the Y direction. The configuration is such that the control pins 102 correspond to the through-holes 107*a* in a one-to-one manner. Each through-hole 107*a* of the second conductive layer 107 is formed in the shape of a rectangular hole so as to correspond to the shape of the control pin 102 described below. Each through-hole 107*a* is loosely formed with respect to each control pin 102 so that the control pin 102 can be smoothly displaced.

The plurality of control pins 102 can form a dielectric waveguide in cooperation with the first and the second conductive layers 106 and 107. Each control pin 102 is configured such that the control pin 102 can be displaced between a down-status in which a part of a so-called dielectric strip of the dielectric waveguide is formed and an up-status. The down-status (see Z1 in FIG. 13) is synonymous with a dielectric waveguide forming state in which the control pin 102 has been lowered in one direction in the Z direction to form a part of the dielectric waveguide. The up-status (see Z2 in FIG. 13) is synonymous with a dielectric waveguide non-forming state in which the control pin 102 has been lifted in the other direction in the Z direction not to form a part of the dielectric waveguide. Each control pin 102 is made of a dielectric material, and is formed in the shape of a quadratic prism that extends in the Z direction. Each control pin 102 is formed such that the length in the Z direction is longer by a predetermined small distance than a distance δ1 between the first conductive layer 106 and the second conductive layer 107. In the down-status, one end portion 102*a* in the longitudinal direction of each control pin 102 is in contact with the first conductive layer 106, and another end portion 102*b* in the longitudinal direction of the control pin 102 slightly projects from one surface portion of the second conductive layer 107. In the up-status, the one end portion 102*a* in the longitudinal direction of the control pin 102 is away from the first conductive layer 106, and is flush with, for example, one surface of the second conductive layer 107. However, there is no limitation to this flush state.

In a case where the plurality of control pins 102 are successively in the down-status along the XY plane, a waveguide in which a dielectric material is formed between the first and the second conductive layers 106 and 107, that is, a so-called H guide is obtained. Furthermore, in a case where the predetermined interval 61 between the first and the second conductive layers 106 and 107 is set to be equal to or narrower than half a signal wavelength λ, an air region is blocked, and thus signal waves cannot exist therein. Since the wavelength is shortened inside a dielectric material, the blocked state is canceled, and thus signal waves can be transmitted. Accordingly, a so-called nonradiative dielectric waveguide (abbreviated as an NRD guide) can be formed.

With the plurality of through-holes 107*a* formed in the second conductive layer 107, the second conductive layer 107 is in the form of a mesh along the XY plane. The interval between the through-holes 107*a* is sufficiently smaller than the wavelength of electromagnetic waves that are transmitted (less than half the wavelength, preferably one-fourth of the wavelength or less). Thus, electromagnetic waves do not leak to be transmitted from the through-holes 107*a*. In other words, in a case where a distance δ2 between the control pins 102 adjacent in the X or Y direction, which is the center distance between the adjacent control pins 102 in the lateral cross section, is prescribed to be less than half the wavelength, preferably one-fourth of the wavelength or less, electromagnetic waves can be prevented from leaking to be transmitted from the through-holes 107*a*. Using this aspect, it is possible to form a dielectric waveguide of an H guide or NRD guide, with the first conductive layer 106, the second conductive layer 107, and the plurality of control pins 102 in the down-status. Furthermore, it is possible to change the dielectric waveguide shape that is formed, by selecting the state of the control pins 102 between the up-status and the down-status.

In this embodiment, each control pin 102 is formed in the shape of a quadratic prism, but the shape is not limited to quadratic prisms, and other shapes are also possible such as cylindrical columns or polygonal prisms other than quadratic prisms, more specifically, triangular prisms, pentagonal prism, and the like. In the variable high frequency circuit, the plurality of control pins 102 can be constituted by a plurality of types of polygonal prisms, or may be constituted by cylindrical columns and polygonal prisms. Compared with control pins constituted by polygonal prisms, those constituted by cylindrical columns can form curves of a waveguide more easily, and thus can support various structures, which increases the versatility.

A conductive layer is formed in the one end portion 102*a* in the longitudinal direction of the control pin 102, and the one end portion 102*a* is preferably flush with the second conductive layer 107 in the up-status. Accordingly, in the up-status of each control pin 102, the one end portion 102*a* in the longitudinal direction of the control pin 102 is flush with one surface of the second conductive layer 107, that is, the through-hole 107*a* of the second conductive layer 107 is sealed with the one end portion 102*a* in the longitudinal direction of each control pin 102 to realize a sealed state, and thus the transmission loss in the conductive material portion can be made as small as possible. Furthermore, a conductive layer is preferably formed in at least one of the upper face, the interior, and the lower face of a piston 112 described later. Accordingly, the sealed state can be realized also in the down-status of the control pins 102.

Accordingly, the transmission loss can be made as small as possible in both of the down-status and the up-status of the control pins 102, the down-status being a dielectric waveguide forming state in which the control pins 102 form a dielectric waveguide, and the up-status being a dielectric waveguide non-forming state in which the control pins 102 do not form a dielectric waveguide. The piston (sealing section) and the conductive layer do not have to be formed at the same position. For example, the conductive layer may be at the position shown in the drawing, and the piston (sealing section) may be provided at the upper end face of the control pin (the piston and the conductive layer are different elements).

Hereinafter, the high frequency circuit control portion 104 will be described. The high frequency circuit control portion 104 includes a circuit pattern information storage portion 108 and a control pin driving portion 109, which are electrically connected. The circuit pattern information storage portion 108 stores therein information of the dielectric waveguide shape for forming a dielectric waveguide, that is, pattern information. Pattern information PD transmitted, for example, in a wired or wireless manner to the third high frequency circuit 101 is temporarily stored in the circuit pattern information storage portion 108. The circuit pattern information storage portion 108 transmits signals to the control pin driving portion 109 (control dielectric driving portion) so that the information is reproduced. The control pin driving portion 109 includes a pump motor as a driving source, a fluid pressure cylinder 110, and a pipe 111 and a control valve (not shown) which are referred to as a pipe or the like, which are connected via pipes. A cylinder body 110A of the fluid pressure cylinder 110 is secured to the second conductive layer 107.

The fluid pressure cylinder 110 includes the cylinder body 110A and the piston 112 that is integrally secured to the other end portion 102*b* in the longitudinal direction of the control pin 102. As a working fluid of the fluid pressure cylinder 110, for example, a gas or oil is used. In a case where a gas is used as the working fluid, it is possible to make the third high frequency circuit 101 lighter than in the case where an oil is used, and thus it is possible to increase the portability of apparatuses including the third high frequency circuit 101. In a case where the working fluid is injected from the driving source via the pipe 111 or the like into the cylinder body 110A based on signals transmitted from the circuit pattern information storage portion 108 to the control pin driving portion 109, positive pressure is applied to the interior of the cylinder body 110A, and thus the piston 112, that is, the control pin 102 is pushed from the up-status to the down-status.

Conversely, in a case where the working fluid inside the cylinder body 110A is sucked based on the signals, negative pressure is applied to the interior of the cylinder body 110A, and thus the control pin 102 is displaced from the down-status to the up-status. As a result, each control pin 102 is in the up-status or the down-status, and thus a modified high frequency circuit is formed. High frequency signals that are inputted to the high frequency circuit are outputted after a filtering process or the like performed in the variable high frequency circuit portion 105. However, the process is not limited to the filtering process.

In this embodiment, the control pin 102 is displaced to the up-status with application of negative pressure to the interior of the cylinder body 110A, but the configuration is not limited to this. For example, biasing means also may be provided that is constituted by a coil spring displacing the control pin 102 from the down-status to the up-status when the pressure of the working fluid applied to the interior of the cylinder body 110A is released. Here, the coil spring has to be made of a nonmetal such as synthetic resins. In this case, it is possible to displace the control pin 102 more quickly than in this embodiment in which negative pressure is applied to the interior of the cylinder body 110A. Even in a case where the working fluid leaks at a point in the pipes or the like, the control pin 102 can be reliably and quickly displaced. It is also possible to control so that each control pin 102 can be displaced between the up-status and the down-status, using a motor and a cam that is secured to a shaft of the motor, the biasing means described above, or the like. Also in this case, effects similar to those in this modified embodiment can be achieved.

Figure 15A:
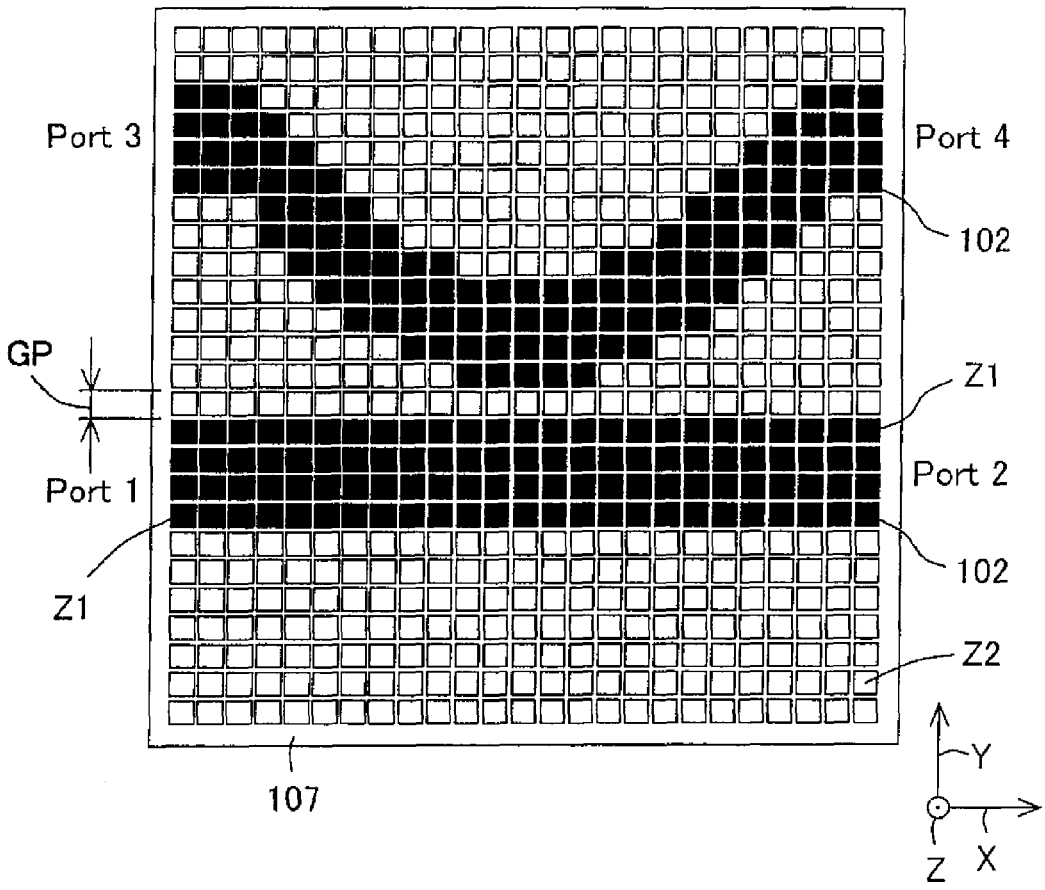
FIGS. 15A and 15B are plan views showing circuit patterns, where
Figure 15B:
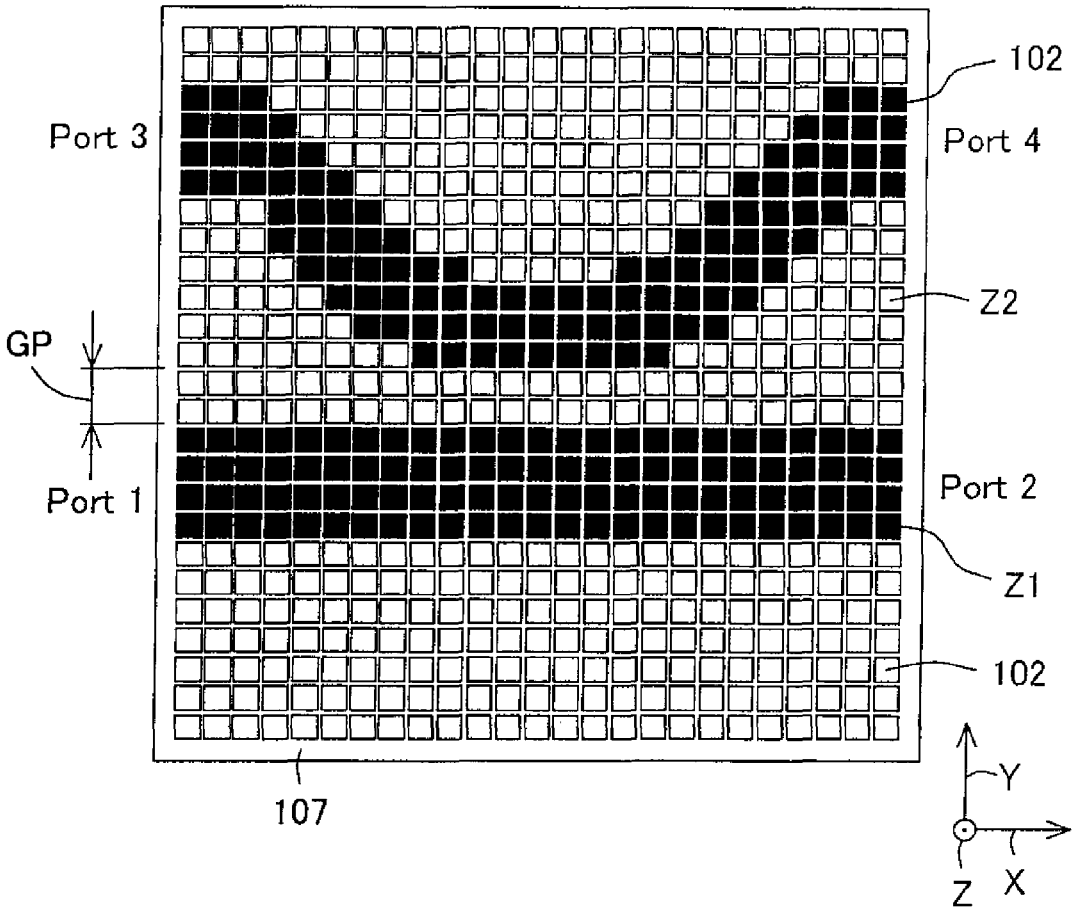

FIGS. 15A and 15B are plan views showing circuit patterns. FIG. 15A is a plan view showing a circuit pattern in which the control pins 102 are arranged to have the function of a coupler. FIG. 15B is a plan view showing a circuit pattern in which the coupling gap is made wider than that in the circuit pattern in FIG. 15A. The control pins 102 are arranged at constant intervals in the X direction and the Y direction. A hollow square indicates the control pin 102 in the up-status in which the dielectric waveguide is not formed. A solid square indicates the control pin 102 in the down-status in which the dielectric waveguide is formed. The circuit pattern that is in the dielectric waveguide shape shown in FIG. 15A is prescribed, for example, as a default. The circuit pattern information shown in FIG. 15A is stored in the circuit pattern information storage portion 108. Based on an operation command of an operator, the circuit pattern information storage portion 108 transmits signals to the control pin driving portion 109, and the control pin driving portion 109 controls driving of the driving source. Accordingly, positive pressure or negative pressure is applied to the interior of the cylinder body 110A, and the control pin 102 is displaced to the up-status or the down-status. Thus, the circuit pattern in FIG. 15A is obtained.

As shown in FIG. 15B, a structure is also possible in which a coupling gap GP is made wider than that in the circuit pattern in FIG. 15A. The distribution ratio of electric power is shifted by adjusting the coupling gap GP in this manner, and thus a so-called power divider can be formed. Pattern information for a power divider, which realizes the power divider, is also stored in the circuit pattern information storage portion 108. Based on an operation command of an operator, the circuit pattern information storage portion 108 transmits signals to the control pin driving portion 109, and the control pin driving portion 109 controls driving of the driving source based on the pattern information for a power divider. Thus, the power divider shown in FIG. 15B is obtained.

Figure 16A:
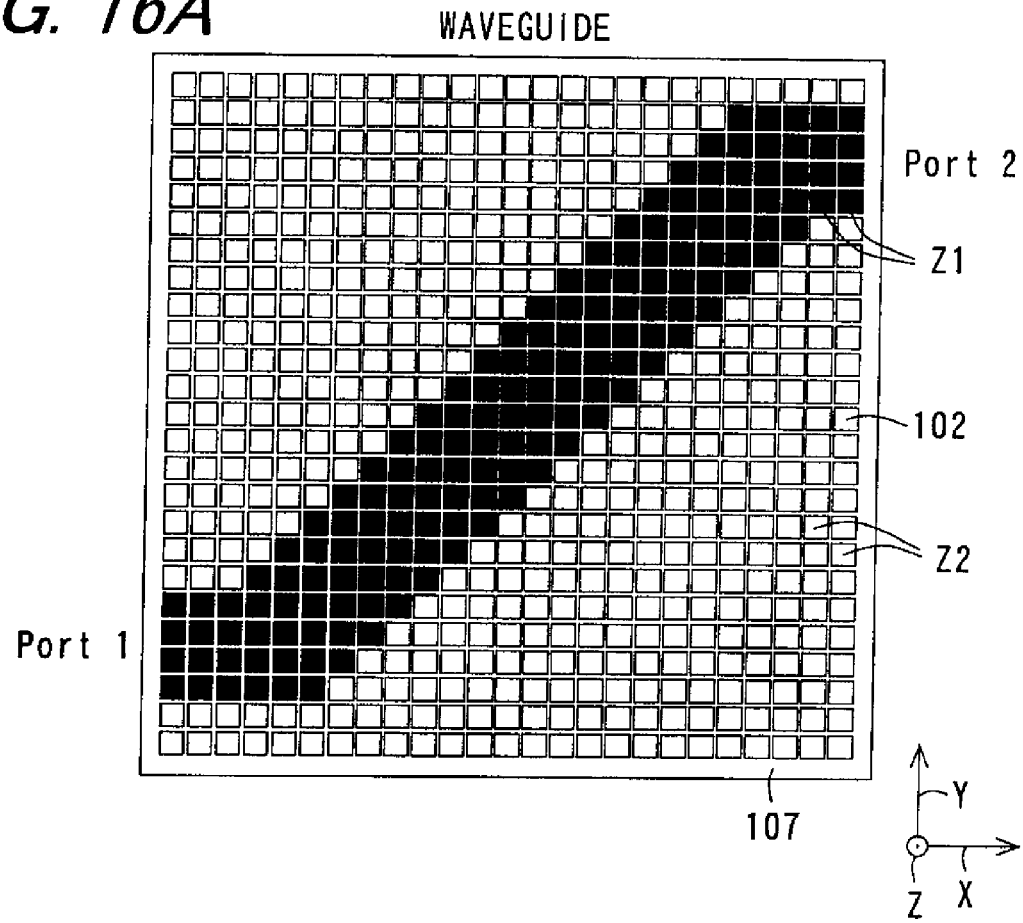
FIGS. 16A and 16B are plan views showing circuit patterns, where
Figure 16B:
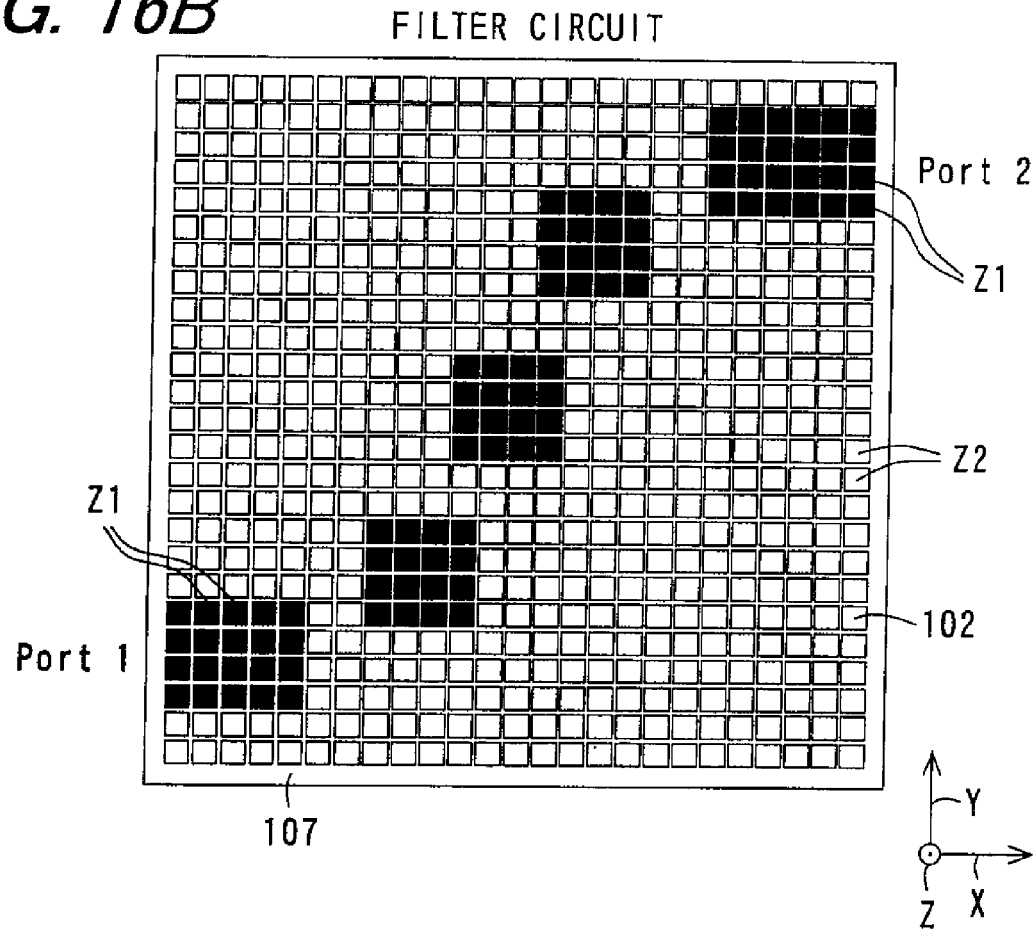

FIGS. 16A and 16B are plan views showing circuit patterns. FIG. 16A is a plan view showing a circuit pattern of a linear dielectric waveguide structure. FIG. 16B is a plan view showing a circuit pattern provided with a filtering function. In this embodiment, for example, the circuit pattern shown in FIG. 16A stored as a default can be changed into the circuit pattern provided with a filtering function (filter circuit), with an operation command from an operator. A filter circuit can be easily and quickly realized by displacing the control pins 102 to the down-status at predetermined intervals in the X and Y directions. Since the circuit pattern can be changed by displacing predetermined control pins 102 to the up-status or the down-status, the center frequency properties and passband of the filtering function also can be changed.

According to the third high frequency circuit 101 described above, the high frequency circuit control portion 104 changes the dielectric waveguide shape of the variable high frequency circuit forming portion 103 based on the pattern information (corresponding to expected information), and thus the variable high frequency circuit forming portion 103 can be freely and easily changed. Compared with a conventional technique in which a plurality of types of high frequency circuit components are selectively used, it is possible to simplify the structure and optimize the variable high frequency circuit forming portion 103. Thus, a high frequency circuit having high versatility can be realized.

According to the third high frequency circuit 101, the first and the second conductive layers 106 and 107 that are spaced away from each other, and the plurality of control pins 102 can cooperate with each other to form a dielectric waveguide. The variable high frequency circuit forming portion 103 can be easily changed by displacing each control pin 102 between the down-status and the up-status. The variable high frequency circuit forming portion 103 is changed to have a dielectric waveguide shape of at least one of a power divider, a filter circuit, and a coupler. In this manner, the versatility of the third high frequency circuit 101 can be increased.

Figure 17:
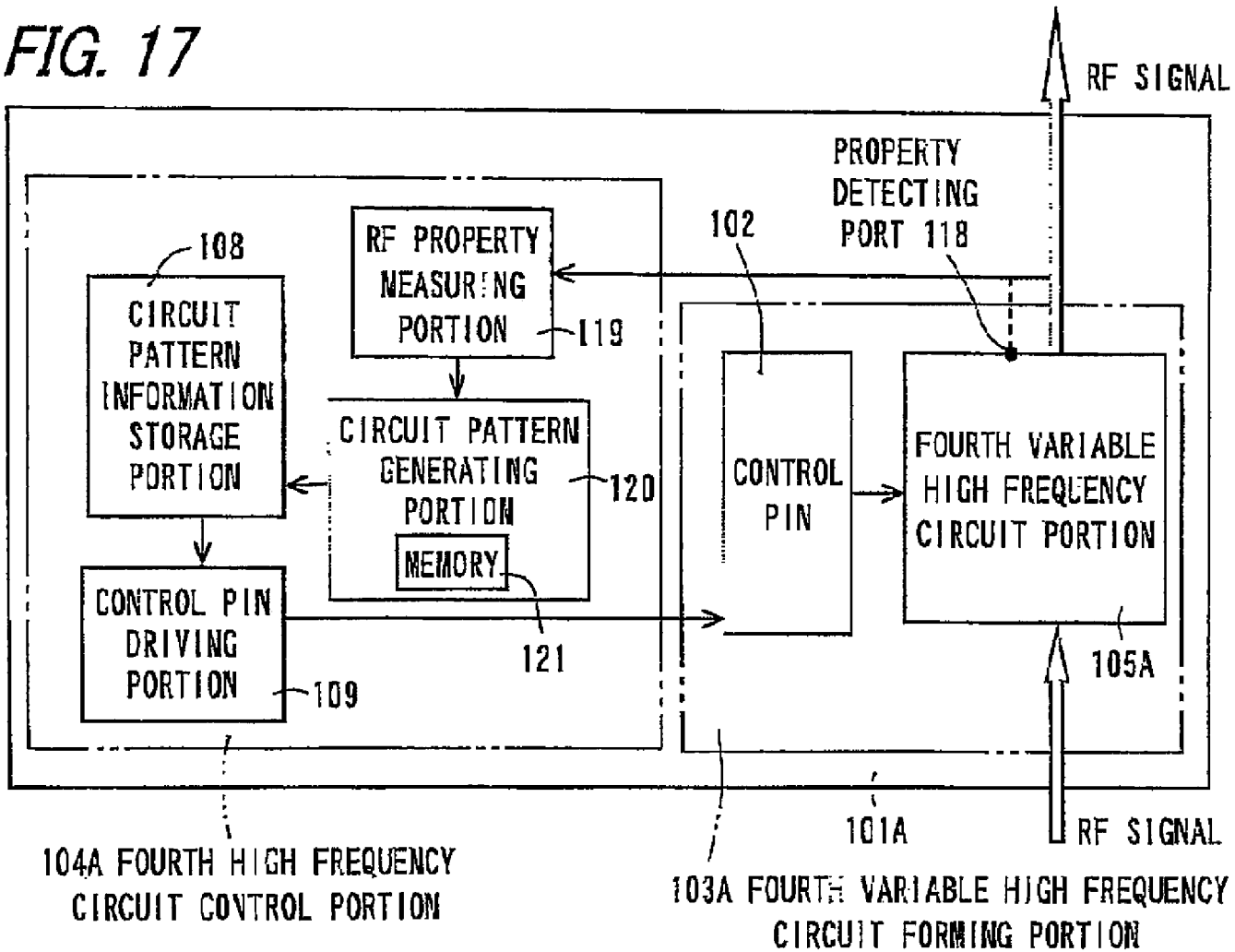
FIG. 17 is a block diagram showing the electric configuration of a variable high frequency circuit 101A according to a fourth embodiment.

FIG. 17 is a block diagram showing the electric configuration of a variable high frequency circuit 101A according to a fourth embodiment. The variable high frequency circuit 101A according to the fourth embodiment is referred to as a "fourth high frequency circuit 101A". The fourth high frequency circuit 101A includes a fourth variable high frequency circuit forming portion 103A as a circuit forming portion and a fourth high frequency circuit control portion 104A as control means. The fourth variable high frequency circuit forming portion 103A has a fourth variable high frequency circuit portion 105A and a plurality of control pins 102. A property detecting port 118 for detecting high frequency signals processed in the fourth variable high frequency circuit portion 105A is formed in the fourth variable high frequency circuit portion 105A. A part of high frequency signals outputted from the property detecting port 118 is inputted to an RF property measuring portion 119 described later.

The fourth high frequency circuit control portion 104A includes the RF property measuring portion 119, a circuit pattern generating portion 120, the circuit pattern information storage portion 108, and the control pin driving portion 109, which are electrically connected. High frequency signals outputted (finally outputted) from the property detecting port 118 are inputted to the RF property measuring portion 119. The RF property measuring portion 119 performs measurement to determine whether or not desired RF signals are outputted. Information indicating a result of this measurement is transmitted to the circuit pattern generating portion 120. The circuit pattern generating portion 120 has a function of determining whether or not high frequency signals processed in the fourth variable high frequency circuit portion 105A have been processed to obtain desired properties, and modifying the process.

The circuit pattern generating portion 120 has a memory 121 as storage means. The memory 121 stores therein reference data functioning as a determination reference for determining whether or not a process has been performed to obtain desired properties. Information indicating a result of the determination is temporarily stored in the memory 121, and this information and the reference data are used for comparison. The circuit pattern generating portion 120 generates a modified circuit pattern based on a result of the comparison. This modified circuit pattern is temporarily stored in the circuit pattern information storage portion 108. The circuit pattern information storage portion 108 transmits signals to the control pin driving portion 109 so that the circuit pattern is reproduced. In this manner, high frequency signals that are to be processed in the fourth variable high frequency circuit portion 105A can be easily and reliably modified. The fourth variable high frequency circuit portion 105A can output expected high frequency signals by repeating this feedback control.

For example, the coupler structure shown in FIGS. 15A and 15B can be formed in the vicinity of output signals of a functional block that is to be measured, and waves can be separated in such a manner that the main signals are not significantly disturbed and outputted to the property detecting port 118. Accordingly, only a necessary functional block can be measured. Thus, compared with the case in which all functional blocks are measured, it is possible to reduce the processing load on the central processing unit and the like. The other functions and effects are the same as those in the third high frequency circuit 101.

Figure 18:
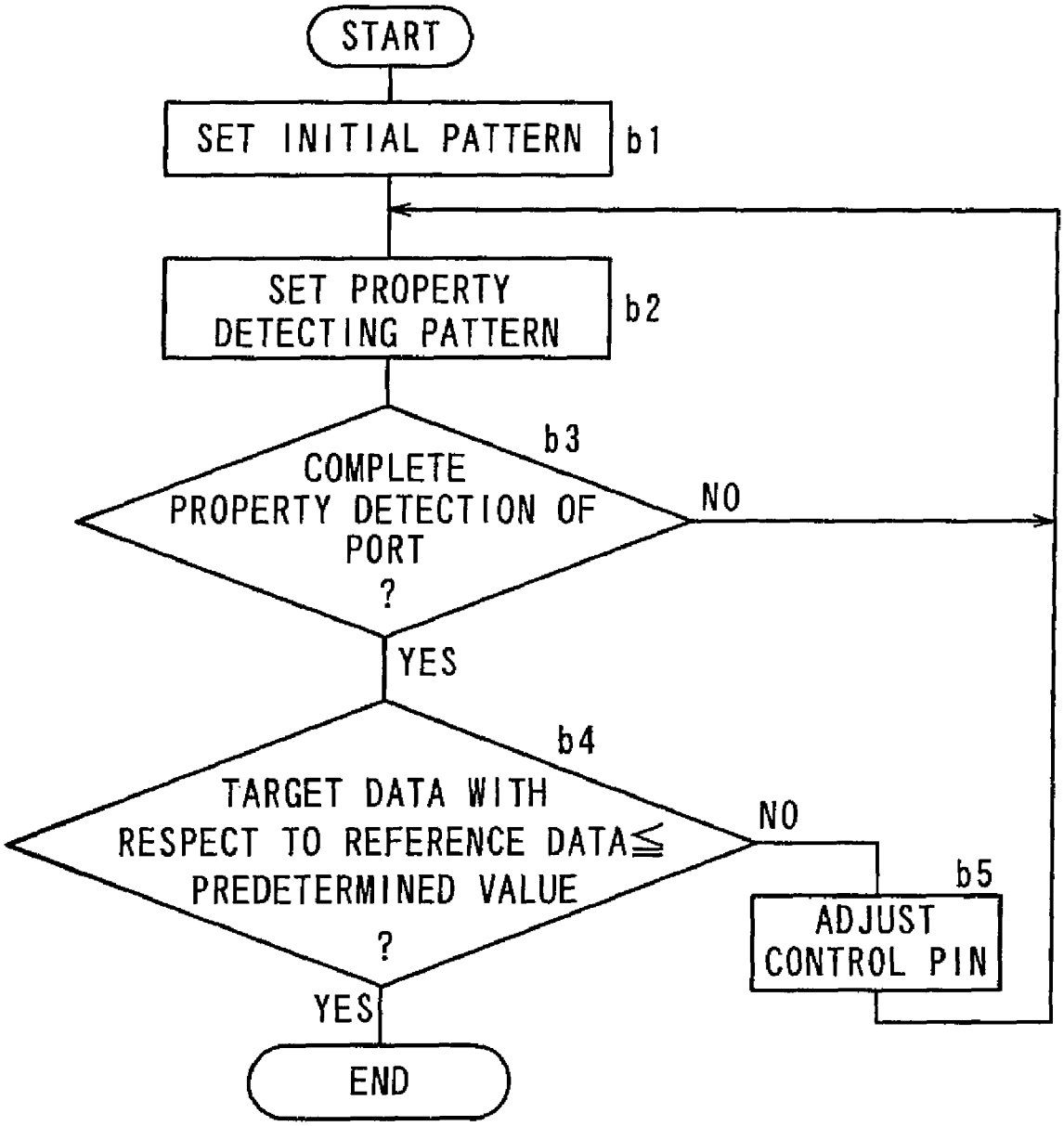
FIG. 18 is a flowchart showing the processing flow in the circuit pattern generating portion 120.

FIG. 18 is a flowchart showing the processing flow in the circuit pattern generating portion 120. In the description below, a reference is made also to FIG. 17. Unless otherwise specified, in this processing, the control is mainly performed in the circuit pattern generating portion 120. The procedure of the processing flow starts, for example, upon satisfying the condition that the main power (not shown) of the fourth high frequency circuit 101A is turned on. After the start, the procedure proceeds to step b1, where an initial pattern that is an initial dielectric waveguide shape is set. Next, the procedure proceeds to step b2, where a property detecting pattern is set. Next, the procedure proceeds to step b3, where it is determined whether or not property detection from the property detecting port 118 has been acquired (completed), in order to compare the reference data and the detected data. In a case where a result of the determination is "NO", the procedure returns to step b2.

In a case where it is determined that the property detection has been completed, the procedure proceeds to step b4. In step b4, target data (e.g., a center frequency, etc.) of the measurement result and the reference data stored in the memory 121 are compared so that it is determined whether or not the center frequency is acceptable. In a case where a result of the determination is "NO", the procedure proceeds to step b5, where based on the comparison result in step b4, signals are transmitted via the circuit pattern information storage portion 108 to the control pin driving portion 109, to adjust the control pins 102. Then, the procedure returns to step b2. In a case where it is determined in step b4 that the center frequency is acceptable, the procedure of the flow ends. In this embodiment, a center frequency is used as target data, but there is no limitation to the center frequency. A flowchart is also possible in which processes (steps) of comparing a plurality of pieces of target data and reference data are arranged in series.

As described above, in step b4, information that is the measurement result and the reference data are compared. In a case where it is determined that the measurement result does not satisfy the condition of the circuit pattern, adjustment is performed in step b5, and then the procedure returns to step b2. The fourth variable high frequency circuit portion 105A can precisely output expected high frequency signals by repeating this feedback control.

In this embodiment, the plurality of control pins 102 are arranged on the entire XY plane in the second conductive layer 107. However, the plurality of control pins 102 may be arranged only at a main portion of the entire XY plane in the second conductive layer 107. In this case, the structure of the variable high frequency circuit forming portion 103A can be simplified, and the control system that displaces the control pins 102 also can be simplified. Through-holes for displacing the control pin 102 also may be formed in the first and the second conductive layers. In this case, the first and the second conductive layers can be held by a part of cylinder bodies, and thus the rigidity strength of the high frequency circuit can be increased. The first conductive layer can be made lighter, by the weight reduced by forming a plurality of through-holes in the first conductive layer.

The dielectric waveguide forming apparatus is applicable also to a high frequency circuit component other than the above-described high frequency circuit component such as a filter circuit. In this embodiment, the dielectric waveguide forming apparatus is applied to a high frequency circuit, but is applicable also to a low frequency circuit. In this case, it is possible to simplify the structure and optimize a variable low frequency circuit forming portion. Thus, a low frequency circuit having high versatility can be realized. As another embodiment of the invention, a desired high frequency circuit may be provided, for example, in which based on a request from a user, a plurality of control pins are controlled to be in the up-status or the down-status, and then all the control pins are fixed so as not to be displaced. In this case, a plurality of types of high frequency circuit components do not have to be prepared, and thus the versatility of the high frequency circuit can be improved. In addition to the above, embodiments can be modified in various manners without departing from the gist of the invention.

Figure 19:
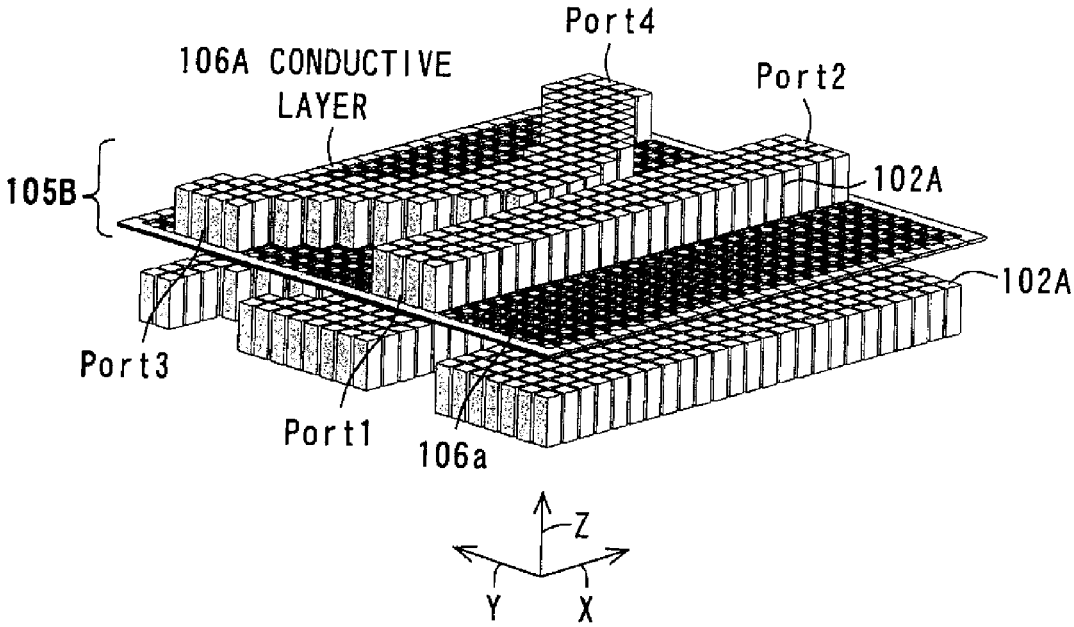
FIG. 19 is a perspective view showing a variable high frequency circuit forming portion 103B according to a fifth embodiment of the invention.
Figure 20:
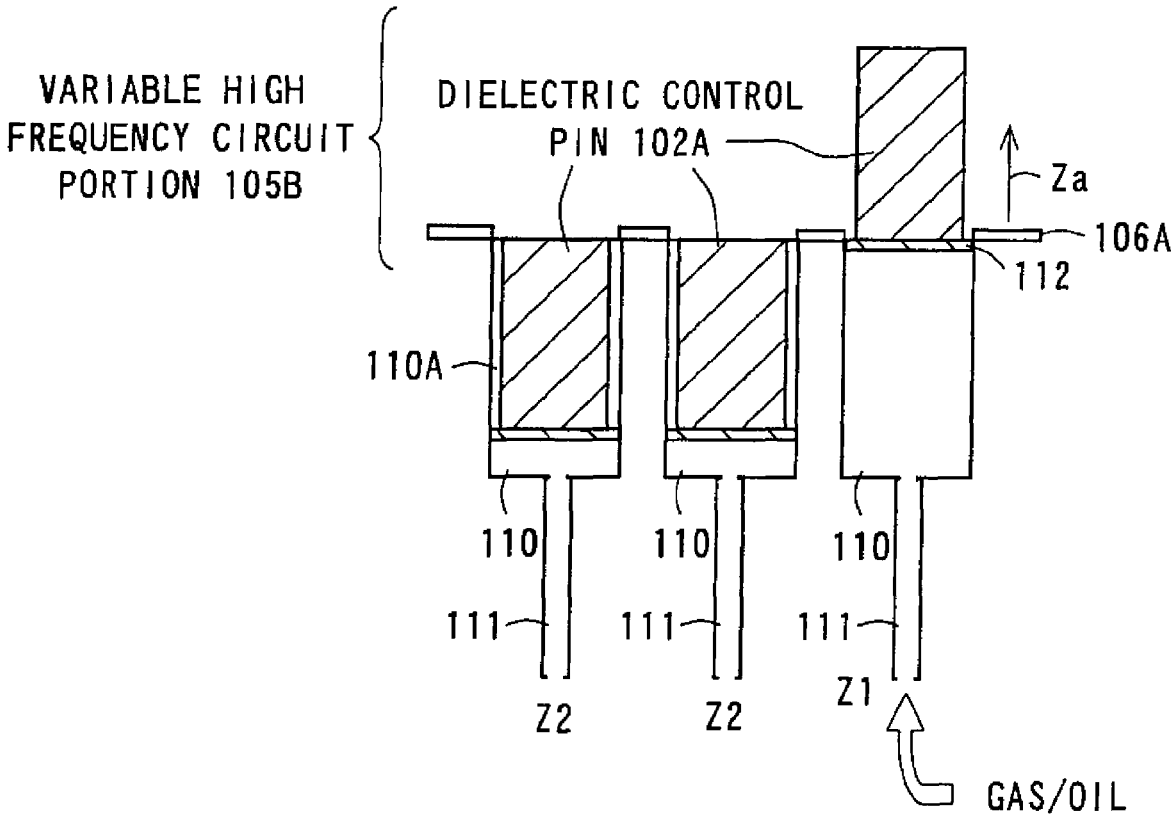
FIG. 20 is a cross-sectional view of the main portions of a driving portion of control pins 102A, taken along a virtual plane containing the direction in which the pins are projected and withdrawn.
Figure 21:
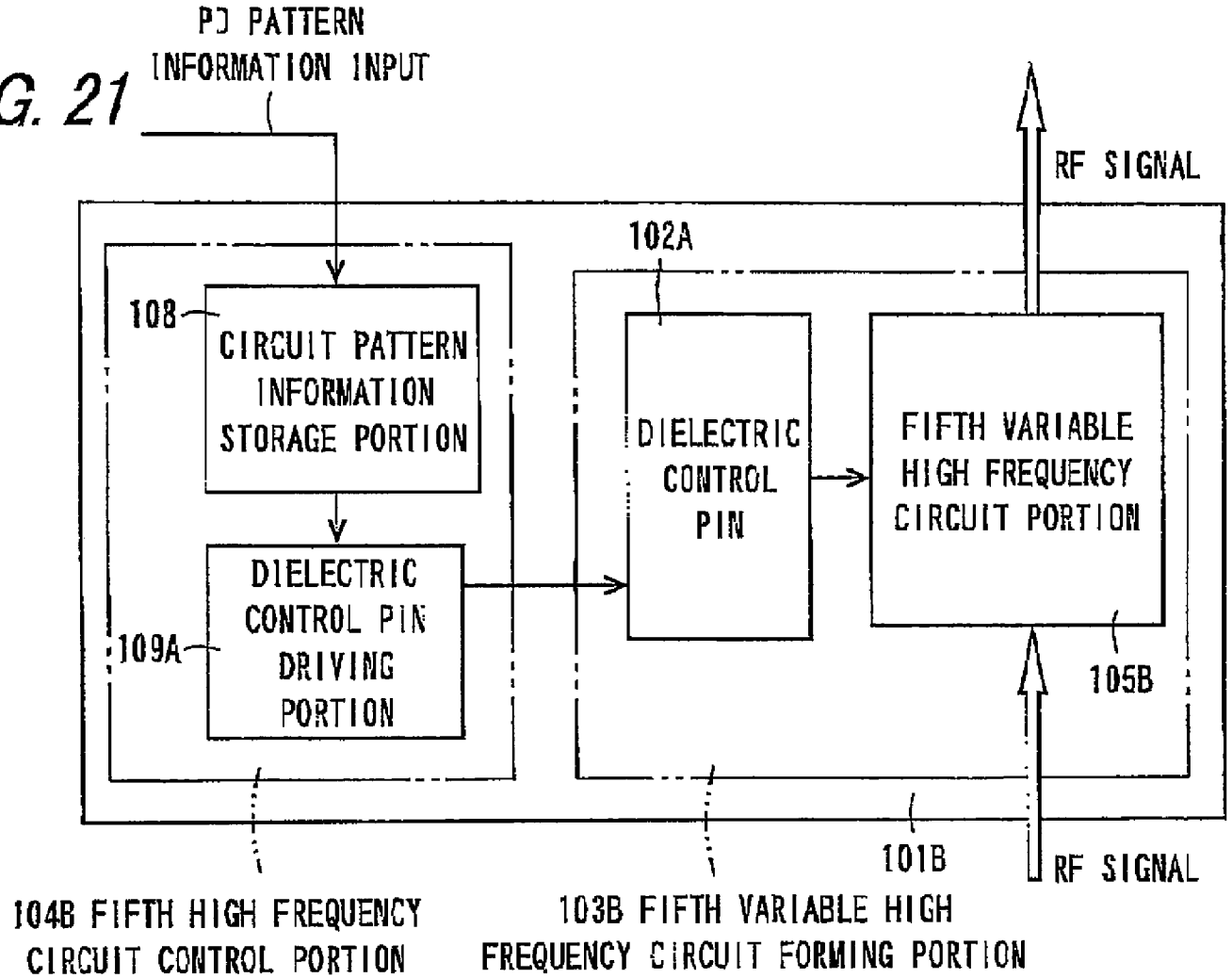
FIG. 21 is a block diagram showing the electric configuration of a variable high frequency circuit 101B according to the fifth embodiment.

FIG. 19 is a perspective view showing a variable high frequency circuit forming portion 103B according to a fifth embodiment of the invention. FIG. 20 is a cross-sectional view of the main portions of a driving portion of control pins 102A, taken along a virtual plane containing the direction in which the pins are projected and withdrawn. FIG. 21 a block diagram showing the electric configuration of a variable high frequency circuit 101B according to the fifth embodiment. The variable high frequency circuit 101B according to the fifth embodiment is referred to as a "fifth high frequency circuit 101B". The fifth high frequency circuit 101B includes the fifth variable high frequency circuit forming portion 103B as a circuit forming portion and a fifth high frequency circuit control portion 104B as control means. The fifth variable high frequency circuit forming portion 103B is a circuit forming portion that can change the dielectric waveguide shape for forming a dielectric waveguide. The fifth high frequency circuit control portion 104B controls so as to change the dielectric waveguide shape of the fifth variable high frequency circuit forming portion 103B based on expected information. First, the fifth variable high frequency circuit forming portion 103B will be described.

The fifth variable high frequency circuit forming portion 103B has a fifth variable high frequency circuit portion 105B and a plurality of control pins 102A (corresponding to movable members). The fifth variable high frequency circuit forming portion 103B includes a conductive layer 106A. The dielectric waveguide formed in this embodiment is a so-called image guide. A metal plate that forms the image guide corresponds to the conductive layer 106A in this embodiment. The dielectric waveguide is constituted by a group of control pins 102A in this embodiment. The conductive layer 106A is formed, for example, in the shape of a rectangular plate when viewed from above.

A plurality of through-holes 106*a* for displacing the control pins 102A are formed in the conductive layer 106A. The plurality of through-holes 106*a* are arranged along the XY plane of the conductive layer 106A at predetermined intervals in the X direction and at predetermined intervals in the Y direction. The configuration is such that the control pins 102A correspond to the through-holes 106*a* in a one-to-one manner. Each through-hole 106*a* of the conductive layer 106A is formed in the shape of a rectangular hole so as to correspond to the shape of the control pin 102A described below. Each through-hole 106*a* is loosely formed with respect to each control pin 102A so that the control pin 102A can be smoothly displaced.

The plurality of control pins 102A can form a dielectric waveguide in cooperation with the conductive layer 136A. Each control pin 102A can be displaced between an up-status in which a part of a dielectric waveguide of the image guide is formed and a down-status. The up-status (see Z1 in FIG. 20) is synonymous with a dielectric waveguide forming state in which the control pin 102A has been lifted in one direction in the Z direction to form a part of the dielectric waveguide. The down-status (see Z2 in FIG. 20) is synonymous with a dielectric waveguide non-forming state in which the control pin 102A has been lowered in the other direction in the Z direction not to form a part of the dielectric waveguide. Each control pin 102A is made of a dielectric material, and is formed in the shape of a quadratic prism that extends in the Z direction. The length in the Z direction of each control pin 102A and the width of a group of the control pins 102A forming the dielectric waveguide are determined based on a desired frequency band. The frequency band relates also to the relative dielectric constant of the control pins 102A.

Herein, even in a case where a hole with a size of less than half the wavelength of electromagnetic waves transmitted through the dielectric waveguide is open in a metal wall, the electromagnetic waves do not leak to be transmitted from this hole. Thus, in a case where the size of the through-holes 106*a* formed in the conductive layer 106A is prescribed to less than half the wavelength of signals, electromagnetic waves do not leak to be transmitted out of the conductive layer 106A, and the conductive layer 106A functions as a metal plate of the image guide. It is possible to form or change the dielectric waveguide structure that is formed, by displacing the control pins 102A to be in the up-status or the down-status.

In this embodiment, each control pin 102A is formed in the shape of a quadratic prism, but the shape is not limited to quadratic prisms, and other shapes are also possible such as cylindrical columns or polygonal prisms other than quadratic prisms, more specifically, triangular prisms, pentagonal prism, and the like. In a case where each control pin 102A is formed in the shape of a cylindrical column, the through-hole 106*a* of the conductive layer 106A corresponding to this control pin 102A in the shape of a cylindrical column can be formed in the shape of a cylindrical tube.

In this embodiment, air is present in one direction (indicated by arrow Za) in the Z direction of the conductive layer 106A, but the configuration is not limited to this. A dielectric material (not shown) may be present in one direction in the Z direction of the conductive layer 106A. A plurality of holes corresponding to the positions where the control pins 102A are arranged are formed through the dielectric material so that displacement of the control pins 102A is not hampered. In a case where this dielectric material is inserted, the control pins 102A can be held by the conductive layer 106A and the dielectric material. In a case where the control pins 102A are held by the conductive layer 106A and the dielectric material, it is possible to increase the rigidity strength of the fifth variable high frequency circuit forming portion 103B compared with the case in which a dielectric material is not present. The increased rigidity strength makes it possible to smoothly displace the control pins 102A.

Hereinafter, the fifth high frequency circuit control portion 104B will be described. The fifth high frequency circuit control portion 104B includes the circuit pattern information storage portion 108 and a control pin driving portion 109A, which are electrically connected. Pattern information PD transmitted, for example, in a wired or wireless manner to the fifth high frequency circuit 101B is temporarily stored in the circuit pattern information storage portion 108. The circuit pattern information storage portion 108 transmits signals to the control pin driving portion 109A so that the information is reproduced. The control pin driving portion 109A includes a pump motor as a driving source, the fluid pressure cylinder 110, and the pipe 111 and a control valve (not shown) which are referred to as a pipe or the like, which are connected via pipes. The cylinder body 110A of the fluid pressure cylinder 110 is secured to the conductive layer 106A.

In a case where a gas is used as the working fluid of the fluid pressure cylinder 110, it is possible to make the fifth high frequency circuit 101B lighter than in the case where an oil is used, and thus it is possible to increase the portability of apparatuses including the fifth high frequency circuit 101B. Based on signals transmitted from the circuit pattern information storage portion 108 to the control pin driving portion 109A, positive pressure is applied from the driving source via a pipe or the like to the interior of the cylinder body 110A, and thus the piston 112, that is, the control pin 102A is pushed from the down-status to the up-status.

Conversely, in a case where the working fluid inside the cylinder body 110A is sucked based on the signals, negative pressure is applied to the interior of the cylinder body 110A, and thus the control pin 102A is displaced from the up-status to the down-status. As a result, each control pin 102A is in the down-status or the up-status, and thus a modified high frequency signal is formed. High frequency signals that are inputted to the high frequency circuit are outputted after a filtering process or the like performed in the fifth variable high frequency circuit portion 105B. However, the process is not limited to the filtering process. Also in this embodiment, a coil spring displacing the control pin 102A from the up-status to the down-status when the pressure of the working fluid applied to the interior of the cylinder body 110A is released may be provided between the cylinder body 110A and the control pin. In this case, it is possible to displace the control pin 102A more quickly than in this embodiment in which negative pressure is applied to the interior of the cylinder body 110A. Even in a case where the working fluid leaks at a point in the pipes or the like, the control pin 102A can be reliably and quickly displaced.

Figure 22A:
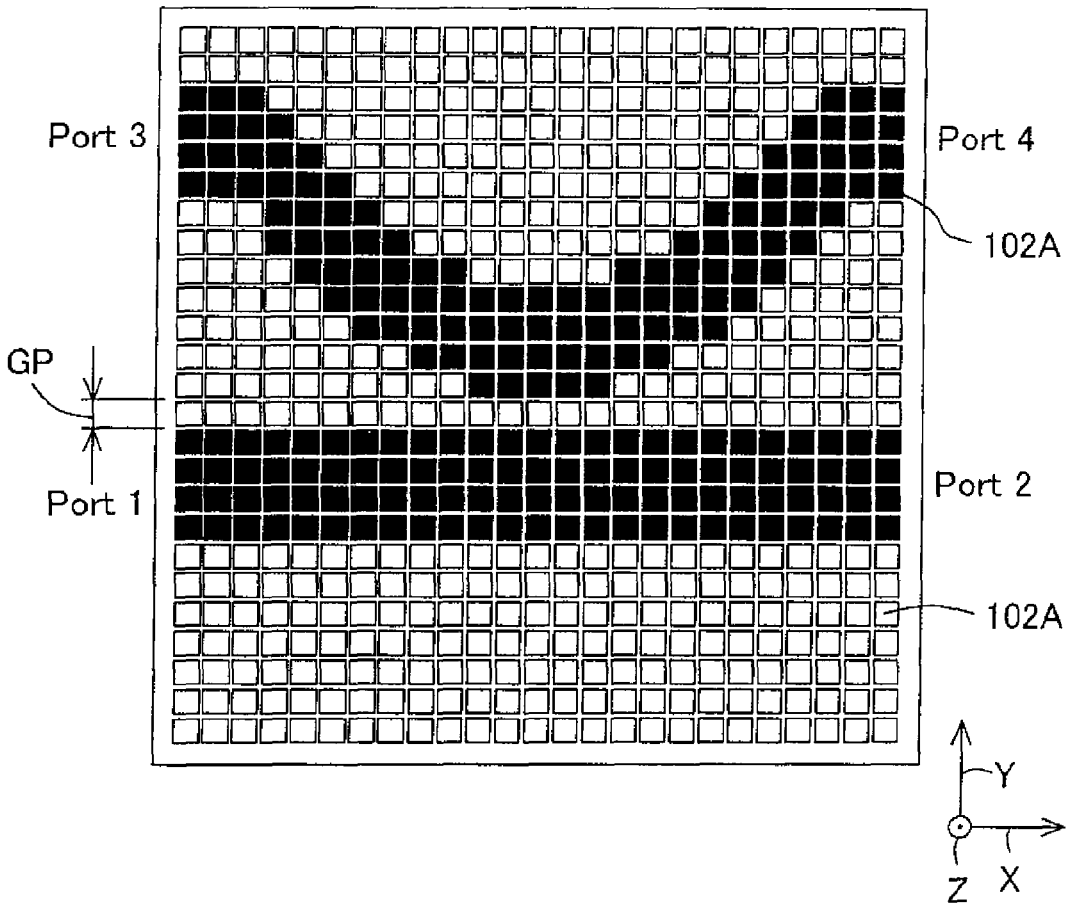
FIGS. 22A and 22B are plan views showing circuit patterns with the structure in which a part of high frequency signals inputted from the first port Pt1 and outputted from the second port Pt2 is coupled and outputted also to a fourth port Pt4.
Figure 22B:
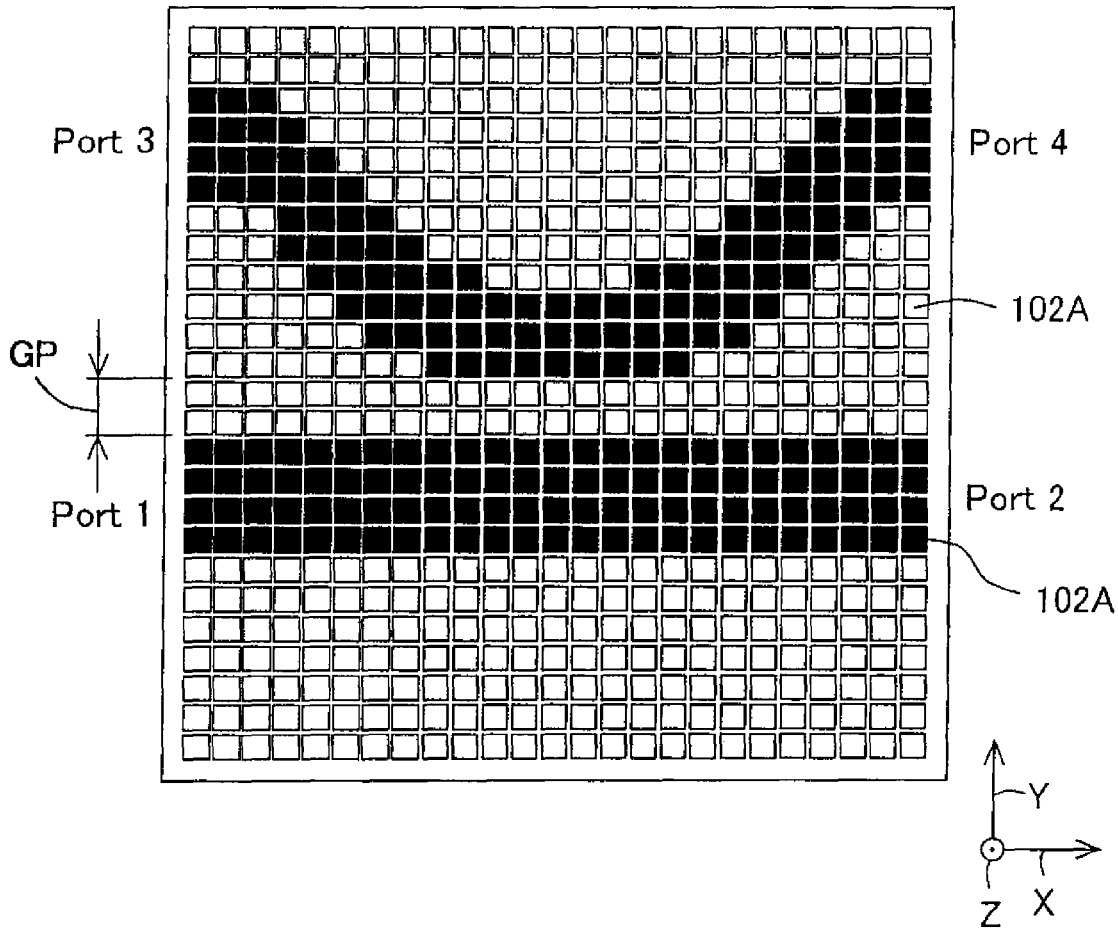

FIGS. 22A and 22B are plan views showing circuit patterns with the structure in which a part of high frequency signals inputted from the first port Pt1 and outputted from the second port Pt2 is coupled and outputted also to a fourth port Pt4. FIG. 22A shows a pattern in which the coupling amount is larger than that in FIG. 22B. Pattern information for the couplers in FIGS. 22A and 22B is stored in the circuit pattern information storage portion 108. A part of the control pins 102A forming a dielectric waveguide is displaced to the up-status or the down-status based on an operation command from an operator, and thus switching can be easily and quickly performed between the circuit pattern shown in FIG. 22A and the circuit pattern shown in FIG. 22B.

Figure 23A:
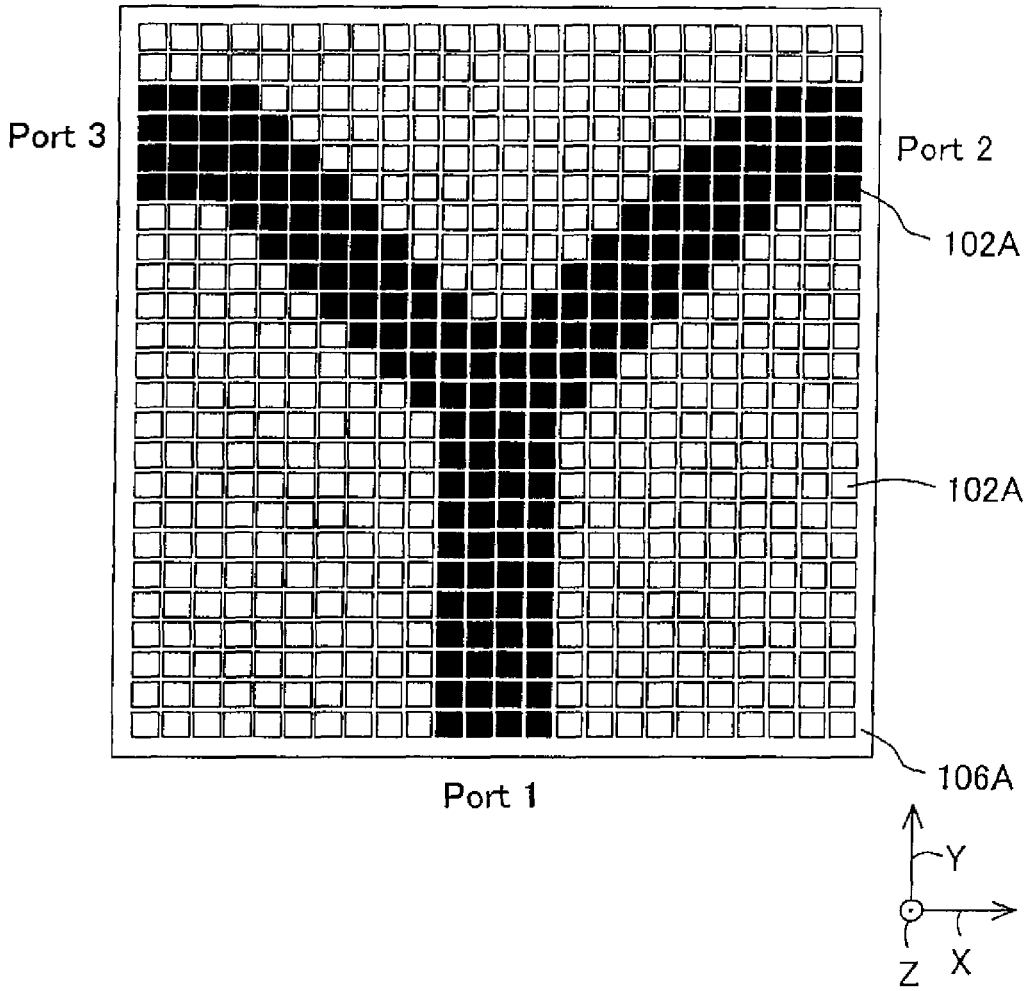
FIGS. 23A and 23B are plan views showing circuit patterns, where
Figure 23B:
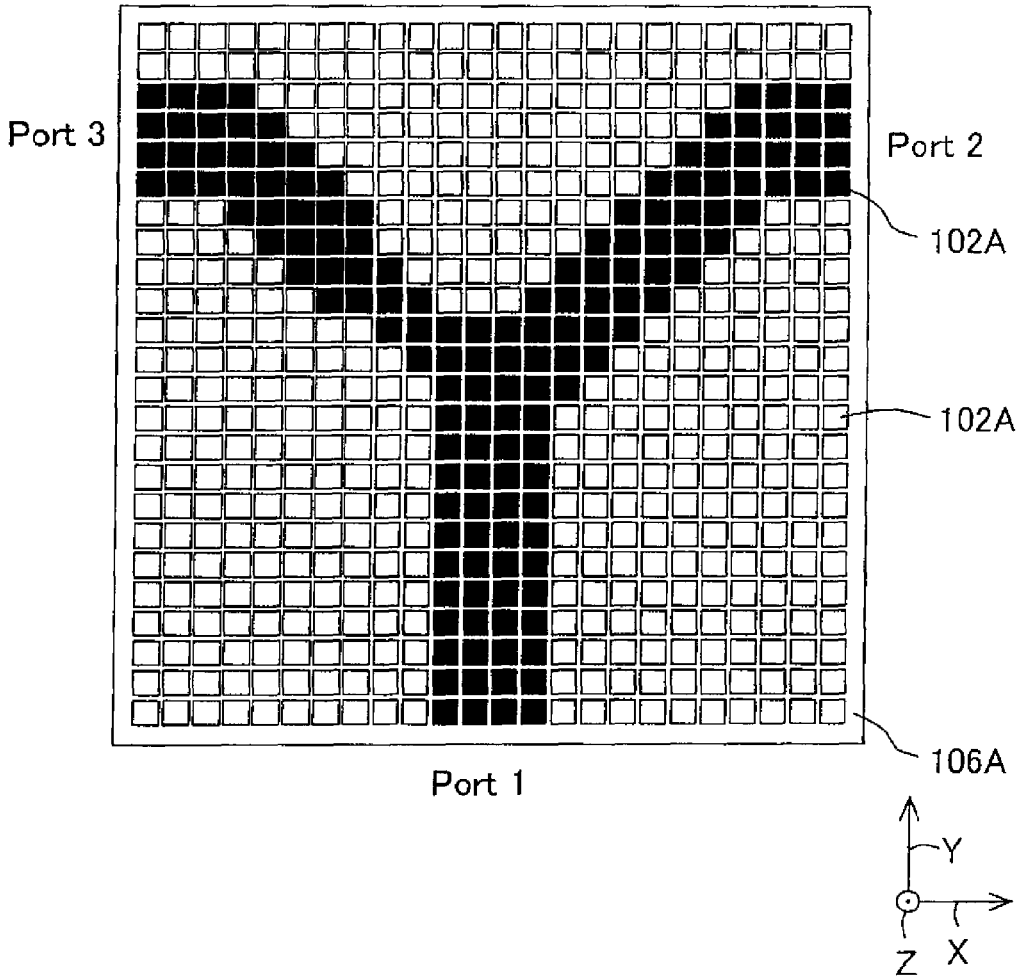

FIGS. 23A and 23B are plan views showing circuit patterns. FIG. 23A is a plan view showing a circuit pattern in which electric power is equally distributed to a second port Pt2 and a third port Pt3. FIG. 23B is a plan view showing a circuit pattern in which the distribution ratio of electric power between the second port Pt2 and the third port Pt3 is shifted.

The control pins 102A are arranged at constant intervals in the X direction and the Y direction. A hollow square indicates the control pin 102A in the down-status in which the dielectric waveguide is not formed. A solid square indicates the control pin 102A in the up-status in which the dielectric waveguide is formed. In FIG. 23A, the control pins 102A are arranged such that an equally branching process is performed. The circuit pattern that is in the dielectric waveguide shape shown in FIG. 23A is prescribed, for example, as a default. Electric power of high frequency signals inputted from a first port Pt1 is equally distributed to the second and the third ports Pt2 and Pt3. Pattern information for performing the equally branching process shown in FIG. 23A is stored in the circuit pattern information storage portion 108. Based on an operation command of an operator, the circuit pattern information storage portion 108 transmits signals to the control pin driving portion 109A, and the control pin driving portion 109A controls driving of the driving source. Accordingly, positive pressure or negative pressure is applied to the interior of the cylinder body 110A, and the control pin 102A is displaced to the up-status or the down-status. Thus, the circuit pattern in FIG. 23A is obtained.

As shown in FIG. 23B, a structure is also possible in which the circuit pattern shown in FIG. 23A is changed into a circuit pattern having a nonuniform width of the dielectric waveguide immediately after the branching. The distribution ratio of electric power is shifted by making the width of the dielectric waveguide immediately after the branching nonuniform in this manner, and thus a so-called power divider can be formed. Pattern information for a power divider, which realizes the power divider, is also stored in the circuit pattern information storage portion 108. Based on an operation command of an operator, the circuit pattern information storage portion 108 transmits signals to the control pin driving portion 109A, and the control pin driving portion 109A controls driving of the driving source based on the pattern information for a power divider. Thus, the power divider shown in FIG. 23B is obtained.

In the examples in FIGS. 23A and 23B, there is only one branching structure. However, in a case where the variable high frequency circuit is enlarged in the X direction and the Y direction to form a large number of branching structures as a feed circuit for an antenna, the ratio of feed to antenna elements coupled with the circuit can be changed, and thus the emission pattern can be changed. As a result, it is also possible to form an array antenna in which sidelobe control can be performed.

Figure 24A:
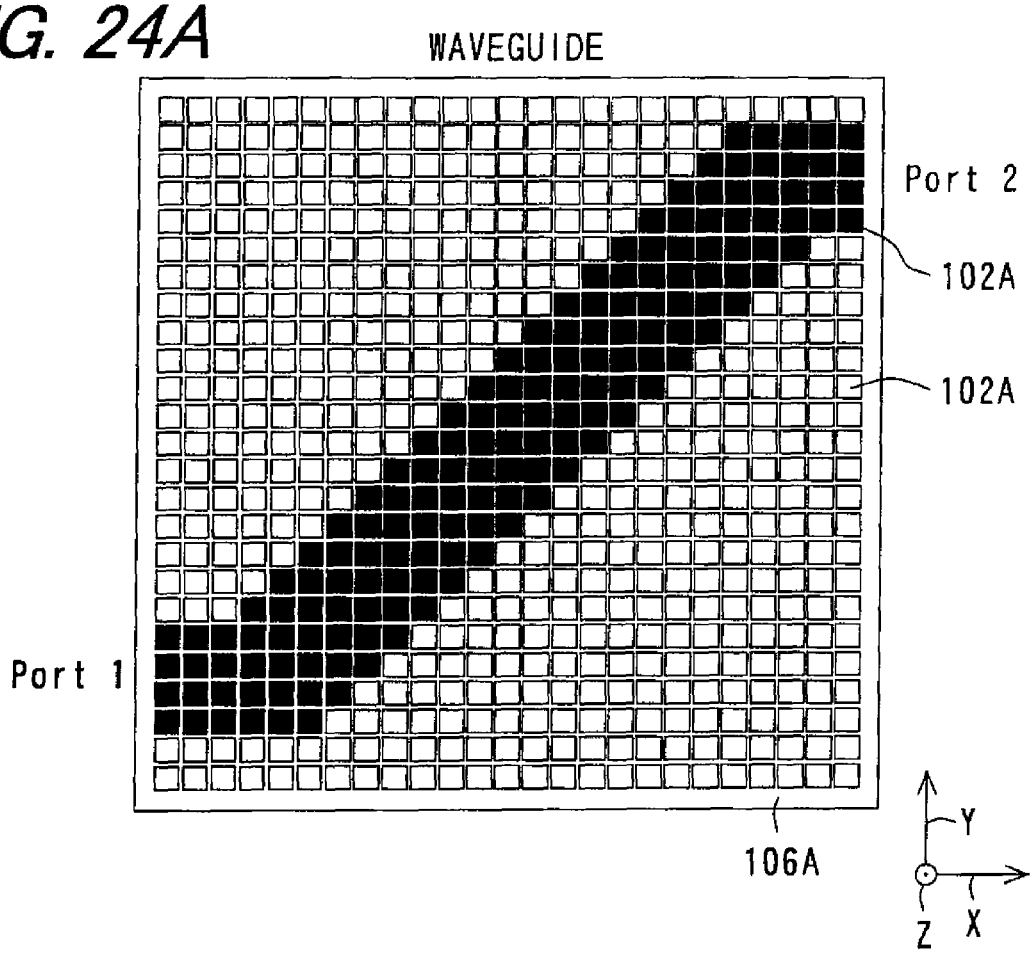
FIGS. 24A and 24B are plan views showing circuit patterns, where
Figure 24B:
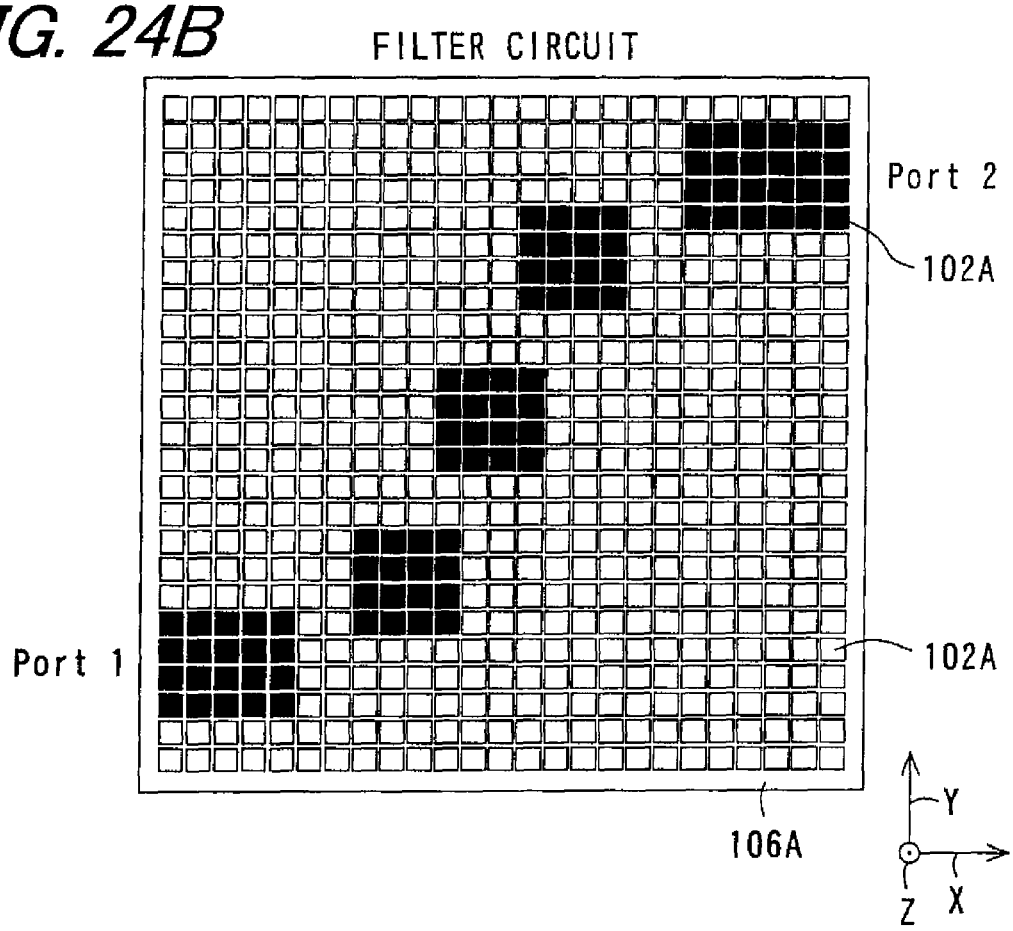

FIGS. 24A and 24B are plan views showing circuit patterns. FIG. 24A is a plan view showing a circuit pattern of a linear dielectric waveguide structure. FIG. 24B is a plan view showing a circuit pattern provided with a filtering function. In this embodiment, for example, the circuit pattern shown in FIG. 24A stored as a default can be changed into the circuit pattern provided with a filtering function (filter circuit), with an operation command from an operator. For example, the dielectric waveguide is made to have an island-pattern as shown in FIG. 24B, each island is made to have a size to function as a dielectric resonator, and the pitch of the islands is adjusted. A filter circuit can be easily and quickly realized by displacing predetermined control pins 102A to the up-status or the down-status, as shown in this state. Since the circuit pattern can be changed by displacing predetermined control pins 102A to the up-status or the down-status, the center frequency properties and passband of the filtering function also can be changed.

Figure 25A:
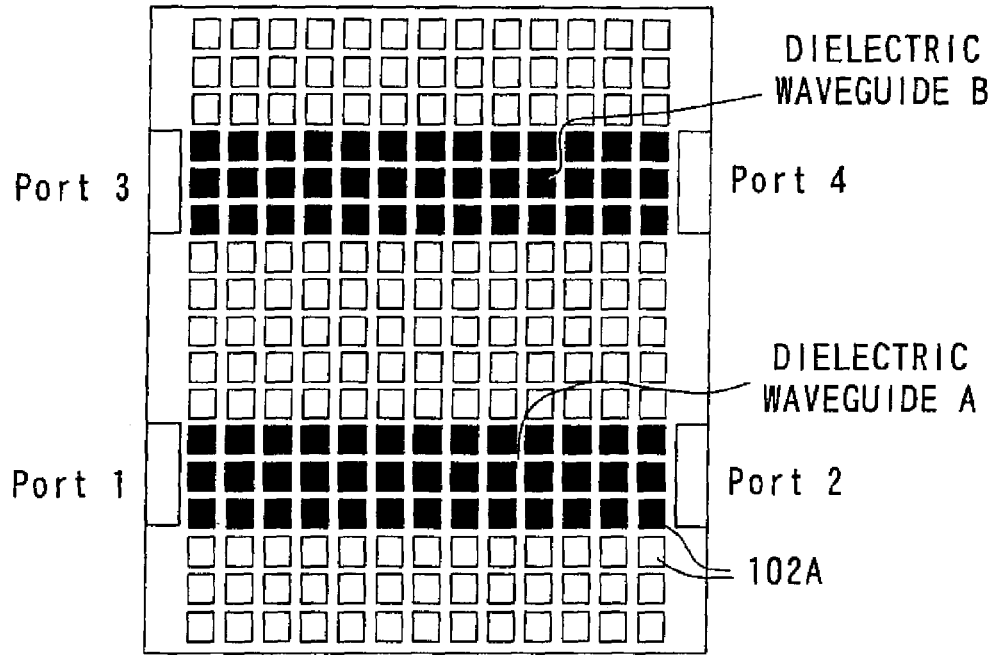
FIGS. 25A and 25B are views relating to a circuit pattern including independent dielectric waveguides A and B, where
Figure 25B:
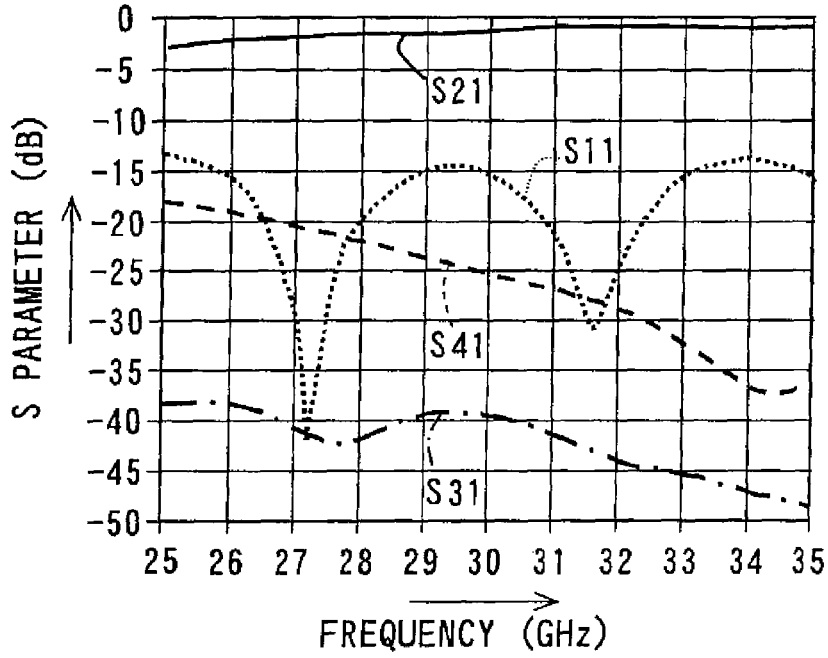

FIGS. 25A and 25B are views relating to a circuit pattern including independent dielectric waveguides A and B. FIG. 25A is a plan view showing a circuit pattern. FIG. 25B is a graph showing a simulation result obtained in this circuit pattern. In FIG. 25A, a hollow square indicates the control pin 102A in the down-status, and a solid square indicates the control pin 102A in the up-status in which a dielectric waveguide is formed. In this case, the size in the X and Y directions of the control pin 102A is 0.6 mm×0.6 mm, and the pitch both in the X and Y directions is 0.8 mm. The height of the control pin 102A in the up-status from the conductive layer 106A, that is, the Z-direction height is 3.0 mm, and the relative dielectric constant thereof is 9.0. As shown by the value of a parameter S21 in FIG. 25B, almost all of signals inputted from a port 1 are outputted from a port 2, and signals are not outputted from a port 3 and a port 4 of the dielectric waveguide B. The coupling amount from the dielectric waveguide A to the port 4 of the dielectric waveguide B can be changed by controlling the control pins 102A in various patterns.

Figure 26A:
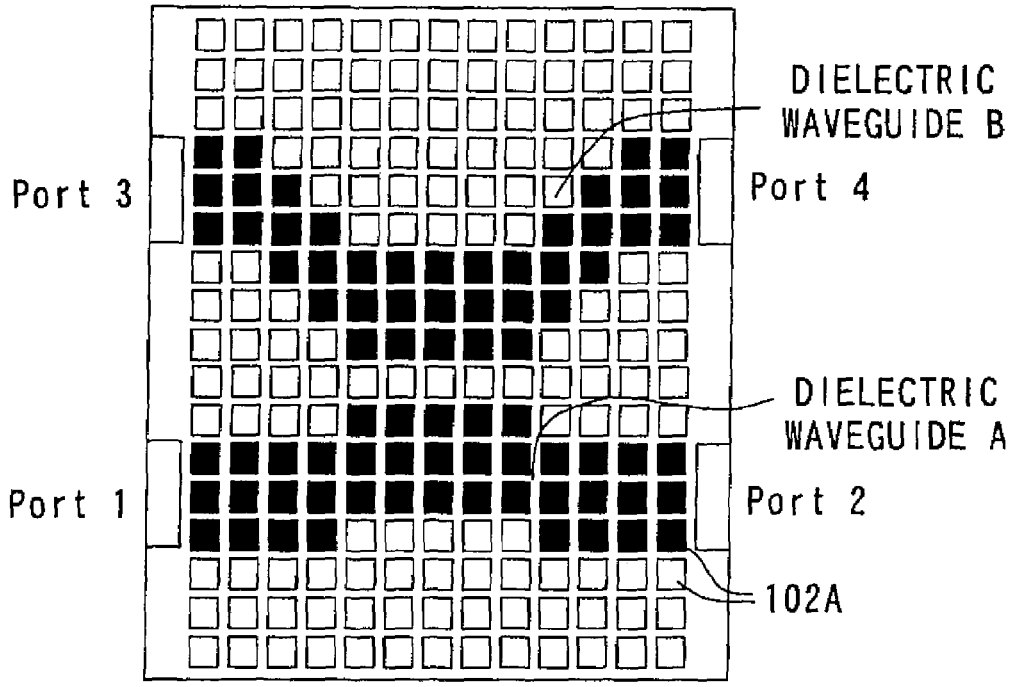
FIGS. 26A and 26B are views relating to a circuit pattern including the independent dielectric waveguides A and B, where
Figure 26B:
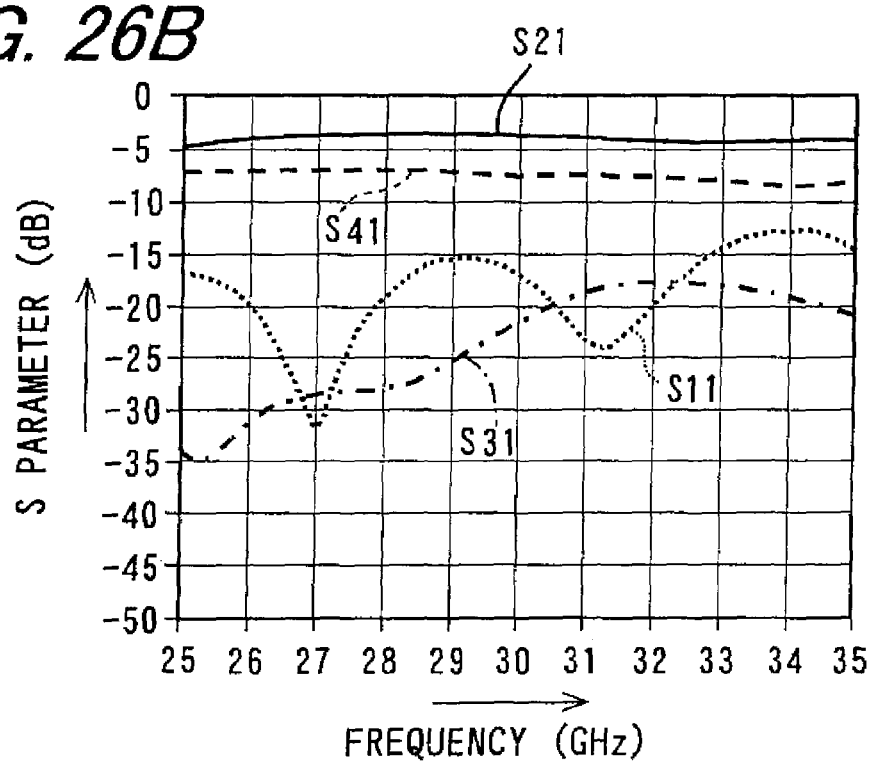

FIGS. 26A and 26B are views relating to a circuit pattern including the independent dielectric waveguides A and B. FIG. 26A is a plan view showing a circuit pattern. FIG. 26B is a graph showing a simulation result obtained in this circuit pattern. The size and the pitch of the control pins 102A are prescribed to be the same as those in FIGS. 25A and 25B. In the case of the circuit pattern shown in FIG. 26A, as shown in FIG. 26B, a large part of signals inputted from the port 1 of the dielectric waveguide A is outputted from the port 2, but the signals are coupled also to the port 4 of the dielectric waveguide B, and the coupling is approximately −11 dB at 30 GHz. The coupling to the port 3 is −20 dB or less, that is, coupling hardly takes place. That is to say, this circuit functions as a directional coupler. The coupling amount from the dielectric waveguide A to the port 4 of the dielectric waveguide B can be changed by controlling the control pins 102A in various patterns.

Figure 27A:
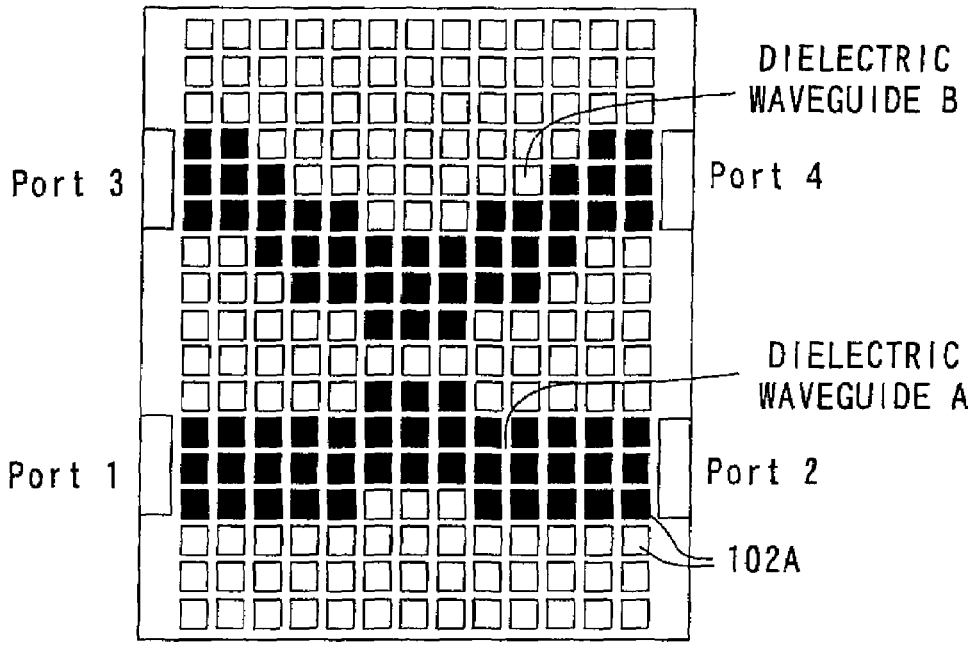
FIGS. 27A and 27B are views relating to a circuit pattern including the independent dielectric waveguides A and B, where
Figure 27B:
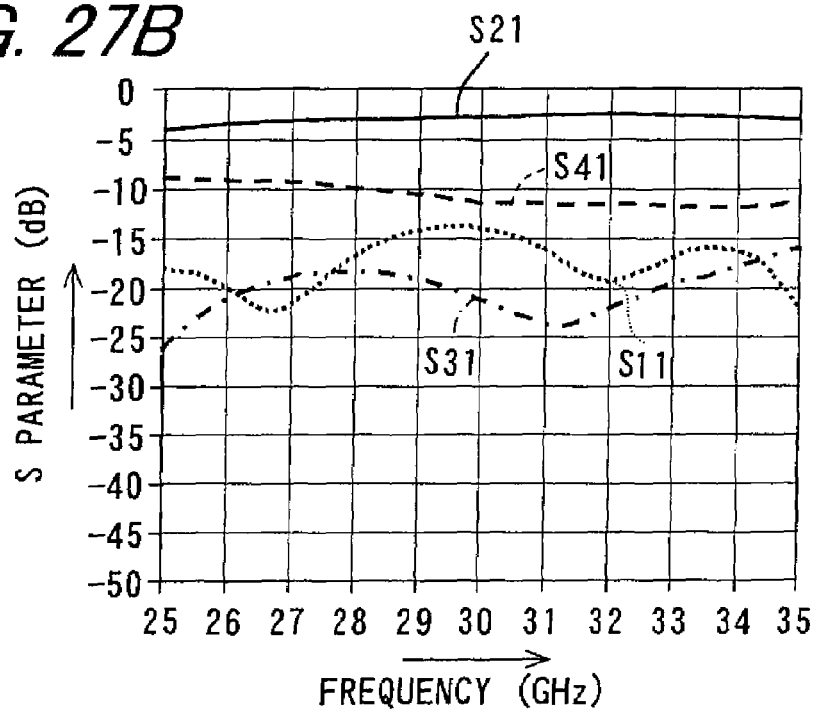

FIGS. 27A and 27B are views relating to a circuit pattern including the independent dielectric waveguides A and B. FIG. 27A is a plan view showing a circuit pattern. FIG. 27B is a graph showing a simulation result obtained in this circuit pattern. The size and the pitch of the control pins 102A are prescribed to be the same as those in FIGS. 25A and 25B. In the case of the circuit pattern shown in FIG. 27A, as shown in FIG. 27B, a large part of signals inputted from the port 1 of the dielectric waveguide A is outputted from the port 2, but the signals are coupled also to the port 4 of the dielectric waveguide B, and the coupling is approximately −8 dB at 30 GHz. The coupling to the port 3 is −20 dB or less, that is, coupling hardly takes place. That is to say, this circuit functions as a directional coupler. In this example, the coupling amount from the dielectric waveguide A to the port 4 of the dielectric waveguide B can be changed by controlling the control pins 102A in various patterns.

According to the fifth high frequency circuit 101B described above, the fifth high frequency circuit control portion 104B changes the dielectric waveguide shape of the fifth variable high frequency circuit forming portion 103B based on the pattern information (corresponding to expected information), and thus the fifth variable high frequency circuit forming portion 103B can be easily changed. Compared with a conventional technique in which a plurality of types of high frequency circuit components are selectively used, it is possible to simplify the structure and optimize the fifth variable high frequency circuit forming portion 103B. Thus, a high frequency circuit having high versatility can be realized.

According to the fifth high frequency circuit 101B, the conductive layer 106A and the plurality of control pins 102A can cooperate with each other to form a dielectric waveguide. The fifth variable high frequency circuit forming portion 103B can be easily changed by displacing each control pin 102A between the down-status and the up-status. The fifth variable high frequency circuit forming portion 103B is changed to have a dielectric waveguide shape of at least one of a power divider, a filter circuit, and a coupler. In this manner, the versatility of the fifth high frequency circuit 101B can be increased. In particular, compared with the structure that includes two conductive layers, it is possible to simplify the structure. The orientation of an electric field that is to be transmitted may be either perpendicular or parallel to the conductive material, and thus the versatility of the dielectric waveguide forming apparatus can be further increased. Since one conductive layer 106A is included, the amount of the control pins 102A inserted can be changed. Since the insertion amount can be changed, for example, the coupling amount of the coupler can be changed according to the insertion amount. Furthermore, in the case of a structure that includes two conductive layers, the range of frequencies that can be used with the interval between the conductive layers is limited to some extent. However, in the case of a structure that includes one conductive layer, the range of frequencies that are used can be changed according to the insertion amount or the width of the control pins. Thus, a high frequency circuit having high versatility can be realized.

Figure 28:
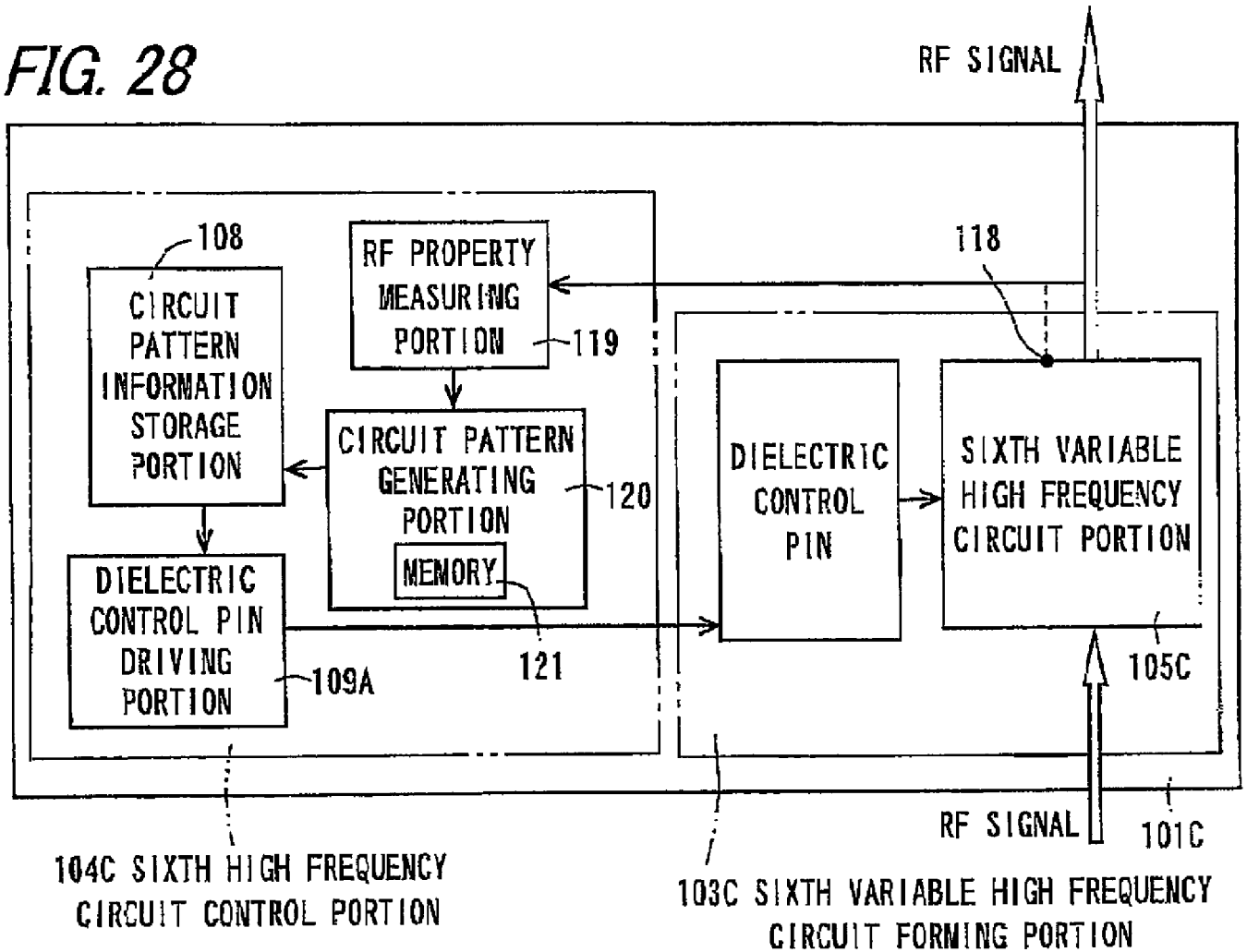
FIG. 28 is a block diagram showing the electric configuration of a variable high frequency circuit 101C according to a sixth embodiment.

FIG. 28 is a block diagram showing the electric configuration of a variable high frequency circuit 101C according to a sixth embodiment. The variable high frequency circuit 101C according to the sixth embodiment is referred to as a "sixth high frequency circuit 101C". The sixth high frequency circuit 101C includes a sixth variable high frequency circuit forming portion 103C as a circuit forming portion and a sixth high frequency circuit control portion 104C as control means. The sixth variable high frequency circuit forming portion 103C has a sixth variable high frequency circuit portion 105C and a plurality of control pins 102A. The property detecting port 118 for detecting high frequency signals processed in the sixth variable high frequency circuit portion 105C is formed in the sixth variable high frequency circuit portion 105C. A part of high frequency signals outputted from the property detecting port 118 is inputted to the RF property measuring portion 119 described later.

The sixth high frequency circuit control portion 104C includes the RF property measuring portion 119, the circuit pattern generating portion 120, the circuit pattern information storage portion 108, and the control pin driving portion 109A, which are electrically connected. High frequency signals outputted (finally outputted) from the property detecting port 118 are inputted to the RF property measuring portion 119. The RF property measuring portion 119 performs measurement to determine whether or not desired RF signals are outputted. Information indicating a result of this measurement is transmitted to the circuit pattern generating portion 120. The circuit pattern generating portion 120 has a function of determining whether or not high frequency signals processed in the sixth variable high frequency circuit portion 105C have been processed to obtain desired properties, and modifying the process.

The circuit pattern generating portion 120 has the memory 121 as storage means. The memory 121 stores therein reference data functioning as a determination reference for determining whether or not a process has been performed to obtain desired properties. Information indicating a result of the determination is temporarily stored in the memory 121, and this information and the reference data are used for comparison. The circuit pattern generating portion 120 generates a modified circuit pattern based on a result of the comparison. This modified circuit pattern is temporarily stored in the circuit pattern information storage portion 108. The circuit pattern information storage portion 108 transmits signals to the control pin driving portion 109A so that the circuit pattern is reproduced. In this manner, high frequency signals that are to be processed in the sixth variable high frequency circuit portion 105C can be easily and reliably modified. The sixth variable high frequency circuit portion 105C can output expected high frequency signals by repeating this feedback control.

For example, the coupler structure shown in FIG. 26A can be formed in the vicinity of output signals of a functional block that is to be measured, and waves can be separated in such a manner that the main signals are not significantly disturbed and outputted to the property detecting port 118. Accordingly, only a necessary functional block can be measured. Thus, compared with the case in which all functional blocks are measured, it is possible to reduce the processing load on the CPU and the like. The other functions and effects are the same as those in the fifth high frequency circuit 101B.

Figure 29:
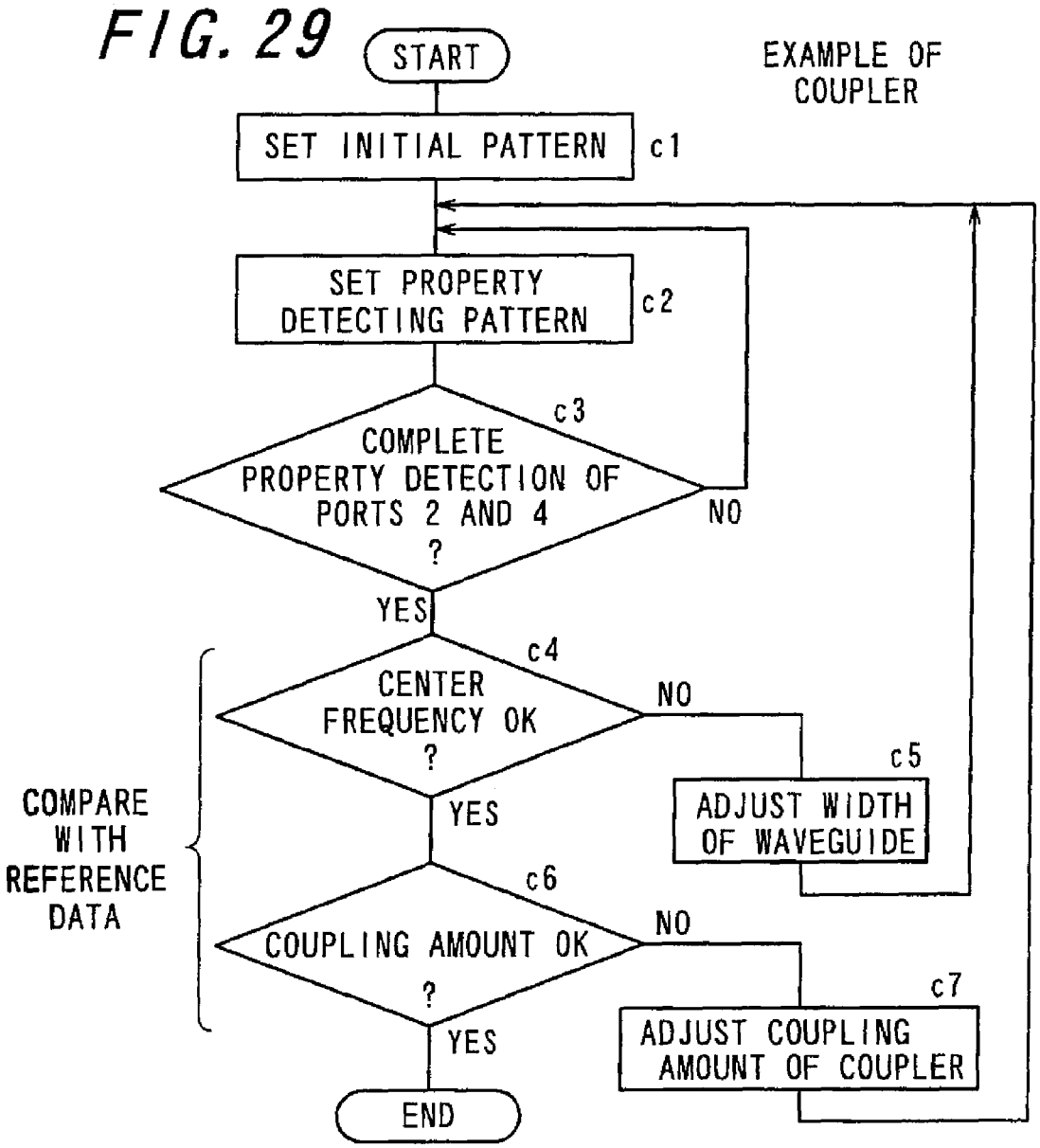
FIG. 29 is a flowchart showing the processing flow in the circuit pattern generating portion 120.

FIG. 29 is a flowchart showing the processing flow in the circuit pattern generating portion 120. In the description below, a reference is made also to FIG. 28. Unless otherwise specified, in this processing, the control is mainly performed in the circuit pattern generating portion 120. The procedure of the processing flow starts, for example, upon satisfying the condition that the main power (not shown) of the sixth high frequency circuit 101C is turned on. After the start, the procedure proceeds to step c1, where an initial pattern that is an initial dielectric waveguide shape is set. Next, the procedure proceeds to step c2, where a property detecting pattern is set. Next, the procedure proceeds to step c3, where it is determined whether or not property detection of the second port and the fourth port has been completed, in order to compare the reference data and the detected data. In a case where a result of the determination is "NO", the procedure returns to step c2.

In a case where it is determined that the property detection has been completed, the procedure proceeds to step c4. Based on a comparison result in step c4, signals are transmitted via the circuit pattern information storage portion 108 to the control pin driving portion 109A, to adjust the width of the dielectric waveguide. Then, the procedure returns to step c2. In a case where it is determined in step c4 that the center frequency is acceptable, the procedure proceeds to step c6. In step c6, a coupling amount of the measurement result and the reference data stored in the memory 121 are compared so that it is determined whether or not the coupling amount is acceptable. In a case where a result of the determination is "NO", the procedure proceeds to step c7, where based on the comparison result in step c6, signals are transmitted via the circuit pattern information storage portion 108 to the control pin driving portion 109A, to adjust the coupling amount of the coupler (see FIGS. 25A, 25B, 26A, and 26B). Then, the procedure returns to step c2. In a case where it is determined in step c6 that the coupling amount is acceptable, the procedure of this flow ends.

As described above, in steps c4 and c6, information that is the measurement result and the reference data are compared. In a case where it is determined that the measurement result does not satisfy the condition of the circuit pattern, adjustment is performed respectively in steps c5 and c7, and then the procedure returns to step c2. The sixth variable high frequency circuit portion 105C can precisely output expected high frequency signals by repeating this feedback control.

In this embodiment, the plurality of control pins 102A are arranged on the entire XY plane in the conductive layer 106A. However, the plurality of control pins 102A may be arranged only at a main portion of the entire XY plane in the conductive layer 106A. In this case, the structure of the variable high frequency circuit forming portion can be simplified, and the control system that displaces the control pins 102A also can be simplified.

The dielectric waveguide forming apparatus is applicable also to a high frequency circuit component other than the above-described high frequency circuit component such as a filter circuit. In this embodiment, the dielectric waveguide forming apparatus is applied to a high frequency circuit, but is applicable also to a low frequency circuit. In this case, it is possible to simplify the structure and optimize a variable low frequency circuit forming portion. Thus, a low frequency circuit having high versatility can be realized. As another embodiment of the invention, a desired high frequency circuit may be provided, for example, in which based on a request from a user, the plurality of control pins 102 are controlled to be in the up-status or the down-status, and then all the control pins are fixed so as not to be displaced. In this case, a plurality of types of high frequency circuit components do not have to be prepared, and thus the versatility of the high frequency circuit can be improved. In addition to the above, embodiments can be modified in various manners without departing from the gist of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

The invention claimed is:

1. A waveguide forming apparatus, comprising:

a circuit forming portion that can change a waveguide shape for forming a waveguide; and a control portion for controlling the circuit forming portion so as to change the waveguide shape of the circuit forming portion based on expected information.

2. The waveguide forming apparatus of claim 1, wherein the circuit forming portion includes a pair of conductive layers that are spaced away from each other, and a plurality of movable members that can form a waveguide in cooperation with the conductive layers, and each of the movable members can be displaced between a wall portion forming state in which the movable member forms a part of a wall portion of the waveguide and a wall portion non-forming state.

3. The waveguide forming apparatus of claim 2, further comprising a driving source that drives displacement of each of the movable members between the wall portion forming state and the wall portion non-forming state, the control portion controlling driving of the driving source.

4. The waveguide forming apparatus of any one of claims 1 to 3, wherein the control portion controls so as to change the circuit forming portion to have a waveguide shape of at least one of a power divider, a filter circuit, and a coupler.

5. A high frequency circuit, comprising:

a pair of conductive layers that are spaced away from each other;

a plurality of control pins that are made of a conductive material, and arranged so as to be displaceable through holes that are formed in at least one of the pair of conductive layers, in a thickness direction of the conductive layer; and a control portion for controlling a displacement position of the control pins in the thickness direction, the control portion forming an H guide or NRD guide, with the control pins whose displacement position in the thickness direction is controlled and the pair of conductive layers.

6. A high frequency circuit, comprising;

a pair of conductive layers that are spaced away from each other;

a plurality of control pins that are made of a conductive material, and arranged so as to be displaceable through holes that are formed in at least one of the pair of conductive layers, in a thickness direction of the conductive layer; and a control portion for controlling a displacement position of the control pins in the thickness direction, two rows of slots being formed in at least one of the pair of conductive layers, the two rows of slots being arranged such that a longitudinal direction of one row of the slots is perpendicular to a longitudinal direction of the other row of the slots, and control of the control portion being executed so that switching can be performed between a state in which vertically polarized waves are emitted from one row of the slots and a state in which horizontally polarized waves are emitted from the other row of the slots.

7. A dielectric wave guide forming apparatus, comprising:

a circuit forming portion that can change a dielectric waveguide shape for forming a dielectric waveguide; and a control portion for controlling the circuit forming portion so as to change the dielectric waveguide shape of the circuit forming portion based on expected information.

8. The dielectric waveguide forming apparatus of claim 7, wherein the circuit forming portion includes a pair of conductive layers that are spaced away from each other, and a plurality of movable member that can form a dielectric waveguide in cooperation with the conductive layers, and each of the movable members can be displaced between a dielectric waveguide forming state in which the movable member forms a part of the dielectric waveguide and a dielectric waveguide non-forming state.

9. The dielectric waveguide forming apparatus of claim 8, further comprising a driving source that drives displacement of each of the movable members between the dielectric wave guide forming state and the dielectric waveguide non-forming state, the control portion controlling driving of the driving source.

10. The dielectric waveguide forming apparatus of any one of claims 7 to 9, wherein the control portion controls so as to change the circuit forming portion to have a dielectric waveguide shape of at least one of a filter circuit and a coupler.

11. The dielectric waveguide forming apparatus of claim 7, wherein the circuit forming portion includes one conductive layer and a plurality of movable members that can form a dielectric waveguide in cooperation with the conductive layer, and each of the movable members can be displaced between a dielectric waveguide forming state in which the movable member forms a part of the dielectric waveguide and a dielectric waveguide non-forming state.

12. The dielectric waveguide forming apparatus of claim 11, further comprising a driving source that drives displacement of each of the movable members between the dielectric waveguide forming state and the dielectric waveguide non-forming state, the control portion controlling driving of the driving source.

13. The dielectric waveguide forming apparatus of claim 11 or 12, wherein the control portion controls so as to change the circuit forming portion to have a dielectric waveguide shape of at least one of a power divider, a filter circuit, and a coupler.

* * * * *